US008746865B2

(12) United States Patent
Tojo et al.

(10) Patent No.: US 8,746,865 B2
(45) Date of Patent: Jun. 10, 2014

(54) IMAGE FORMING METHOD

(75) Inventors: Kaoru Tojo, Kanagawa (JP); Toshihiro Kariya, Kanagawa (JP); Terukazu Yanagi, Kanagawa (JP); Akio Tamura, Kanagawa (JP); Minoru Sakai, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 474 days.

(21) Appl. No.: 13/074,036

(22) Filed: Mar. 29, 2011

(65) Prior Publication Data

US 2011/0242200 A1 Oct. 6, 2011

(30) Foreign Application Priority Data

Mar. 31, 2010 (JP) ..... 2010-082287
Mar. 31, 2010 (JP) ..... 2010-082288
Mar. 31, 2010 (JP) ..... 2010-082289

(51) Int. Cl.
*B41J 2/01* (2006.01)
*B41J 2/21* (2006.01)

(52) U.S. Cl.
CPC . *B41J 2/01* (2013.01); *B41J 2/2107* (2013.01)
USPC ..... 347/96; 347/95; 347/100

(58) Field of Classification Search
CPC ..... B41J 2/01; B41J 2/211; B41J 2/1433; B41J 2/17; B41J 2/17593; B41J 2/2107; B41J 2/1755; B41J 2/2114; B41J 11/0015; B41J 2/2056; B41J 2/21; C09D 11/36; C09D 11/40; C09D 11/30; C09D 11/38; C09D 11/322; C09D 11/328; C09D 11/101
USPC ..... 347/100, 95, 96, 101, 102, 88, 99, 21, 347/20; 106/31.6, 31.13, 31.27; 523/160, 523/161
See application file for complete search history.

(56) References Cited

U.S. PATENT DOCUMENTS 5,618,338 A 4/1997 Kurabayashi et al.
2001/0055052 A1* 12/2001 Mueller et al. ..... 347/88
2002/0009547 A1* 1/2002 Ito et al. ..... 106/31.2
2002/0027586 A1* 3/2002 Kikuchi et al. ..... 347/104

(Continued)

FOREIGN PATENT DOCUMENTS

EP 1145865 A2 10/2001
JP 62-246730 A 10/1987

(Continued)

OTHER PUBLICATIONS

English language translation of the following: Office action dated Aug. 6, 2013 from the JPO in a Japanese patent application corresponding to the instant patent application. This office action translation is submitted now in order to supplement the understanding of patent document JP2000-108495 which is cited in the office action and is being disclosed in the instant Information Disclosure Statement.

(Continued)

*Primary Examiner* — Manish S Shah
(74) *Attorney, Agent, or Firm* — SOLARIS Intellectual Property Group, PLLC

(57) ABSTRACT

An image forming method including applying an ink composition onto a recording medium by an inkjet method, and applying an liquid including particles onto the recording medium is disclosed.

20 Claims, 1 Drawing Sheet

(56) References Cited

U.S. PATENT DOCUMENTS

| | | | | |
|---|---|---|---|---|
| 2002/0067402 | A1* | 6/2002 | Nishita | 347/102 |
| 2003/0174195 | A1* | 9/2003 | Onishi et al. | 347/105 |
| 2004/0032473 | A1* | 2/2004 | Ishimoto et al. | 347/100 |
| 2005/0212882 | A1* | 9/2005 | Naniwa | 347/102 |
| 2007/0195145 | A1* | 8/2007 | Yamashita et al. | 347/101 |
| 2009/0246488 | A1* | 10/2009 | Yanagi et al. | 428/207 |

FOREIGN PATENT DOCUMENTS

| | | | |
|---|---|---|---|
| JP | H08-72393 | | 3/1996 |
| JP | 10-130621 | A | 5/1998 |
| JP | 2000-108495 | | 4/2000 |
| JP | 2000141886 | A | 5/2000 |
| JP | 2004-50751 | A | 2/2004 |
| JP | 2009-220299 | A | 10/2009 |
| JP | 2009-226810 | | 10/2009 |
| JP | 2010-046844 | | 3/2010 |
| JP | 2010-046896 | | 3/2010 |

OTHER PUBLICATIONS

English language translation of the following: Office action dated Jun. 25, 2013 from the JPO in a Japanese patent application corresponding to the instant patent application. This office action translation is submitted now in order to supplement the understanding of patent document JP2000-046844, JPH08-72393, JP08-72393, JP2009-226810 and JP2010-046896 which are cited in the office action and are being disclosed in the instant Information Disclosure Statement.

Corresponding EPO Official communication (May 20,2011).

* cited by examiner

IMAGE FORMING METHOD

CROSS-REFERENCE TO RELATED APPLICATION

This application is based on and claims priority under 35 USC 119 from Japanese Patent Application No. 2010-082287 filed on Mar. 31, 2010, Japanese Patent Application No. 2010-082288 filed on Mar. 31, 2010, and Japanese Patent Application No. 2010-082289 filed on Mar. 31, 2010, the disclosures of which are incorporated herein by reference.

BACKGROUND OF THE INVENTION

1. Technical Field

The present invention relates to an image forming method.

2. Description of the Related Art

Printed articles obtained by printing using a commercial printer for off-set printing or the like are stacked in a large amount and at a high speed on a paper discharge unit. Then, the ink (image) printed on one printed article adheres to another stacked printed article, and thus if the adhered printed articles are detached from each other, a phenomenon in which ink is removed from the one printed article and adhered to the other printed article (blocking) may occur. In order to inhibit such blocking, in the case of off-set printing, after printing, a powder, for example, starch, is sprayed out as a blocking inhibiting agent and adhered to the surface of printed articles, thereby preventing adherence between inks. For example, Japanese Patent Application Laid-Open (JP-A) No. 62-246730 discloses a method in which an aerosol including powder of particles is adhered to the surface of paper by a mist chamber so as to inhibit blocking. Further, JP-A No. 10-130621 proposes a method in which, in off-set printing, powder is sprayed out in a small amount onto the surface of printed articles.

On the other hand, ink jet techniques have been applied as an image recording method for recording color images in the field of office printers, home printers, and the like. Recently, with respect to commercially available printers, ink jet technology has improved in regard to large-quantity printing and high-speed printing. In such commercial printing, since printed articles are stacked in a large amount and at a high speed on the paper discharge unit, blocking occurs in some cases.

Moreover, in ink jet printing, a fixing treatment using a fixing roller or the like may be performed in order to improve abrasion resistance and the like, but off-set (fixing off-set, which is an off-set occurring at the time of fixing) in which an image section on a recording medium is transferred to the fixing roller occurs in some cases.

In this regard, aforementioned JP-A No. 62-246730 discloses, as a technique to inhibit such blocking (a phenomenon in which pieces of stacked printed articles are adhered to each other and the ink of the image portion of one printed article is adhered to the back side of the other printed article), attaching a liquid including powder of particles to the surface of paper.

JP-A No. 2004-50751 discloses a technique in which a resin liquid including resin particles is coated on a recording surface to form a resin-coated film which forms a protective layer including the resin-coated film for coating the image.

JP-A No. 2009-220299 discloses that a liquid including particles is applied and dried to apply ink.

SUMMARY OF THE INVENTION

However, none of JP-A Nos. 62-246730, 2004-50751, and 2009-220299 includes a study on reduction of the above-described fixing off-set that occurs when an ink jet image is subjected to a fixing treatment.

Further, none of JP-A Nos. 62-246730, 2004-50751, and 2009-220299 includes a study on improvement of the glossiness of a formed image, and in particular, a technique for forming a resin-coated film on a recording side such as that disclosed in JP-A No. 2004-50751, only results in an insufficient effect of inhibiting of blocking and glossiness.

Moreover, neither of JP-A Nos. 62-246730 and 2004-50751 includes a study on a both-side printing property as an index indicative of a resolution of printed letters or the like on the second side in a case in which, in both-side printing, printing is carried out on the second side of the printed recording medium on which printing has been carried out on the first side, which is thus extremely insufficient in terms of practical use.

Furthermore, JP-A Nos. 62-246730 and 10-130621 do not include sufficient studies on the problem of fixing off-set.

Furthermore, in a case in which the method of JP-A No. 10-130621 is employed for an ink jet system, problems such as powder attaching to the tip of an ink jet nozzle and clogging of a nozzle easily occur.

According to a first aspect of the present invention, an image forming method including applying an ink composition onto a recording medium by an inkjet method, and applying an liquid including particles onto the recording medium is provided.

According to a second aspect of the present invention, an image forming method according to <1>, which includes recording an image on a recording medium by an ink jet method using an ink composition including a coloring material, first polymer particles having a film-forming property, a water-soluble organic solvent, and water, applying a liquid including second polymer particles having a glass transition temperature onto a surface of a heating roller or a surface of the image, and bringing the heating roller into contact with the surface of the image, wherein a minimum film-forming temperature $T_A$ expressed by ° C. of a mixture of the first polymer particles and the water-soluble organic solvent, a surface temperature $T_B$ expressed by ° C. of the heating roller, and a glass transition temperature $T_C$ expressed by ° C. of the second polymer particles satisfy the relationship of $T_A<T_B<T_C$, is provided.

According to a third aspect of the present invention, an image forming method according to <1>, which includes applying an ink composition onto a recording medium by an inkjet method, and applying a dispersion liquid onto the recording medium onto which the ink composition has been applied, the dispersion liquid including polymer particles having a volume average diameter of from 1 μm to 30 μm and a glass transition temperature Tg of 100° C. or higher and an nonvolatile solvent, is provided.

According to a fourth aspect of the present invention, an image forming method according to <1>, which includes applying an ink composition onto a recording medium by an inkjet method, and applying a particle-containing liquid including particles and a nonvolatile solvent onto the recording medium, wherein a volume average particle diameter of the particles is two times or larger the maximum thickness of a dried film of the ink composition applied onto the recording medium, is provided.

DETAILED DESCRIPTION OF THE INVENTION

Figure 1:
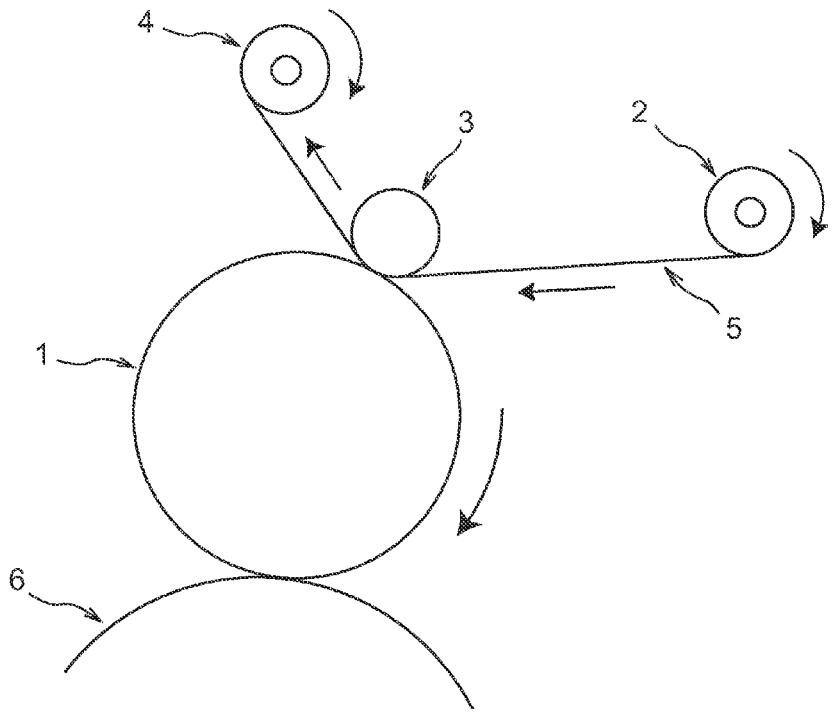
FIG. 1 is a schematic view showing a device used at a fixing process of an embodiment of the present invention.

According to the first aspect of the present invention, there is provided an image forming method including applying an ink composition onto a recording medium by an ink jet method and applying a liquid including particles onto the recording medium.

An embodiment of the image forming method according to the first aspect of the present invention may be an image forming method including recording an image on a recording medium by an ink jet method using an ink composition including a coloring material, first polymer particles having a film-forming property, a water-soluble organic solvent, and water (recording process), applying a liquid including second polymer particles having a glass transition temperature onto a surface of a heating roller or a surface of the image (application process), and bringing the heating roller into contact with the surface of the image (fixing process), wherein a minimum film-forming temperature $T_A$ expressed by ° C. of a mixture of the first polymer particles and the water-soluble organic solvent, a surface temperature $T_B$ expressed by ° C. of the heating roller, and a glass transition temperature $T_C$ expressed by ° C. of the second polymer particles satisfy the relationship of $T_A<T_B<T_C$. Hereinafter, the image forming method of this embodiment is also referred to as a first image forming method.

Another embodiment of the image forming method according to the first aspect of the present invention may be an image forming method including applying an ink composition onto a recording medium by an inkjet method (ink application process), and applying a dispersion liquid onto the recording medium onto which the ink composition has been applied (dispersion liquid application process), the dispersion liquid including polymer particles having a volume average diameter of from 1 μm to 30 μm and a glass transition temperature Tg of 100° C. or higher and an nonvolatile solvent. Hereinafter, the image forming method of this embodiment is also referred to as a second image forming method.

Another embodiment of the image forming method according to the first aspect of the present invention may be an image forming method including applying an ink composition onto a recording medium by an inkjet method (first process), and applying a particle-containing liquid including particles and a nonvolatile solvent onto the recording medium (second process), wherein a volume average particle diameter of the particles is two times or larger the maximum thickness of a dried film of the ink composition applied onto the recording medium. Hereinafter, the image forming method of this embodiment is also referred to as a third image forming method.

Numerical values defined by using an expression "from . . . to ." represents ranges inclusive of the numbers that respectively appear at the left and right of "to" as the minimum value and the maximum value, respectively.

I. First Image Forming Method

The first image forming method is described. Further, in this section of "First Image Forming Method", the first image forming method may be simply referred to as "the present embodiment" in some cases.

The present inventors have conducted extensive studies, and as a result, attention has been paid to a relationship of: (1) a relationship of polymer particles and an organic solvent included in an ink composition of an ejected ink (minimum film-forming temperature), (2) a glass transition temperature of the resin particles applied on the image surface on which ink has been ejected in order to prevent the blocking; and (3) a temperature of a heating roller in contact with the ink and the resin particles. Further, they have also discovered that glossiness, blocking, fixing off-set, and the like can be influenced by controlling relationship of these factors, thereby obtaining the first image forming method.

The first image forming method includes recording an image on a recording medium by an inkjet method using an ink composition containing a coloring material, first polymer particles having a film-forming property, a water-soluble organic solvent, and water (recording process); applying a liquid containing second polymer particles having a glass transition temperature onto a surface of a heating roller or a surface of the image (application process), and bringing the heating roller into contact with the surface of the image (fixing process), wherein the minimum film-forming temperature $T_A$° C. of a mixture of the first polymer particles and the water-soluble organic solvent contained in the ink composition, the surface temperature $T_B$° C. of the heating roller, and the glass transition temperature $T_C$° C. of the second polymer particles satisfy the relationship of $T_A<T_B<T_C$. Hereinbelow, each process is described in detail.

1. Recording Process

The recording process of the present embodiment is a process in which an ink composition containing a coloring material, polymer particles having a film-forming property, a water-soluble organic solvent, and water is used to record an image on a recording medium by an ink jet method.

(1) Ink composition

The ink composition of the present embodiment contains a coloring material, polymer particles having at least a film-forming property, a water-soluble organic solvent, and water.

(Coloring Material)

The ink composition of the present embodiment contains at least one kind of coloring materials.

As the coloring material, a known dye, a pigment, or the like can be used without particular limitation. Among these, the coloring material is preferably insoluble or poorly soluble in water from the viewpoints of ink colorability. Specific examples thereof include various pigments, dispersion dyes, oil-soluble dyes, coloring matters forming a J-aggregate, and the like, and a pigment is more preferred.

In the present embodiment, a water-insoluble pigment as it is or a pigment which has been surface-treated with a dispersant can be used as a coloring material.

The type of the pigment in the present embodiment is not particularly limited, and any of conventionally known organic pigments and inorganic pigments may be used. Examples of the pigment include polycyclic pigments such as an azo lake, an azo pigment, a phthalocyanine pigment, a perylene pigment, a perynone pigment, an anthraquinone pigment, a quinacridone pigment, a dioxazine pigment, a diketopyrrolopyrrole pigment, a thioindigo pigment, an isoindolinone pigment, a quinophthalone pigment, and the like, dye lakes such as basic dye lakes, acidic dye lakes, and the like, organic pigments such as a nitro pigment, a nitroso pigment, aniline black, a daylight fluorescent pigment, and the like, and inorganic pigments such as titanium oxide, an iron oxide-based pigment, a carbon black-based pigment, and the like. Also, pigments that can be dispersed in an aqueous phase may be used even if they are not described in the Color Index. Further, pigments obtained by subjecting the above-described pigments to surface treatment with a surfactant, a polymer dispersant, or the like, grafted carbon, or the like may be used. Among these pigments, preferable examples include an azo pigment, a phthalocyanine pigment, an anthraquinone pigment, a quinacridone pigment, and a carbon black-based pigment.

Specific examples of the organic pigments that are used in the present embodiment are described below.

Examples of the organic pigments for orange or yellow include C. I. pigment orange 31, C. I. pigment orange 43, C. I. pigment yellow 12, C. I. pigment yellow 13, C. I. pigment yellow 14, C. I. pigment yellow 15, C. I. pigment yellow 17, C. I. pigment yellow 74, C. I. pigment yellow 93, C. I. pigment yellow 94, C. I. pigment yellow 128, C. I. pigment yellow 138, C. I. pigment yellow 151, C. I. pigment yellow 155, C. I. pigment yellow 180, C. I. pigment yellow 185, and the like.

Examples of the organic pigments for magenta or red include C. I. pigment red 2, C. I. pigment red 3, C. I. pigment red 5, C. I. pigment red 6, C. I. pigment red 7, C. I. pigment red 15, C. I. pigment red 16, C. I. pigment red 48:1, C. I. pigment red 53:1, C. I. pigment red 57:1, C. I. pigment red 122, C. I. pigment red 123, C. I. pigment red 139, C. I. pigment red 144, C. I. pigment red 149, C. I. pigment red 166, C. I. pigment red 177, C. I. pigment red 178, C. I. pigment red 222, C. I. pigment violet 19, and the like.

Examples of the organic pigments for green or cyan include C. I. pigment blue 15, C. I. pigment blue 15:2, C. I. pigment blue 15:3, C. I. pigment blue 15:4, C. I. pigment blue 16, C. I. pigment blue 60, C. I. pigment green 7, aluminum phthalocyanine pigments crosslinked with siloxane as described in U.S. Pat. No. 4,311,775, and the like.

Examples of the organic pigments for black include C. I. pigment black 1, C. I. pigment black 6, C. I. pigment black 7, and the like.

—Dispersant—

In a case in which the coloring material in the present embodiment is a pigment, the pigment is preferably dispersed in an aqueous solvent by a dispersant. The dispersant may be either a polymer dispersant or a low-molecular-weight surfactant-type dispersant. The polymer dispersant may be either a water-soluble dispersant or a water-insoluble dispersant.

With the low-molecular-weight surfactant-type dispersant (hereinafter also referred to as "low-molecular-weight dispersant" in some cases), an organic pigment can be stably dispersed in an aqueous medium, while maintaining the viscosity of the ink at a low level. The low-molecular-weight dispersant is a low-molecular-weight dispersant having a molecular weight of 2000 or less. The molecular weight of the low-molecular-weight dispersant is preferably from 100 to 2000, and more preferably from 200 to 2000.

The low-molecular-weight dispersant has a structure containing a hydrophilic group and a hydrophobic group. The number of hydrophilic groups and the number of hydrophobic groups in one molecule may be each independently one or more, and the low-molecular-weight dispersant may have plural kinds of hydrophilic group or plural kinds of hydrophobic group. The low-molecular-weight dispersant may optionally have a linking group for linking a hydrophilic group and a hydrophobic group.

Examples of the hydrophilic group include an anionic group, a cationic group, a nonionic group, a betaine type hydrophilic group having a combination of the above groups, and the like.

The anionic group is not particularly limited so long as the group has a negative charge, but the anionic group is preferably a phosphoric acid group, a phosphonic acid group, a phosphinic acid group, a sulfuric acid group, a sulfonic acid group, a sulfinic acid group, or a carboxylic group, more preferably a phosphoric acid group, or a carboxylic group, and even more preferably a carboxylic group.

The cationic group is not particularly limited so long as the group has a positive charge, but the cationic group is preferably an organic cationic substituent, more preferably a cationic group containing a nitrogen atom or a phosphorus atom, and even more preferably a cationic group containing a nitrogen atom. Among those, the cationic group is particularly preferably a pyridinium cation or an ammonium cation.

The nonionic group is not particularly limited so long as the group does not have a negative or a positive charge. Examples of the nonionic group include a part of polyalkylene oxide, polyglycerin, or sugar unit.

In the present embodiment, a hydrophilic group or an anionic group is preferable from the viewpoints of dispersion stability and aggregation properties of a pigment.

Furthermore, in a case in which the low-molecular-weight dispersant has an anionic hydrophilic group, its pKa is preferably 3 or more in terms of promoting an aggregation reaction upon contact with an acidic treatment liquid. The pKa of the low-molecular-weight dispersant in the present embodiment is a value experimentally determined based on a titration curve that is obtained by titrating a 1 mmol/L solution of the low-molecular-weight dispersant dissolved in a tetrahydrofuran/water solution (THF:water=3:2, V/V), with an aqueous acid or alkaline solution.

Theoretically, if the pKa of a low-molecular-weight dispersant is 3 or more, 50% or more of the anionic groups are in a non-dissociation state when contacted with a treatment liquid having a pH of about 3. Therefore, water solubility of the low-molecular-weight dispersant is remarkably decreased, and an aggregation reaction occurs, namely, aggregation reactivity is improved. From these viewpoints, the low-molecular-weight dispersant preferably has a carboxylic group as an anionic group.

On the other hand, the hydrophobic group may have, for example, any of a hydrocarbon-based structure, a fluorocarbon-based structure, and a silicone-based structure, and a hydrocarbon-based structure is particularly preferable. Further, the hydrophobic group may have a straight chain structure or a branched structure. Also, the hydrophobic group may have a single chain structure or a chain structure having two or more chains, and in a case in which the hydrophobic group has a structure having two or more chains, the structure may have plural kinds of hydrophobic group.

The hydrophobic group is preferably a hydrocarbon group having from 2 to 24 carbon atoms, more preferably a hydrocarbon group having from 4 to 24 carbon atoms, and even more preferably a hydrocarbon group having from 6 to 20 carbon atoms.

Among the polymer dispersants which may be used in the present embodiment, as the water-soluble dispersant, a hydrophilic polymer compound can be used. Examples of the hydrophilic polymer compound include natural hydrophilic polymer compounds, and examples the natural hydrophilic polymer compound include plant polymers such as gum arabic, gum tragacanth, guar gum, gum karaya, locust bean gum, arabinogalactan, pectin, quince seed starch, and the like, sea weed-based polymers such as alginic acid, carrageenan, agar, and the like, animal-based polymers such as gelatin, casein, albumin, collagen, and the like, microbial-based polymers such as xanthan gum, dextran, and the like, and others.

Examples of hydrophilic polymer compounds obtained by chemically modifying natural raw materials include cellulose-based polymers such as methyl cellulose, ethyl cellulose, hydroxyethyl cellulose, hydroxypropyl cellulose, carboxymethyl cellulose, and the like, starch-based polymers such as sodium starch glycolate, sodium starch phosphate ester, and the like, sea weed-based polymers such as propylene glycol alginate and the like, and others.

Examples of synthetic water-soluble polymer compounds include vinyl-based polymers such as polyvinyl alcohol, polyvinyl pyrrolidone, polyvinyl methyl ether, and the like; acrylic resins such as polyacrylamide, polyacrylic acid and alkali metal salts thereof, water-soluble styrene acrylic resins, and the like, water-soluble styrene maleic acid resins, water-soluble vinylnaphthalene acrylic resins, water-soluble vinylnaphthalene maleic acid resins, polyvinyl pyrrolidone, polyvinyl alcohol, alkali metal salts of formalin condensates of β-naphthalene sulfonic acid, polymer compounds having, at a side chain, a salt of a cationic functional group such as a quaternary ammonium group, an amino group, and the like, and others.

Among those, a polymer compound containing a carboxy group is preferable from the viewpoints of dispersion stability and aggregation properties of the pigment. For example, polymer compounds containing a carboxy group such as acrylic resins such as water-soluble styrene acrylic resins, water-soluble styrene maleic acid resins, water-soluble vinylnaphthalene acrylic resins, and water-soluble vinylnaphthalene maleic acid resins, and the like are particularly preferable.

Among the polymer dispersants, as the water-insoluble dispersant, a polymer having both hydrophilic and hydrophobic moieties can be used. Examples thereof include styrene-(meth)acrylic acid copolymers, styrene-(meth)acrylic acid-(meth)acrylic ester copolymers, (meth)acrylic ester-(meth) acrylic acid copolymers, polyethylene glycol (meth)acrylate-(meth)acrylic acid copolymers, styrene-maleic acid copolymers, and the like.

The acid value of the polymer dispersant is preferably 100 mg KOH/g or less. Further, the acid value is more preferably from 25 mg KOH/g to 100 mg KOH/g, and particularly preferably from 30 mg KOH/g to 90 mg KOH/g, from the viewpoints of good aggregation properties when a treatment liquid is in contact therewith.

The weight average molecular weight of the polymer dispersant in the present embodiment is preferably from 3,000 to 200,000, more preferably from 5,000 to 100,000, even more preferably from 5,000 to 80,000, and yet even more preferably from 10,000 to 60,000.

Further, the mixing ratio by mass of the pigment to the dispersant (pigment:dispersant) is preferably in a range of from 1:0.06 to 1:3, more preferably in a range of from 1:0.125 to 1:2, and even more preferably in a range of from 1:0.125 to 1:1.5.

In a case in which a dye is used as a coloring material in the present embodiment, a dye retained on a water-insoluble carrier may be used as water-insoluble coloring particles. As the dye, a known dye can be used without particular limitation, and the dyes described in, for example, JP-A Nos. 2001-115066, 2001-335714, 2002-249677, and the like can also be used preferably in the present embodiment. Also, as the carrier, an inorganic material, an organic material, or a composite material thereof, which is insoluble in water or poorly soluble in water, can be used without particular limitation. Specifically, the carriers described in, for example, JP-A Nos. 2001-181549, 2007-169418, and the like can also be used preferably in the present embodiment.

The carrier retaining the dye (water-insoluble coloring particles) can be used in the form of an aqueous dispersion formed by using a dispersant. As the dispersant, the above-mentioned dispersants can be used preferably.

The coloring material in the present embodiment preferably includes a pigment and a dispersant, more preferably includes an organic pigment and a polymer dispersant, and particularly preferably includes an organic pigment and a polymer dispersant containing carboxy group from the viewpoints of abrasion resistance and aggregation properties.

Further, the coloring material is preferably covered with a polymer dispersant containing a carboxy group, and is water-insoluble, from the viewpoints of aggregation properties.

In the present embodiment, from the viewpoint of aggregation properties, it is preferable that the acid value of the particle of the self-dispersing polymer as described later is smaller than the acid value of the above-mentioned polymer dispersant.

The average particle diameter of the coloring material is preferably from 10 nm to 200 nm, more preferably from 10 nm to 150 nm, and even more preferably from 10 nm to 100 nm. If the average particle diameter is 200 nm or less, the color reproducibility is excellent and the ejection characteristics are excellent in a case in which droplets are ejected by an ink jet method, whereas if the average particle diameter is 10 nm or more, light-fastness is excellent. The particle diameter distribution of the coloring material is not particularly limited, and may be either a broad particle diameter distribution or a monodispersed particle diameter distribution. Further, a mixture of two or more coloring materials having monodispersed particle diameter distributions may be used.

The average particle diameter and the particle diameter distribution of the coloring materials are determined by measuring the volume average particle diameters by means of a dynamic light scattering method, using a NANOTRAC particle size distribution measuring instrument UPA-EX150 (trade name, manufactured by NIKKISO Co., Ltd.).

The coloring material may be used alone or in combination of two or more kinds thereof.

From the viewpoints of the image density, the content of the coloring material in the ink composition is preferably from 1% by mass to 25% by mass, and more preferably from 2% by mass to 20% by mass, based on the ink composition.

(Polymer Particles Having Film-Forming Property)

The ink composition of the present embodiment contains first polymer particles having a film-forming property (hereinafter may also be also referred to as "film-forming polymer particles" or "polymer particles"). In the present invention, "having a film-forming property" refers to having a minimum film-forming temperature and capable of forming a film by heating the polymer particles. In the present embodiment, even when the film is not formed only with the polymer particles, the film may be formed in the presence of a water-soluble solvent which is used in the ink as described later.

Examples of the film-forming polymer particles in the present embodiment include particles of resins having an anionic group, such as thermoplastic, or modified acrylic, epoxy-based, polyurethane-based, polyether-based, polyamide-based, unsaturated polyester-based, phenolic-based, silicone-based or fluorine-based resins, polyvinyl-based resins such as vinyl chloride, vinyl acetate, polyvinyl alcohol, polyvinyl butyral, and the like, polyester-based resins such as an alkyd resin, a phthalic acid resin, and the like, amino-based materials such as a melamine resin, a melamine-formaldehyde resin, an aminoalkyd co-condensed resin, a urea resin, and the like, copolymers or mixtures thereof, and the like. Among these, the anionic acrylic resins may be obtained by, for example, polymerizing an acrylic monomer having an anionic group (hereinafter, referred to as an "anionic group-containing acrylic monomer") and optionally, another monomer capable of being copolymerized with the anionic group-containing acrylic monomer, in a solvent. Examples of the anionic group-containing acrylic monomer include acrylic monomers having one or more anionic groups selected from the group consisting of a carboxy group, a sulfonic acid group and a phosphonic acid group, and among them, acrylic monomers having a carboxy group (for example, acrylic acid, metacrylic acid, crotonic acid, ethacrylic acid, propylacrylic acid, isopropylacrylic acid, itaconic acid, fumaric acid, and the like) are preferred, and acrylic acid or methacrylic acid is particularly preferred.

As the film-forming polymer particles in the present embodiment, self-dispersing polymer particles are preferred, and self-dispersing polymer particles having a carboxy group are more preferred, in view of exhibiting good film-forming properties and aggregation properties without an effect by a dispersant, an emulsifier, and the like. The self-dispersing polymer particles mean particles of a water-insoluble polymer which can form a dispersed state in an aqueous medium by means of a functional group (particularly, an acidic group or a salt thereof) included in the polymer per se in the absence of an additional surfactant, wherein the water-insoluble polymer particles do not contain a free emulsifier.

The term "dispersed state" as used herein includes an emulsified state where the water-insoluble polymer is dispersed in a liquid state in an aqueous medium (emulsion) and a dispersed state where the water-insoluble polymer is dispersed in a solid state in the aqueous medium (suspension).

The water-insoluble polymer in the present embodiment is preferably a water-insoluble polymer that can form a dispersed state where the water-insoluble polymer is dispersed in a solid state, from the viewpoints of a aggregation speed and a fixing property in a case in which it is used in a liquid composition.

The dispersed state of the self-dispersing polymer particles in the present embodiment means a state where stable presence of a dispersed state can be confirmed visually at 25° C. for at least one week after mixing and stirring a solution in which 30 g of a water-insoluble polymer is dissolved in 70 g of an organic solvent (for example, methyl ethyl ketone), a neutralizing agent capable of neutralizing a salt-forming group of the water-insoluble polymer to 100% (sodium hydroxide if the salt forming group is anionic or acetic acid if the group is cationic), and 200 g of water (apparatus: a stirrer equipped with a stirring blade, number of rotation: 200 rpm, 30 min, 25° C.), and then removing the organic solvent from the liquid mixture.

Further, the water-insoluble polymer means a polymer which is dissolved in a dissolution amount of 10 g or less in a case in which the polymer is dried at 105° C. for 2 hours and then dissolved in 100 g of water at 25° C. The dissolution amount is preferably 5 g or less, and more preferably 1 g or less. The dissolution amount is a dissolution amount of the polymer neutralized to 100% with sodium hydroxide or acetic acid in accordance with the kind of the salt-forming group of the water-insoluble polymer.

The aqueous medium may contain water and may optionally contain a water-soluble organic solvent. In the present embodiment, the aqueous medium preferably includes water and the water-soluble organic solvent in an amount of 0.2% by mass or less with respect to water, and more preferably the aqueous medium consists of water.

The main chain skeleton of the resin used in the polymer particles in the present embodiment is not particularly limited, and for example, a vinyl polymer or a condensed type polymer (an epoxy resin, a polyester, a polyurethane, a polyamide, a cellulose, a polyether, a polyurea, a polyimide, a polycarbonate, or the like) can be used. Among those, a vinyl polymer is particularly preferred, and from the viewpoints of dispersion stability of the polymer particles, (meth)acrylic polymer particles are more preferred. Further, the (meth) acrylic resin means methacrylic resins or acrylic resins.

Preferred examples of the vinyl polymer and a monomer used for in the formation of the vinyl polymer include those described in JP-A Nos. 2001-181549 and 2002-88294. Further, vinyl polymers introduced with a dissociative group to a terminal end of a polymer chain by radical polymerization of a vinyl monomer using a chain transfer agent, a polymerization initiator, or an iniferter having a dissociative group (or a substituent that can be induced to the dissociative group) or by ionic polymerization using a compound having a dissociative group (or substituent that can be induced to the dissociative group) to an initiator or a terminator can also be used. Preferred examples of a condensed type polymer and monomers used for the formation of the condensed type polymer include those described in JP-A No. 2001-247787.

The self-dispersing polymer particles in the present embodiment preferably contain a water-insoluble polymer containing a hydrophilic constituent unit, and as a hydrophobic constituent unit, at least one constituent unit derived from an alicyclic monomer, from the viewpoints of self-dispersibility, a film-forming temperature, and the like. In addition to these, the water-insoluble polymer may further include a constituent unit derived from an aromatic group-containing monomer.

The "constituent (or structural) unit (of a polymer) derived from a (specific) monomer" herein means a unit that has a structure which can be typically incorporated into the polymer by employing the (specific) monomer as that to be polymerized for forming the polymer.

The hydrophilic constituent unit is not particularly limited so long as it is derived from a hydrophilic group-containing monomer, and it may be either a unit derived from one kind of hydrophilic group-containing monomer or a unit derived from two or more kinds of hydrophilic group-containing monomers. The hydrophilic group is not particularly limited and it may be either a dissociative group or a nonionic hydrophilic group. The hydrophilic group is preferably a dissociative group from the viewpoints of promoting the self-dispersibility and the viewpoints of stability of the formed emulsified or dispersed state, and more preferably an anionic dissociative group. Examples of the dissociative group include a carboxy group, a phosphoric acid group, a sulfonic acid group, and the like, and among them, the carboxy group is preferred from the viewpoints of the fixing property of the ink composition in which the water-insoluble polymer is used.

The hydrophilic group-containing monomer is preferably a dissociative group-containing monomer, and preferably a dissociative group-containing monomer having a dissociative group and an ethylenically unsaturated bond from the viewpoints of the self-dispersibility and the aggregation property. Examples of the dissociative group-containing monomer include an unsaturated carboxylic acid monomer, an unsaturated sulfonic acid monomer, an unsaturated phosphoric acid monomer, and the like.

Specific examples of the unsaturated carboxylic acid monomer include acrylic acid, methacrylic acid, crotonic acid, itaconic acid, maleic acid, fumaric acid, citraconic acid, 2-methacryloyloxy methyl succinic acid, and the like. Specific examples of the unsaturated sulfonic acid monomer include styrene sulfonic acid, 2-acrylamide-2-methylpropane sulfonic acid, 3-sulfopropyl (meth)acrylate, bis-(3-sulfopropyl)-itaconic acid ester, and the like. Specific examples of the unsaturated phosphoric acid monomer include vinyl phosphonic acid, vinyl phosphate, bis(methacryloyloxyethyl)

phosphate, diphenyl-2-acryloyloxyethyl phosphate, diphenyl-2-methacryloyloxyethyl phosphate, dibutyl-2-acryloyloxyethyl phosphate, and the like.

Among the dissociative group-containing monomers, the unsaturated carboxylic acid monomer is preferred, and at least one of acrylic acid and methacrylic acid are more preferred, from the viewpoints of dispersion stability and ejecting stability.

Furthermore, examples of the monomer having a nonionic hydrophilic group include ethylenically unsaturated monomers containing a (poly)ethyleneoxy group or a polypropyleneoxy group, such as 2-methoxy ethyl acrylate, 2-(2-methoxyethoxy)ethyl acrylate, 2-(2-methoxyethoxy)ethyl methacrylate, ethoxytriethylene glycol methacrylate, methoxypolyethylene glycol (molecular weight of 200 to 1000) monomethacrylate, polyethylene glycol (molecular weight of 200 to 1000) monomethacrylate, and the like, and ethylenically unsaturated monomers containing a hydroxyl group, such as hydroxymethyl (meth)acrylate, 2-hydroxyethyl (meth)acrylate, 2-hydroxypropyl (meth)acrylate, 4-hydroxybutyl (meth)acrylate, hydroxypentyl (meth)acrylate, hydroxyhexyl (meth)acrylate, and the like.

As the monomer containing a nonionic hydrophilic group, an ethylenically unsaturated monomer having an alkyl ether at a terminal thereof is more preferable than an ethylenically unsaturated monomer having a hydroxyl group at a terminal thereof from the viewpoints of the stability of the particles and the content of water-soluble components.

With respect to the hydrophilic constituent units, the self-dispersing polymer preferably include only hydrophilic units containing an anionic dissociative group as the hydrophilic constituent units, or both of hydrophilic constituent units containing an anionic dissociative group and hydrophilic constituents unit containing a nonionic hydrophilic group as the hydrophilic constituent units.

The self-dispersing polymer may preferably include two or more kinds of hydrophilic units containing an anionic dissociative group, or two or more kinds of hydrophilic constituent units containing an anionic dissociative group and hydrophilic constituent units containing a nonionic hydrophilic group.

The content of the hydrophilic constituent units in the self-dispersing polymer is preferably 25% by mass or less, more preferably from 1% by mass to 25% by mass, even more preferably from 2% by mass to 23% by mass, and particularly preferably from 4% by mass to 20% by mass, from the viewpoints of viscosity and stability over time of the ink composition.

Further, in a case in which two or more kinds of hydrophilic constituent units are included, the total content of the hydrophilic constituent units is preferably in the range mentioned above.

The content of the constituent unit containing an anionic dissociative group in the self-dispersing polymer is preferably in a range by which the acid value is in the preferable range described below. The content of the constituent unit having a nonionic hydrophilic group is preferably from 0% by mass to 25% by mass, more preferably from 0% by mass to 20% by mass, and particularly preferably from 0% by mass to 15% by mass from the viewpoints of ejecting stability and stability over time.

The self-dispersing polymer particles preferably contain a polymer containing a carboxy group and more preferably contain a polymer containing a carboxy group and having an acid value (mgKOH/g) of from 25 to 100, from the viewpoints of the self-dispersibility and an aggregation speed when contacting the treatment liquid as described later during recording using the treatment liquid. Furthermore, the acid value is more preferably from 25 to 80, and particularly preferably from 30 to 65, from the viewpoints of the self-dispersibility and an aggregation speed when contacting the treatment liquid. In particular, if the acid value is 25 or more, the stability of self-dispersibility becomes favorable and if the acid value is 100 or less, aggregation properties are enhanced.

The alicyclic monomer is not particularly limited as long as it is a compound containing an alicyclic hydrocarbon group and a polymerizable group, but the alicyclic monomer is preferably an alicyclic (meth)acrylate from the viewpoints of dispersion stability, a film-forming temperature, and the like.

The alicyclic (meth)acrylate has a structural portion derived from a (meth)acrylic acid and a structural portion derived from an alcohol, in which the structural portion derived from an alcohol contains at least one unsubstituted or substituted alicyclic hydrocarbon group. The alicyclic hydrocarbon group may be the structural portion derived from an alcohol itself or may be bonded to the structural portion derived from an alcohol via a linking group. Further, the "alicyclic (meth)acrylate" refers to a methacrylate or an acrylate having an alicyclic hydrocarbon group.

The alicyclic hydrocarbon group is not particularly limited as long as it contains a cyclic non-aromatic hydrocarbon group, and examples thereof include a monocyclic hydrocarbon group, a bicyclic hydrocarbon group, and a polycyclic hydrocarbon group of tri- or higher cyclic ones. Examples of the alicyclic hydrocarbon group include cycloalkyl groups, such as a cyclopentyl group, a cyclohexyl group, and the like, a cycloalkenyl group, a bicyclohexyl group, a norbornyl group, an isobornyl group, a dicyclopentanyl group, a dicyclopentenyl group, an adamantyl group, a decahydronaphthalenyl group, a perhydrofluorenyl group, a tricyclodecanyl group, bicyclononane, and the like. The alicyclic hydrocarbon group may further have a substituent. Examples of the substituent include an alkyl group, an alkenyl group, an aryl group, an aralkyl group, an alkoxy group, a hydroxy group, a primary amino group, a secondary amino group, a tertiary amino group, an alkyl carbonyl group, an aryl carbonyl group, a cyano group, and the like. Further, the alicyclic hydrocarbon group may further form a condensed ring.

The alicyclic hydrocarbon group in the present embodiment preferably has an alicyclic hydrocarbon group moiety having from 5 to 20 carbon atoms from the viewpoints of viscosity and solubility.

Examples of a linking group for linking the alicyclic hydrocarbon group to the structural portion derived from an alcohol include an alkylene group, an alkenylene group, an alkynylene group, an arylakylene group, an oxyalkylene group, a mono- or oligo-ethylene oxy group, a mono- or oligo-propylene oxy group, and the like, each having from 1 to 20 carbon atoms.

Specific example of the alicyclic (meth)acrylate are presented below, but the present invention is not limited thereto. One kind of these compounds may be used alone or as a mixture of two or more kinds thereof.

Examples of the monocyclic (meth)acrylate include cycloalkyl (meth)acrylates having a cycloalkyl group having from 3 to 10 carbon atoms, such as cyclopropyl (meth)acrylate, cyclobutyl (meth)acrylate, cyclopentyl (meth)acrylate, cyclohexyl (meth)acrylate, cycloheptyl (meth)acrylate, cyclooctyl (meth)acrylate, cyclononyl (meth)acrylate, cyclodecyl (meth)acrylate, and the like. Examples of the bicyclic (meth)acrylate include isobornyl (meth)acrylate, norbornyl (meth)acrylate, and the like. Examples of the tricyclic (meth) acrylate include adamantyl (meth)acrylate, dicyclopentanil (metha)acrylate, dicyclopentenyloxyethyl (meth)acrylate, and the like. Among the above, from the viewpoints of the dispersion stability, fixability, and blocking resistance of the self-dispersing polymer particles, at least either one of the bicyclic (meth)acrylate or the polycyclic (meth)acrylate of tri- or higher cyclic ones is preferred, and at least one selected from isobornyl (meth)acrylate, adamantyl (meth)acrylate, and dicyclopentanyl(meth)acrylate is more preferred.

In the present embodiment, the content of the constituent units derived from the alicyclic (meth)acrylate contained in the self-dispersing polymer particles is preferably from 20% by mass to 90% by mass, and more preferably from 40% by mass to 90% by mass from the viewpoints of the stability of a self-dispersion state, stabilization of the particle shape in an aqueous medium due to hydrophobic interaction of alicyclic hydrocarbon groups, and reduction in the amount of water-soluble components due to appropriate hydrophobizing of particles. The content thereof is particularly preferably from 50% by mass to 80% by mass. In a case in which the content of the constituent units derived from alicyclic (meth)acrylate is 20% by mass or more, fixability and blocking may be improved. In a case in which the constituent units derived from alicyclic (meth)acrylate is 90% by mass or less, the stability of polymer particles may be improved.

Further, in a case in which a constituent unit derived from an aromatic group-containing monomer is included, the aromatic group-containing monomer is not particularly limited so long as it is a compound containing an aromatic group and a polymerizable group. The aromatic group may be either a group derived from an aromatic hydrocarbon or a group derived from an aromatic heterocyclic ring. In the present embodiment, the aromatic group is preferably an aromatic group derived from the aromatic hydrocarbon, from the viewpoints of particle shape stability in the aqueous medium. The polymerizable group may be either a polycondensating polymerizable group or an addition polymerizing polymerizable group. The polymerizable group is preferably an addition polymerizing polymerizable group, and more preferably a group containing an ethylenically unsaturated bond from the viewpoints of particle shape stability in the aqueous medium.

The aromatic group-containing monomer is preferably a monomer containing an aromatic group derived from an aromatic hydrocarbon and an ethylenically unsaturated bond. One kind of the aromatic group-containing monomer may be used alone or two or more kinds of the aromatic group-containing monomers may be used in combination. Examples of the aromatic group-containing monomer include phenoxyethyl (meth)acrylate, benzyl (meth)acrylate, phenyl (meth) acrylate, a styrenic monomer, and the like. Among them, from the viewpoints of the balance between the hydrophilicity and the hydrophobicity of the polymer chain and the ink fixing property, an aromatic group-containing (meth)acrylate monomer is preferred, and at least one selected from the group consisting of phenoxyethyl (meth)acrylate, benzyl (meth)acrylate, and phenyl (meth)acrylate is more preferable, and phenoxyethyl (meth)acrylate and/or benzyl (meth)acrylate are even more preferred. In a case in which the styrene monomer is used as an aromatic group-containing monomer, the content of the constituent units derived from the styrene monomer is preferably 20% by mass or less, more preferably 10% by mass or less, and even more preferably 5% by mass or less, from the viewpoints of the stability of self-dispersing polymer particles in which the monomer is used. It is preferable that the self-dispersing polymer does not contain the constituent unit derived from a styrene monomer. The styrene monomer as used herein refers to styrene, substituted styrene ($\alpha$-methyl styrene, chlorostyrene, or the like), or a styrene macromer having a polystyrene structural unit.

The self-dispersing polymer particles may optionally include, for example, as a hydrophobic constituent unit, an additional constituent unit as well as a constituent unit derived from an aromatic group-containing monomer, in addition to a constituent unit derived from an alicyclic monomer. The monomer which may be used for forming the additional constituent unit (which may also be hereinafter referred to as an "additional copolymerizable monomer") is not particularly limited so long as it is a monomer copolymerizable with the hydrophilic group-containing monomer, the aromatic group-containing monomer, and the alicyclic monomer. Among these, an alkyl group-containing monomer is preferred from the viewpoints of the flexibility of the polymer skeleton or easiness in control of the glass transition temperature (Tg).

Examples of the alkyl group-containing monomer include alkyl (meth)acrylates such as methyl (meth)acrylate, ethyl (meth)acrylate, isopropyl (meth)acrylate, n-propyl (meth) acrylate, n-butyl (meth)acrylate, isobutyl (meth)acrylate, t-butyl (meth)acrylate, hexyl (meth)acrylate, ethylhexyl (meth)acrylate, and the like; ethylenically unsaturated monomers having a hydroxyl group such as hydroxymethyl (meth) acrylate, 2-hydroxyethyl (meth)acrylate, 2-hydroxypropyl (meth)acrylate, 4-hydroxybutyl (meth)acrylate, hydroxypentyl (meth)acrylate, hydroxyhexyl (meth)acrylate, and the like; dialkylamino alkyl (meth)acrylates such as dimethylaminoethyl (meth)acrylate; (meth)acrylamides, for example, N-hydroxyalkyl (meth)acrylamide such as N-hydroxymethyl (meth)acrylamide, N-hydroxyethyl (meth) acrylamide, N-hydroxybutyl (meth)acrylamide, and the like; N-alkoxyalkyl (meth)acrylamides such as N-methoxymethyl (meth)acrylamide, N-ethoxymethyl (meth)acrylamide, N-(n-, iso)butoxymethyl (meth)acrylamide, N-methoxyethyl (meth)acrylamide, N-ethoxyethyl (meth)acrylamide, N-(n-, iso)butoxyethyl (meth)acrylamide, and the like; etc.

Among these, from the viewpoints of the flexibility of the polymer skeleton or easiness in control of the glass transition temperature (Tg) and from the viewpoints of the dispersion stability of a self-dispersing polymer, at least one of (meth) acrylates containing a chain alkyl group having from 1 to 8 carbon atoms is preferred, (meth)acrylates containing a chain alkyl group having from 1 to 4 carbon atoms are more preferred, and methyl (meth)acrylate or ethyl (meth)acrylate is particularly preferred. The chain alkyl group as used herein refers to an alkyl group having a straight chain or a branched chain.

One kind of the additional copolymerizable monomers may be used alone or in combination of two or more kinds thereof. In a case in which the self-dispersing polymer particles contain the additional constituent units, the content thereof is preferably from 10% by mass to 80% by mass, more preferably from 15% by mass to 75% by mass, and particularly preferably from 20% by mass to 70% by mass. In a case in which two or more kinds of monomers are used in combination for forming the additional constituent unit, the total content thereof is preferably in the range described above.

The self-dispersing polymer in the present embodiment is also preferably a polymer obtained by polymerizing at least three kinds of substances of at least one alicyclic (meth) acrylate, an additional copolymerizable monomer (examples thereof including an aromatic group-containing (meth)acrylate), and a hydrophilic group-containing monomer, and more preferably a polymer obtained by polymerizing at least three kinds of substances of at least one alicyclic (meth)acrylate, a (meth)acrylate containing a straight chain or branched chain alkyl group having from 1 to 8 carbon atoms, and a hydrophilic group-containing monomer, from the viewpoints of dispersion stability. In the present embodiment, the self-dispersing polymer is preferably a self-dispersing polymer which does not substantially contain a constituent unit having a substituent having high hydrophobicity such as a constituent unit derived from (meth)acrylate having a straight chain or branched chain alkyl group having 9 or more carbon atoms, a constituent unit derived from an aromatic group-containing macromonomer or the like, and the self-dispersing polymer is more preferably a self-dispersing polymer which does not contain such a constituent unit, from the viewpoints of dispersion stability.

The self-dispersing polymer may be a random copolymer in which each constituent unit is irregularly introduced or a block copolymer in which each constituent unit is regularly introduced. In the case of a block copolymer, the polymer may be synthesized in any order of introduction of monomers, and the same constituent component may be introduced in the polymer twice or more. A random copolymer is preferable in terms of versatility and manufacturability.

The molecular weight of the self-dispersing polymer is preferably from 3000 to 200,000, more preferably from 5000 to 150,000, and even more preferably from 10,000 to 100,000 in terms of a weight average molecular weight. Further, the self-dispersing polymer preferably has an acid value (mg KOH/g) of from 25 to 100 and a weight average molecular weight of 3000 to 200,000, and the self-dispersing polymer more preferably has an acid value of from 25 to 95 and a weight average molecular weight of from 5000 to 150,000. By setting the weight average molecular weight to 3000 or more, the amount of the water-soluble component can be suppressed effectively. By setting the weight average molecular weight to 200,000 or less, the self-dispersion stability can be increased. The weight average molecular weight is measured by gel permeation chromatography (GPC). In GPC, HLC-8020GPC (trade name, manufactured by Tosoh Corporation) is used, TSKgel Super HZM-H, TSK gel Super HZ4000 and TSK gel Super HZ200 (trade names, manufactured by Tosoh Corporation, 4.6 mm ID×15 cm) are used as the columns, and THF (tetrahydrofuran) is used as an eluent.

It is preferable that the self-dispersing polymer in the present embodiment contains a constituent unit derived from an alicyclic (meth)acrylate (preferably a structural unit derived from at least one of isobornyl (meth)acrylate, adamantyl (meth)acrylate, and dicyclopentanyl (meth)acrylate) in a proportion of from 15% by mass to 80% by mass of the total mass of the self-dispersing polymer particles as a copolymerization ratio, has an acid value (mg KOH/g) of from 25 to 100, and a weight average molecular weight of from 3000 to 200,000 from the viewpoints of controlling the hydrophilic and hydrophobic properties of the polymers.

It is also preferable that the self-dispersing polymer contains a constituent unit derived from an alicyclic (meth)acrylate (preferably a structural unit derived from at least one of isobornyl (meth)acrylate, adamantyl (meth)acrylate, and dicyclopentanyl (meth)acrylate) in a proportion of 15% by mass to 80% by mass as a copolymerization ratio, a constituent unit derived from a carboxy group-containing monomer, and a constituent unit derived from an alkyl group-containing monomer (preferably a structural unit derived from an alkyl ester of a (meth)acrylic acid) from the viewpoints of controlling the hydrophilic and hydrophobic properties of the polymers. It is more preferable that the self-dispersing polymer contains a structural unit derived from at least one of isobornyl (meth)acrylate, adamantyl (meth)acrylate, and dicyclopentanyl (meth)acrylate in a proportion of 15% by mass to 80% by mass as a copolymerization ratio, a constituent unit derived from a carboxy group-containing monomer, and a constituent unit derived from an alkyl group-containing monomer (preferably a structural unit derived from an alkyl ester having 1 to 4 carbon atoms of a (meth)acrylic acid), have an acid value of 25 to 95, and has a weight average molecular weight of 5000 to 150,000.

It is also preferable that the self-dispersing polymer of the present embodiment be a vinyl polymer containing a structure derived from an alicyclic (meth)acrylate (preferably a structural unit derived from at least one of isobornyl (meth) acrylate, adamantyl (meth)acrylate, and dicyclopentanyl (meth)acrylate) in a proportion of from 20% by mass to 90% by mass as a copolymerization ratio, a structure derived from a dissociative group-containing monomer, at least one structure derived from a (meth)acrylate containing a chain alkyl group having from 1 to 8 carbon atoms, has an acid value (mgKOH/g) of from 20 to 120, has a total content of hydrophilic structural units of from 25% by mass or less, and has a weight average molecular weight of from 3,000 to 200,000, from the viewpoints of controlling the hydrophilic and hydrophobic properties of the polymer. It is more preferable that the self-dispersing polymer of the present embodiment be a vinyl polymer containing a structure derived from a polycyclic (meth)acrylate having two or three or more rings (preferably a structural unit derived from at least one of isobornyl (meth) acrylate, adamantyl (meth)acrylate, and dicyclopentanyl (metha)acrylate) in a proportion of from 30% by mass to 90% by mass as a copolymerization ratio, a structure derived from a (meth)acrylate containing a chain alkyl group having from 1 to 4 carbon atoms in a proportion of from 10% by mass to 80% by mass as a copolymerization ratio, and a structure derived from a carboxy group-containing monomer in such an amount that the acid value is in the range of from 25 to 100, has a total content of hydrophilic structural units of 25% by mass or less, and has a weight average molecular weight of from 10,000 to 200,000. It is particularly preferable that the self-dispersing polymer of the present embodiment be a vinyl polymer containing a structure derived from polycyclic (meth)acrylate having two or three or more rings (preferably a structural unit derived from at least one of isobornyl (meth) acrylate, adamantyl (meth)acrylate, and dicyclopentanyl (metha)acrylate) in a proportion of from 40% by mass to 80% by mass as a copolymerization ratio, a structure derived at least from a methyl (meth)acrylate or an ethyl (meth)acrylate in a proportion of from 20% by mass to 70% by mass as a copolymerization ratio, and a structure derived from an acrylic acid or a methacrylic acid in such an amount that the acid value is in the range of from 30 to 80, has a total content of hydrophilic structural units of 25% by mass or less, and has a weight average molecular weight of from 30,000 to 150,000.

Examples of the polymers contained in the polymer particles include alicyclic group-containing polymers as below, but the present invention is not limited thereto. The ratio in the brackets represents the mass ratio of the copolymerization components. In a case in which the glass transition temperature is "calculated Tg", the glass transition temperature is a value calculated according to Calculation Equation (S) as described later using a Tg value of a homopolymer of each of the following monomers. Tg of methyl methacrylate: 105° C., Tg of isobornyl methacrylate: 156° C., Tg of benzyl methacrylate: 54° C., Tg of methacrylic acid: 130° C., Tg of adamantyl methacrylate: 140° C., and Tg of dicyclopentanyl methacrylate: 128° C.

Methyl methacrylate/isobornyl methacrylate/methacrylic acid copolymer (20/72/8), Tg 180° C.

Methyl methacrylate/isobornyl methacrylate/methacrylic acid copolymer (30/62/8), Tg 170° C.

Methyl methacrylate/isobornyl methacrylate/methacrylic acid copolymer (40/52/8), Tg 160° C.

Methyl methacrylate/isobornyl methacrylate/methacrylic acid copolymer (50/42/8), Tg 150° C.

Methyl methacrylate/isobornyl methacrylate/benzyl methacrylate/methacrylic acid copolymer (30/50/14/6), Tg 123° C.

Methyl methacrylate/dicyclopentanyl methacrylate/methacrylic acid copolymer (40/50/10), Tg 130° C.

Methyl methacrylate/dicyclopentanyl methacrylate/phenoxy ethyl methacrylate/methacrylic acid copolymer (30/50/14/6), Tg 101° C.

Methyl meth acrylate/isobornyl methacrylate/methoxypolyethylene glycol methacrylate (n=2)/methacrylic acid copolymer (30/54/10/6), Tg 110° C.

Methyl methacrylate/dicyclopentanyl methacrylate/methoxypolyethylene glycol methacrylate (n=2)/methacrylic acid copolymer (54/35/5/6), Tg 100° C.

Methyl methacrylate/adamantyl methacrylate/methoxypolyethylene glycol methacrylate (n=23)/methacrylic acid copolymer (30/50/15/5), Tg 112° C.

Methyl methacrylate/isobornyl methacrylate/dicyclopentanyl methacrylate/methacrylic acid copolymer (20/50/22/8), Tg 139° C.

Ethyl methacrylate/cyclohexyl methacrylate/acrylic acid copolymer (50/45/5), Tg 67° C.

Isobutyl methacrylate/cyclohexyl methacrylate/acrylic acid copolymer (40/50/10), Tg 70° C.

n-butyl methacrylate/cyclohexyl methacrylate/styrene/acrylic acid copolymer (30/55/10/5), Tg 86° C.

Methyl methacrylate/dicyclopentenyloxyethyl methacrylate/methacrylic acid copolymer (40/52/8), Tg 78° C.

Lauryl methacrylate/dicyclopentenyloxyethyl methacrylate/methacrylic acid copolymer (3/87/10), Tg 53° C.

The method of preparing the water-insoluble polymer used in the self-dispersing polymer particles in the present embodiment is not particularly limited. Examples of the method of preparing the water-insoluble polymer include a method of performing emulsion polymerization in the presence of a polymerizable surfactant thereby covalently-bonding the surfactant and the water-insoluble polymer, and a method of copolymerizing a monomer mixture containing the hydrophilic group-containing monomer and the aromatic group-containing monomer by a known polymerization method such as a solution polymerization method, a bulk polymerization method, and the like. Among the polymerization methods described above, the solution polymerization method is preferred, and a solution polymerization method in which an organic solvent is used is more preferred, from the viewpoints of the aggregation speed and the droplet ejection stability of the ink composition.

From the viewpoints of the aggregation speed, it is preferred that the self-dispersing polymer particles in the present embodiment contain a polymer synthesized in an organic solvent, and the polymer has a carboxy group (the acid value is preferably from 20 to 100), in which the carboxy groups of the polymer are partially or entirely neutralized and the polymer is prepared as a polymer dispersion in a continuous phase of water. That is, the preparation of the self-dispersing polymer particle in the present embodiment is preferably carried out by a method including a process of synthesizing the polymer in the organic solvent and a dispersion process of forming an aqueous dispersion in which at least a portion of the carboxy groups of the polymer is neutralized.

The dispersion process preferably includes the following process (1) and process (2).

Process (1): a process of stirring a mixture containing a polymer (water-insoluble polymer), an organic solvent, a neutralizing agent, and an aqueous medium.

Process (2): a process of removing the organic solvent from the mixture.

The process (1) is preferably a treatment that includes at first dissolving the polymer (water-insoluble polymer) in the organic solvent and then gradually adding the neutralizing agent and the aqueous medium, and mixing and stirring the mixture to obtain a dispersion. As such, by adding the neutralizing agent and the aqueous medium to the solution of the water-insoluble polymer dissolved in the organic solvent, self-dispersing polymer particles having a small particle diameter and higher storage stability can be obtained without requiring a strong shearing force.

The method for stirring the mixture is not particularly limited, and a mixing and stirring apparatus that is used generally, and optionally, a disperser such as an ultrasonic disperser, a high pressure homogenizer, and the like can be used.

Preferable examples of the organic solvent include an alcohol-based solvent, a ketone-based solvent, and an ether-based solvent.

Examples of the alcohol-based solvent include isopropyl alcohol, n-butanol, t-butanol, ethanol, and the like. Examples of the ketone-based solvent include acetone, methyl ethyl ketone, diethyl ketone, methyl isobutyl ketone, and the like. Examples of the ether-based solvent include dibutyl ether, dioxane, and the like. Among the solvents, a ketone-based solvent such as methyl ethyl ketone and the like, and an alcohol-based solvent such as isopropyl alcohol and the like are preferred. Further, for the purpose of moderating the change in polarity at the phase transfer from an oil system to an aqueous system, combined use of isopropyl alcohol and methyl ethyl ketone is also preferred. By the combined use of the solvents, self-dispersing polymer particles having a small particle size and high stage stability with less occurrence of aggregation settling or fusion between particles to each other may be obtained.

A neutralizing agent is used to partially or entirely neutralize the dissociative groups so that the self-dispersing polymer can form a stable emulsified or dispersed state in water. In a case in which the self-dispersing polymer of the present embodiment has an anionic dissociative group (for example, a carboxy group) as the dissociative group, examples of the neutralizing agent to be used include basic compounds such as organic amine compounds, ammonia, and alkali metal hydroxides. Examples of the organic amine compounds include monomethyl amine, dimethyl amine, trimethyl amine, monoethyl amine, diethyl amine, triethyl amine, monopropyl amine, dipropyl amine, monoethanolamine, diethanolamine, triethanolamine, N,N-dimethyl-ethanolamine, N,N-diethyl-ethanolamine, 2-dimethylamino-2-methyl-1-propanol, 2-amino-2-methyl-1-propanol, N-methyldiethanolamine, N-ethyldiethanolamine, monoisopropanolamine, diisopropanolamine, triisopropanolamine, and the like. Examples of the alkali metal hydroxide include lithium hydroxide, sodium hydroxide, potassium hydroxide, and the like. Among them, sodium hydroxide, potassium hydroxide, triethylamine, and triethanolamine are preferred from the viewpoints of the stabilization of dispersion of the self-dispersing polymer particles of the present embodiment into water.

The basic compound is used preferably in an amount of from 5% by mol to 120% by mol, more preferably from 10% by mol to 110% by mol, and even more preferably from 15% by mole to 100% by mol, with respect to 100% by mol of the dissociative groups. In a case in which the basic compound is used in an amount of 15% by mol or more, the effect of stabilizing the dispersion of the particles in water is exerted and in a case in which the basic compound is in an amount of 100% or less, the effect of decreasing the water-soluble component is obtained.

In the process (2), an aqueous dispersion of the self-dispersing polymer particles can be obtained by phase transfer to the aqueous system by distilling off the organic solvent from the dispersion obtained in the process (1) by an ordinary method such as distillation under a reduced pressure, and the like. In the obtained aqueous dispersion, the organic solvent is substantially removed and the amount of the organic solvent is preferably from 0.2% by mass or less, and more preferably 0.1% by mass or less.

The average particle diameter of the film-forming polymer particles (particularly the self-dispersing polymer particles) is, in terms of a volume average particle diameter, preferably in the range of from 10 nm to 400 nm, more preferably in the range of from 10 nm to 200 nm, even more preferably in the range of from 10 nm to 100 nm, and particularly preferably in the range of from 10 nm to 50 nm. In a case in which the volume average particle diameter is 10 nm or more, production suitability may be enhanced, and in a case in which the volume average particle diameter is 400 nm or less, storage stability may be enhanced. Further, the particle diameter distribution of the film-forming polymer particles is not particularly limited, and any of those particles having a broad particle diameter distribution or those particles having a monodisperse particle diameter distribution may be used. Two or more kinds of water-insoluble particles may be used as a mixture.

The average particle diameter and the particle diameter distribution of the film-forming polymer particles are the values determined by measuring the volume average particle diameters by means of a dynamic light scattering method, using a NANOTRAC particle size distribution measuring instrument UPA-EX150 (trade name, manufactured by NIKKISO Co., Ltd.).

The content of the film-forming polymer particles (particularly the self-dispersing polymer particles) in the ink composition is preferably 1% by mass to 20% by mass, and more preferably from 2% by mass to 10% by mass in terms of solid, with respect to the ink composition, from the viewpoints of glossiness of the image, and the like.

The film-forming polymer particles (particularly the self-dispersing polymer particles) may be used alone or as a mixture of two or more kinds thereof.

(Water-Soluble Organic Solvent)

In the present embodiment, the ink composition contains at least one water-soluble organic solvent in combination with water as a solvent. By including the water-soluble organic solvent in combination with the film-forming polymer particles, the minimum film-forming temperature of the polymer particles in the ink composition can be lowered, and a fixing effect can be obtained more effectively, and therefore, the glossiness, the abrasion resistance, and the like of the image can be favorably maintained.

As the water-soluble organic solvent used in the ink composition, an alkyleneoxy alcohol or an alkyleneoxyalkyl ether is preferred from the viewpoints that a minimum film-forming temperature can be preferably controlled in a range below the surface temperature of a heating roller. Further, for the same reason, the ink composition preferably contains two or more water-soluble organic solvents, and in a case in which the ink composition contains two or more water-soluble organic solvents, it is preferable that at least one thereof be an alkyleneoxy alcohol. It is particularly preferable that the ink composition include two or more water-soluble organic solvents including at least one alkyleneoxy alcohol and at least one alkyleneoxyalkyl ether.

Preferable examples of the alkyleneoxy alcohol include propyleneoxy alcohol. Examples of the propyleneoxy alcohol include SANNIX GP250 and SANNIX GP400 (trade name, manufactured by Sanyo Chemical Industries, Ltd.).

Preferable examples of the alkyleneoxyalkyl ether include ethyleneoxyalkyl ether having an alkyl moiety having from 1 to 4 carbon atoms, and propyleneoxy alkyl ether having an alkyl moiety having from 1 to 4 carbon atoms. Examples of the alkyleneoxyalkyl ether include ethylene glycol monomethyl ether, ethylene glycol monoethyl ether, ethylene glycol monobutyl ether, diethylene glycol monomethyl ether, diethylene glycol monobutyl ether, propylene glycol monomethyl ether, propylene glycol monobutyl ether, dipropylene glycol monomethyl ether, triethylene glycol monomethyl ether, tripropylene glycol monoethyl ether, ethylene glycol diacetate, ethylene glycol monomethyl ether acetate, triethylene glycol monomethyl ether, triethylene glycol monoethyl ether, ethylene glycol monophenyl ether, and the like.

In the present embodiment, a case where the film-forming polymer particles are self-dispersing polymer particles, and as the water-soluble organic solvents, propyleneoxy alcohol and ethyleneoxyalkyl ether (having an alkyl moiety having from 1 to 4 carbon atoms) and/or propyleneoxy alkyl ether (having an alkyl moiety having from 1 to 4 carbon atoms) are used, are preferred. Further, a case where the polymer particles are self-dispersing polymer particles including a water-insoluble polymer containing a hydrophilic constituent unit and a constituent unit derived from an alicyclic group-containing monomer, and as the water-soluble organic solvent, propyleneoxy alcohol and ethyleneoxyalkyl ether (having an alkyl moiety having from 1 to 4 carbon atoms) and/or propyleneoxy alkyl ether (having an alkyl moiety having from 1 to 4 carbon atoms) are used, are also preferred.

Furthermore, in addition to the water-soluble organic solvent, optionally, for the purpose of promoting drying prevention, penetration enhancement, viscosity modification, or the like, one or more additional organic solvents may be included.

In a case in which the organic solvent is used as a drying preventing agent, nozzle clogging that can be caused by drying ink at an ink ejecting port can be prevented effectively while ejecting the ink composition by an ink jet method to record an image.

For prevention of drying, a water-soluble organic solvent having a lower vapor pressure than that of water is preferable. Specific examples of the water-soluble organic solvent that is preferable for prevention of drying include polyhydric alcohols, typical examples thereof including ethylene glycol, propylene glycol, diethylene glycol, polyethylene glycol, thiodiglycol, dithiodiglycol, 2-methyl-1,3-propanediol, 1,2,6-hexanetriol, acetylene glycol derivatives, glycerin, trimethylol propane, and the like; heterocycles, typical examples thereof including 2-pyrrolidone, N-methyl-2-pyrrolidone, 1,3-dimethyl-2-imidazolidinone, N-ethylmorpholine, and the like; sulfur-containing compounds, typical examples thereof including sulfolane, dimethyl sulfoxide, 3-sulfolene, and the like; polyfunctional compounds, typical examples thereof including diacetone alcohol, diethanolamine, and the like; urea derivatives, and the like. Among these, polyhydric alcohols such as glycerin, diethylene glycol, and the like are preferred.

For enhancement of penetration, an organic solvent may be used for the purpose of promoting penetration of the ink composition into a recording medium. Specific examples of the organic solvent that is preferable for enhancement of penetration include alcohols such as ethanol, isopropanol, butanol, 1,2-hexanediol, and the like, sodium lauryl sulfate, sodium oleate, nonionic surfactants, and the like.

The water-soluble organic solvent can be used for adjustment of the viscosity. Specific examples of the water-soluble organic solvent that can be used for adjustment of viscosity include alcohol (for example, methanol, ethanol, propanol, and the like), amines (for example, ethanolamine, diethanolamine, triethanolamine, ethylene diamine, diethylene triamine, and the like) and other polar solvents (for example, formamide, N,N-dimethylformamide, N,N-dimethylacetamide, dimethyl sulfoxide, sulfolane, 2-pyrrolidone, acetonitrile, acetone, and the like).

The content of the water-soluble organic solvent in the ink composition is preferably from 1% by mass to 30% by mass, more preferably from 5% by mass to 25% by mass, and even more preferably from 10% by mass to 20% by mass.

(Water)

In the present embodiment, the ink composition contains water, but the amount of water is not particularly limited. The preferable content of water is from 10% by mass to 99% by mass, more preferably from 30% by mass to 80% by mass, and even more preferably from 50% by mass to 70% by mass.

(Minimum Film-Forming Temperature $T_A$)

The minimum film-forming temperature ($T_A$) in the ink composition of the present embodiment is a minimum film-forming temperature of a mixed liquid obtained by mixing the polymer particles and the water-soluble organic solvent, each contained in the ink composition. Particularly, in the present embodiment, it refers to a minimum film-forming temperature (hereinafter also referred to as "$MFT^{40\%}$) in a case in which the content ratio of the film-forming polymer particles and the water-soluble organic solvent in the ink composition are such the ratio of the content of the former is 40 parts by mass with respect to 100 parts by mass of the latter.

Specifically, the minimum film-forming temperature is a value calculated as follows. An aqueous solution of 25 parts by mass of film-forming polymer particles, 10 parts by mass of a water-soluble organic solvent, and 65 parts by mass of water is prepared. The aqueous solution thus prepared is coated with a blade at a length of 50 cm×a width of 3 cm on a support to a thickness of the coated film of 300 μm. Then heating is performed from the back side of the support, and drying the coated film for 4 hours under an environment of 20° C. and 22% RH over a temperature gradient of from 20° C. to 74° C. on the coated film, and thereafter, the boundaries between a portion in which the film is not formed with generation of precipitates in the form of white powder and a portion in which the film is formed with formation of a transparent film is measured to calculating the minimum film-forming temperature.

In the present embodiment, the minimum film-forming temperature is lower than the surface temperature of the heating roller (as described later). Due to this, the glossiness, the abrasion resistance, and the like of the image can become more favorable. For example the minimum film-forming temperature is preferably 70° C. or lower, more preferably 65° C. or lower, and even more preferably 60° C. or lower. The lower limit is not particularly limited, but it may be, for example, 20° C. or higher, more preferably 30° C. or higher, and even more preferably 40° C. or higher.

In the present embodiment, it is thought that the minimum film-forming temperature varies significantly, particularly depending on the composition of the film-forming polymer particles (for example, the content ratios of the respective monomers such as the alicyclic (meth)acrylate and the like), the content ratios of the film-forming polymer particles and the water-soluble organic solvent, and the like, and therefore, it is possible to adjust the minimum film-forming temperature ($MFT^{40\%}$) by appropriately adjusting such ratios, and the like.

The present embodiment focuses on the minimum film-forming temperature ($MFT^{40\%}$), and as a result, it has been found that by using a specific ink composition having a minimum film-forming temperature and fixing with a heating roller having a temperature that is higher than the minimum film-forming temperature, it is possible to effectively perform film formation with the film-forming polymer particles and, therefore, it is also possible to improve the glossiness and the abrasion resistance of the image, and the like.

The reasons for the above effects are presumed as follows. That is, a specific ink composition is ejected onto a recording medium by an ink jet method, and a part of the water-soluble organic solvent contained in the ink composition is penetrated into the inside of the recording medium until being fixed on the heating roller. As a result, the image formed on the recording medium surface contains the solid in ink and the remainder of the water-soluble organic solvent, and its content ratio is such a ratio that the content of the latter is 40 parts by mass with respect to 100 parts by mass of the former. Further, a fixing process on the heating roller follows. During the fixing process, in a case in which the fixing temperature is higher than the film-forming temperature of the ink composition having a certain concentration, the image is sufficiently subjected to film formation and an effect of improvement of the glossiness and the abrasion resistance of the image is exhibited.

(Other Additives)

The ink composition can optionally contain one or more other additives in addition to the above-described components. Examples of the additives include known additives such as a wax, an ultraviolet ray absorber, an anti-fading agent, an emulsion stabilizer, a penetration preventing agent, a preservative, an anti-mold agent, a pH adjusting agent, a surface tension adjusting agent, an antifoaming agent, a viscosity modifier, a dispersant, a dispersion stabilizer, an anti-corrosive agent, a chelating agent, and the like. These various additives may be added directly after preparation of the ink composition or may be added during preparation of the ink composition.

As the wax, for example, wax particles having a melting point of from 40° C. to lower than 100° C. can be preferably used. By including the wax, press blocking resistance of the image can be improved.

Examples of the wax of the wax particles include natural wax and synthetic wax.

Examples of the natural wax include petroleum-derived wax (petroleum-based wax), plant-derived wax (plant-based wax), and animal/plant-derived wax.

Examples of the petroleum-derived wax include paraffin wax, microcrystalline wax, petrolactam, and the like, examples of the plant-derived wax include carnauba wax, candelilla wax, rice wax, Japan tallow wax, and the like, and examples of the animal/plant-derived wax include lanoline, bees wax, and the like.

Examples of the synthetic wax include synthetic hydrocarbon-based wax, and modified waxes.

Examples of the synthetic hydrocarbon-based wax include polyethylene wax, Fischer-Tropsch wax, and the like, and examples of the modified waxes include paraffin wax derivatives, montan wax derivatives, microcrystalline wax derivatives, and the like.

The wax in the present embodiment may be contained in the ink composition by any method, for example, in a solution form in which the wax is dissolved in a preferable solvent, an emulsion dispersion form, a dispersion form of solid particles, or the like.

The emulsion dispersion method is particularly preferred, and it is preferable to add particles preferably having an average particle size of from 0.01 μm to 10 μm, preferably from 0.05 μm to 5 μm, and more preferably from 0.1 μm to 2 μm.

The wax preferably has a wax solid concentration in the ink composition of from 0.001% by mass to 20% by mass from the viewpoints of improvement of abrasion resistance, press blocking resistance, and ink ejecting properties (immediately after ejecting, and after passage of time), more preferably from 0.01% by mass to 10% by mass, and even more preferably from 0.1% by mass to 5% by mass.

The ultraviolet ray absorber can improve the image storability. Examples of the ultraviolet ray absorber include benzotriazole-based compounds as described in JP-A Nos. 58-185677, 61-190537, 2-782, 5-197075, 9-34057, and the like, benzophenone-based compounds as described in JP-A Nos. 46-2784 and 5-194483, U.S. Pat. No. 3,214,463, and the like, cinnamic acid-based compounds as described in Japanese Examined Patent Publication Nos. 48-30492 and 56-21141, JP-A No. 10-88106, and the like, triazine-based compounds as described in JP-A Nos. 4-298503, 8-53427, 8-239368, and 10-182621, PCT Japanese Translation Patent Publication No. 8-501291, and the like, compounds described in Research Disclosure No. 24239, and compounds capable of absorbing ultraviolet rays and emitting fluorescence, so-called fluorescent brighteners, typical examples thereof including stilbene-based compounds and benzoxazole-based compounds.

The anti-fading agent can improve the storage property of the image. As the anti-fading agent, various organic and metal complex-based anti-fading agents can be used. Examples of the organic anti-fading agents include hydroquinones, alkoxyphenols, dialkoxyphenols, phenols, anilines, amines, indanes, chromanes, alkoxyanilines and heterocycles, while examples of metal complexes include nickel complexes, zinc complexes, and the like. More specifically, compounds as described in Research Disclosure, No. 17643, VII, Sections Ito J, No. 15162, No. 18716, left column on page 650, No. 36544, page 527, No. 307105, page 872, and the patent cited in No. 15162, and compounds embraced in the formula of the typical compounds and compound examples described on pages 127 to 137 of JP-A No. 62-215272.

Examples of the anti-mold agent include sodium dehydroacetate, sodium benzoate, sodium pyridinethione-1-oxide, p-hydroxybenzoic acid ethyl ester, 1,2-benzisothiazoline-3-one, salt thereof, and the like. These are preferably used in an amount of from 0.02% by mass to 1.00% by mass in the ink composition.

As the pH adjusting agent, a neutralizing agent (organic bases and inorganic alkali) can be used. The pH adjusting agent is preferably added such that the ink composition has a pH of from 6 to 10, and preferably a pH of from 7 to 10, from the viewpoints of improvement of the storage stability of the ink composition.

Examples of the surface tension adjusting agent include nonionic surfactants, cationic-based surfactants, anionic-based surfactants, betaine-based surfactants, and the like.

In order to perform good ejecting by an ink jet method, the addition amount of the surface tension adjusting agent is preferably an amount that is capable of adjusting the surface tension of the ink composition to a range of preferably from 20 mN/m to 60 mN/m, more preferably from 20 mN/m to 45 mN/m, and even more preferably from 25 mN/m to 40 mN/m. On the other hand, in a case in which the ink is applied by a method other than the ink jet method, a range of from 20 mN/m to 60 mN/m is preferred, and a range of from 30 mN/m to 50 mN/m is more preferred.

The surface tension of the ink composition is a value measured by a plate method, using AUTOMATIC SURFACE TENSIONMETER CBVP-Z (trade name, manufactured by Kyowa Interface Science Co., Ltd.) under the condition of 25° C.

Specific examples of the surfactant include, for a hydrocarbon-based surfactant, anionic-based surfactants such as a salt of a fatty acid, an alkyl sulfate ester salt, an alkyl benzene sulfonate salt, an alkyl naphthalene sulfonate salt, a dialkyl sulfosuccinate salt, an alkyl phosphate ester salt, a naphthalene sulfate/formalin condensate, a polyoxyethylene alkyl sulfonate ester salt, and the like, and nonionic surfactants such as a polyoxyethylene alkyl ether, a polyoxyethylene alkyl aryl ether, a polyoxyethylene fatty acid ester, a sorbitan fatty acid ester, a polyoxyethylene sorbitan fatty acid ester, a polyoxyethylene alkyl amine, a glycerin fatty acid ester, an oxyethylene oxypropylene block copolymer, and the like. Preferable examples further include SURFYNOLS (trade name, manufactured by Air Products & Chemicals), which is an acetylene-based polyoxyethylene oxide surfactant, and an amine oxide type of amphoteric surfactant such as N,N-dimethyl-N-alkyl amine oxide.

It is also possible to use the surfactants described on pages (37) to (38) of JP-A No. 59-157636 and Research Disclosure No. 308119 (1989).

Furthermore, it is also possible to use a fluorine-based (alkyl fluoride-based) surfactant, a silicone-based surfactant, and the like, such as those described in JP-A Nos. 2003-322926, 2004-325707, and JP-A No. 2004-309806 to improve the abrasion resistance.

It is also possible to use a surface tension adjusting agent as an anti-foaming agent, and a fluoride-based compound, a silicone-based compound, chelating agents such as EDTA, and the like can be used as an anti-foaming agent.

The viscosity of the ink composition is preferably in the range of from 1 mPa·s to 30 mPa·s, more preferably in the range of from 1 mPa·s to 20 mPa·s, even more preferably in the range of from 2 mPa·s to 15 mPa·s, and particularly preferably in the range of from 2 mPa·s to 10 mPa·s, from the viewpoints of ejecting stability and an aggregation speed upon contact with an acidic treatment liquid in a case of application by ejecting ink using the ink jet method. Further, in a case in which the ink composition is applied by a method other than an ink jet method, the viscosity is preferably in the range of from 1 mPa·s to 40 mPa·s, and more preferably in the range of from 5 mPa·s to 20 mPa·s.

The viscosity of the ink composition can be measured, for example, by using a Brookfield viscometer.

<Ink Set>

The ink jet image forming method of the present embodiment can be used along with a treatment liquid which is capable of forming aggregates by being brought into contact with the ink composition, in addition to the above-described ink composition of the present embodiment. In the present embodiment, the ink set includes the above-described ink composition of the present embodiment and the treatment liquid.

—Treatment Liquid—

The treatment liquid in the present embodiment is configured to be capable of forming aggregates by being brought into contact with the above-described ink composition. Specifically, the treatment liquid preferably includes at least an aggregation component which is capable of forming aggregates by aggregating dispersed particles such as the coloring material particles (for example, a pigment), and the like in the ink composition, and may include optionally one or more other components. By using the treatment liquid together with the ink composition, the speed of ink jet recording can be increased, and an image having an excellent drawing property (for example, reproducibility of fine lines and fine parts) with a high density and a high resolution, even when high-speed recording is carried out, can be obtained.

(Aggregating Components)

The treatment liquid can contain at least one aggregating component which is capable of forming aggregates by being brought into contact with the ink composition. By mixing the treatment liquid with the ink composition ejected by the ink jet method, coagulation of the pigments and the like that are dispersed stably in the ink composition is promoted.

Examples of the treatment liquid include liquids that are capable of forming coagulates by changing the pH of the ink composition. Here, the pH (25° C.) of the treatment liquid is preferably from 1 to 6, more preferably from 1.2 to 5, and even more preferably from 1.5 to 4, from the viewpoints of the aggregation speed of the ink composition. In this case, the pH (25° C.) of the ink composition used in the ejecting process is preferably from 7.5 to 9.5 (more preferably from 8.0 to 9.0).

Among these, in the present embodiment, from the viewpoints of the image density, resolution, and a higher recording speed of ink jet recording, the pH (25° C.) of the ink composition is 7.5 or more, and the pH (25° C.) of the treatment liquid is preferably 1.5 to 3.

The aggregating components may be used alone or as a mixture of two or more kinds thereof.

The treatment liquid may include at least one acidic compound as an aggregating component. As the acidic compound, a compound having a phosphoric acid group, a phosphonic acid group, a phosphinic acid group, a sulfuric acid group, a sulfonic acid group, a sulfinic acid, or a carboxy group, or a salt thereof (for example, a polyhydric metal salt) can be used. Among these, from the viewpoints of the aggregation speed of the ink composition, a compound having a phosphoric acid group or a carboxy group is more preferred, and a compound having a carboxy group is even more preferred.

The compound having a carboxy group is preferable selected from polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furancarboxylic acid, pyridinecarboxylic acid, coumaric acid, thiophene carboxylic acid, nicotinic acid, derivatives of the compounds, salts thereof (for example, polyvalent metal salts), and the like. These compounds may be used alone or in combination of two or more kinds thereof.

The treatment liquid in the present embodiment may include an aqueous solvent (for example, water), in addition to the acidic compound and the like.

The content of the acidic compound in the treatment liquid is preferably from 5% by mass to 95% by mass, more preferably from 10% by mass to 80% by mass, and even more preferably from 15% by mass to 50% by mass, with respect to the total mass of the treatment liquid, from the viewpoints of the coagulation effect.

The treatment liquid may be, for example, a treatment liquid including a polyvalent metal salt. When the treatment liquid including a polyvalent metal salt is used, high-speed aggregation properties can be improved. Examples of the polyvalent metal salt include salts of alkaline earth metals belonging to Group II of the periodic table (for example, magnesium and calcium), transition metals belonging to Group III of the periodic table (for example, lanthanum), cations from Group XIII of the periodic table (for example, aluminum), and lanthanides (for example, neodymium). As salts of the metals, carboxylic acid salts (formates, acetates, benzoates, and the like), nitrates, chlorides, and thiocyanates are preferable. Among these, calcium salts or magnesium salts of carboxylic acids (for example, formates, acetates, benzoates, and the like), calcium salts or magnesium salts of nitric acid, calcium chloride, magnesium chloride, and calcium salts or magnesium salts of thiocyanic acid are more preferable.

The content of the metal salt in the treatment liquid is preferably in the range of from 1% by mass to 10% by mass, more preferably 1.5% by mass to 7% by mass, and even more preferably 2% by mass to 6% by mass, from the viewpoints of the coagulation effect.

The treatment liquid may include at least one cationic organic compound as an aggregating component. Examples of the cationic organic compound include cationic polymers such as a poly(vinylpyridine) salt, a polyalkylaminoethyl acrylate, polyalkylaminoethyl methacrylate, a poly(vinylimidazole), a polyethyleneimine, a polybiguanide, a polyguanide, or a polyallylamine and a derivative thereof, and the like.

The weight average molecular weight of the cationic polymer is preferably small in terms of the viscosity of the treatment liquid. In a case in which the treatment liquid is applied onto a recording medium by an ink jet method, the weight average molecular weight is preferably in the range of from 1,000 to 500,000, more preferably from 1,500 to 200,000 and even more preferably from 2,000 to 100,000. A weight average molecular weight of 1000 or more is advantageous from the viewpoints of the aggregation speed and a weight average molecular weight of 500,000 or less is advantageous from the viewpoints of ejecting reliability. However, this does not apply in a case in which the treatment liquid is applied onto a recording medium by a method other than ink jet.

Preferable examples of the cationic organic compound include compounds of primary, secondary or tertiary amine salt type. Examples of amine salt type compounds include cationic compounds including compounds such as hydrochlorides or acetates (for example, laurylamine, palmitylamine, stearylamine, rosin amine, and the like), quaternary ammonium salt type compounds (for example, lauryltrimethylammonium chloride, cetyltrimethylammonium chloride, lauryldimethylbenzylammonium chloride, benzyltributylammonium chloride, benzalkonium chloride, and the like), pyridinium salt type compounds (for example, cetylpyridinium chloride, cetylpyridinium bromide, and the like), imidazoline type cationic compounds (for example, 2-heptadecenylhydroxyethylimidazoline and the like), ethylene oxide adducts of higher alkylamines (for example, dihydroxyethylstearylamine and the like), and the like, and amphoteric surfactants exhibiting cationic properties in a desired pH region, including amphoteric surfactants such as amino acid type amphoteric surfactants, carboxylate type amphoteric surfactants (for example, stearyldimethylbetaine, lauryldihydroxyethylbetaine, and the like), amphoteric surfactants of sulfuric acid ester type, sulfonic acid type or phosphoric acid ester type, and the like.

Among these, a divalent or higher cationic organic compound is preferable.

The content of the cationic organic compound in the treatment liquid is preferably from 1% by mass to 50% by mass, and more preferably from 2% by mass to 30% by mass, from the viewpoints of a aggregation effect.

Among these, as the aggregating component, a divalent or higher carboxylic acid or a divalent or higher cationic organic compound is preferable in view of aggregation properties and abrasion resistance of the image.

(Other Components)

In general, the treatment liquid in the present embodiment may contain a water-soluble organic solvent in addition to the aggregating components.

Within a range not interfering with the effect of the present embodiment, one or more other additives may also be used.

Details of the water-soluble organic solvent are the same as those in the above-described ink composition.

Examples of other additives above include those known additives such as a drying preventing agent (a moisturizing agent), an anti-fading agent, an emulsion stabilizer, a penetration enhancement agent, an ultraviolet ray absorber, a preservative, an anti-mold agent, a pH adjusting agent, a surface tension adjusting agent, an antifoaming agent, a viscosity modifier, a dispersant, a dispersion stabilizer, an anti-rusting agent, a chelating agent, and the like, and those mentioned as specific examples of other additives included in the above-described ink composition can be employed here.

The viscosity of the treatment liquid is preferably in the range of from 1 mPa·s to 30 mPa·s, more preferably from 1 mPa·s to 20 mPa·s, even more preferably from 2 mPa·s to 15 mPa·s, and particularly preferably from 2 mPa·s to 10 mPa·s, from the viewpoints of the aggregation speed of the ink composition.

The viscosity is measured under the condition of a temperature of 20° C. using VISCOMETER TV-22 (trade name, manufactured by Toki Sangyo Co., Ltd.).

Further, the surface tension of the treatment liquid is preferably from 20 mN/m to 60 mN/m, more preferably from 20 mN/m to 45 mN/m, and even more preferably from 25 mN/m to 40 mN/m, from the viewpoints of the aggregation speed of the ink composition.

The surface tension is measured under the condition of a temperature of 25° C. using an automatic surface tensiometer CBVP-Z (trade name, manufactured by Kyowa Interface Science Co., Ltd.).

<Recording Process>

The recording process in the present embodiment is a process in which an image is recorded on a recording medium by an ink jet method to record an image using the above-described ink composition of the present embodiment. Further, optionally, a treatment liquid application process in which a treatment liquid capable of forming aggregates by being brought into contact with the ink composition is applied onto a recording medium may be provided. The recording process in the present embodiment may further optionally include one or more other processes.

In the present process, the ink composition can be applied selectively onto the recording medium, so that a desired visible image can be formed. Details of the ink composition and details, preferred modes, and the like of each of the components in the ink composition of the present embodiment are as described above.

Specifically, the recording of an image using an ink jet method can be carried out by ejecting a liquid composition onto a desired recording medium by application of energy, and the recording medium may be, for example, a plain paper or a resin-coated paper, such as paper exclusively for ink jet recording, a film, paper that can be used both for ink jet recording and electrophotographic recording, cloth, glass, a metal, ceramic, or the like, and examples thereof include those described in JP-A Nos. 8-169172, 8-27693, 2-276670, 7-276789, 9-323475, 62-238783, 10-153989, 10-217473, 10-235995, 10-337947, 10-217597, 10-337947, and the like. Preferable examples of an ink jet recording method that is preferred in the present embodiment also include the method described in paragraphs [0093] to [0105] of JP-A No. 2003-306623.

The ink jet method is not particularly limited and may be any known method such as a charge-control method in which ink is ejected by electrostatic attraction force, a drop-on-demand method (pressure-pulse method) in which a pressure of oscillation of a piezo element is utilized, an acoustic ink jet method in which ink is ejected by radiation pressure generated by irradiation of ink with acoustic beams that have been converted from electric signals, a thermal ink jet method in which ink is ejected by a pressure generated by formation of bubbles caused by heating of ink (BUBBLEJET (registered trademark) system), and the like. In particular, an ink jet method described in JP-A No. 54-59936 can be effectively used, in the ink jet method in which ink is ejected from a nozzle by an acting force generated by a rapid change in the volume of the ink caused by application of a thermal energy to the ink.

Further, examples of the ink jet method include a method in which a large number of small-volume droplets of an ink having a low concentration, which is called a photo ink, are ejected, a method in which inks of substantially the same color hue at different concentrations are used to improve the image quality, and a method in which a clear and colorless ink is used.

Further, the ink jet head used in an ink jet method may be either an on-demand type head or a continuous type head. Further, specific examples of the ejecting systems include electromechanical transduction systems (for example, a single-cavity system, a double-cavity system, a vendor system, a piston system, a share-mode system, a shared-wall system, and the like), electrothermal transduction systems (for example, a thermal ink jet system, a BUBBLEJET (registered trademark) system, and the like), electrostatic suction systems (for example, an electric-field-control system, a slit-jet system, and the like), discharge systems (for example, a spark-jet system and the like), and the like, and any of these ejecting systems is applicable.

In addition, the ink nozzles and the like used when carrying out the ink jet recording by the ink jet method are not particularly limited, and may be selected as appropriate according to purposes.

Specific examples of the ink jet recording method are presented below.

Regarding the ink jet recording method, there is (1) a method called an electrostatic attraction system. It is a method in which a strong electric field is applied between a nozzle and an acceleration electrode placed in front of the nozzle, ink in the form of a liquid droplet is continuously ejected from the nozzle, and while the ink droplets pass between the deflection electrode, a print information signal is given to the deflection electrode, thereby sending the ink droplets on the recording medium, and the ink is fixed on the recording medium, whereby the image is recorded, or a method in which ink droplets are ejected from a nozzle onto a recording medium according to the print information signal without deflecting the ink, and an image is fixed onto a recording medium, and whereby the image is recorded. Further, there is (2) a method in which pressure is applied to an ink liquid by a small pump and at the same time, the ink jet nozzle is vibrated mechanically by a quartz crystal vibrator or the like, thereby ejecting the ink droplets from the nozzle by force. The ink droplets ejected from the nozzle are charged at the time when they are ejected, thereby giving a print information signal to a deflection electrode while passing through the deflection electrode and applying the ink droplets towards the recording medium, and thus, recording an image on the recording medium. Next, there is (3) a method in which pressure and the print information signal are added together to an ink liquid by a piezoelectric element, thereby ejecting the ink droplets from a nozzle towards a recording medium, and thus, recording an image on a recording medium (piezo) and (4) a method in which an ink liquid is heated using a microelectrode according to the print information signal for foaming, and the ink liquid is ejected from a nozzle towards a recording medium by expanding the bubbles, and recording an image on a recording medium (BUBBLEJET (registered trademark)).

Regarding the ink jet head, there are a shuttle system in which recording is carried out while a short serial head is used, and the head is moved in the width direction of a recording medium in a scanning manner, and a line system in which a line head having recording devices that are aligned correspondingly to the entire length of one side of a recording medium is used. In the line system, image recording can be carried out over the whole of one surface of a recording medium by scanning the recording medium in a direction perpendicular to the direction along which the recording devices are aligned, and a conveyance system, such as carriage which moves the short head in a scanning manner, and the like is unnecessary. Further, since a complicated scan-movement control of the movement of the carriage and the recording medium is unnecessary and only the recording medium is moved, the recording speed can be increased compared to the shuttle system. The ink jet recording method of the present embodiment can be applied to both of these systems, but effects in improving the ejecting accuracy and rubbing resistance of an image are larger in a case in which the ink jet recording method of the present invention is applied to a line system, in which dummy ejecting is not generally performed.

Furthermore, in the recording process in the present embodiment, in the case of using a line system, one kind of the ink composition may be used or two or more kinds of the ink composition can be used to carry out the recording appropriately at an ejecting (ejection) gap between the ink composition that is ejected first ($n^{th}$ color ($n \geq 1$), for example, $2^{nd}$ color) and the ink composition that is ejected subsequently ($n+1^{th}$ color, for example, $3^{rd}$ color) of 1 second or less. In the present embodiment, when recording in a line system with an ejecting gap of 1 second or less, it is possible to obtain an image having excellent abrasion resistance and suppressed blocking generation under recording at a high speed that is no less than a conventional speed can be obtained while preventing blurring occurring due to interference between the ink droplets or color mixing. Further, an image having excellent color and drawing properties (for example, reproducibility of fine lines and fine parts in the image) can be obtained.

The amount of the ink droplets ejected from an ink jet head is preferably from 0.5 pl (picoliters) to 6 pl, more preferably from 1 pl to 5 pl, and even more preferably from 2 pl to 4 pl, from the viewpoints of obtaining a high-precision image.

—Treatment Liquid Application Process—

In the present embodiment, a treatment liquid application process can be provided before or after the recording process.

In the treatment liquid application process, a treatment liquid capable of forming aggregates by being brought into contact with the ink composition is applied onto a recording medium to bring the treatment liquid into contact with the ink composition for forming an image. In this case, dispersed particles such as polymer particles, coloring materials (for example, pigments), and the like in the ink composition are aggregated to fix an image on the recording medium. Details and preferred modes of each of the components in the treatment liquid are as described above.

Application of the treatment liquid can be carried out using a known method such as a coating method, an ink jet method, an immersion method, and the like. The coating method may be a known coating method using a bar coater, an extrusion die coater, an air doctor coater, a blade coater, a rod coater, a knife coater, a squeeze coater, a reverse roll coater, and the like. Details of the ink jet method are as described above.

In the present embodiment, it is preferable that the recording process is performed after the treatment liquid is applied in the treatment liquid application process. That is, it is preferable that the treatment liquid for aggregating the coloring material (preferably, a pigment) in the ink composition is applied on the recording medium before the ink composition is applied on the recording medium, and the ink composition is applied so as to come into contact with the treatment liquid provided on the recording medium, whereby forming an image. As a result, ink jet recording can be performed at a higher speed, and an image having a high density and a high resolution can be obtained even in a case in which recording is performed at a high speed.

The amount of the treatment liquid to be applied is not particularly limited as long as it is possible to form aggregates at the ink composition, and is preferably 0.1 $g/m^2$ or more in terms of the amount of the aggregating component (for example, a divalent or higher carboxylic acid or a cationic organic compound) to be applied. The amount of the aggregating component to be applied is preferably from 0.1 $g/m^2$ to 1.0 $g/m^2$, and more preferably from 0.2 $g/m^2$ to 0.8 $g/m^2$. In a case in which the amount of the aggregating component to be applied is 0.1 $g/m^2$ or more, the aggregation reaction proceeds properly, whereas in a case in which the amount of the aggregating component to be applied is 1.0 $g/m^2$ or less, the degree of glossiness is less likely to become too high, which is thus preferable.

In the present embodiment, it is preferable that the recording process is provided after the treatment liquid application process (in other words, the ink composition is applied on the recording medium after the treatment liquid is applied on the recording medium), and after the treatment liquid is applied on a recording medium and before the ink composition is applied on the recording medium, a heat-drying process is performed in which the treatment liquid on the recording medium is dried by heating. By drying the treatment liquid in advance by heating prior to the recording process, the ink coloring property such as prevention of blurring and the like may become favorable, and a visible image having good color density and hue can be recorded.

Heating-drying can be carried out according to a known heating means such as a heater and the like, or an air-blowing means involving air blowing such as a drier and the like, or a method in which these methods are combined. Examples of the heating method include a method of supplying heat from the side of the recording medium opposite to the surface on which the treatment liquid has been applied, using a heater or the like, a method of blowing a warm or hot air to the surface of the recording medium on which the treatment liquid has been applied; a heating method using an infrared heater, and the like, and a combination of two or more of the above methods.

2. Application Process

The application process of the present embodiment is a process in which a liquid including resin particles having a glass transition temperature is applied on the surface of a heating roller or the image. That is, it may be a method in which the liquid including the resin particles (hereinafter, may also be referred to as "resin particle-containing liquid") is applied to the heating roller, via the heating roller having the resin particle applied on the surface thereof, the resin particles are applied on the surface of the image (first mode), or a method in which the resin particle-containing liquid is applied directly on the surface of the image (second mode).

(Resin Particle-Containing Liquid)

The second polymer particles having a glass transition temperature, used in the resin particle-containing liquid (hereinafter also referred to as "resin particles") are ones capable of inhibiting the blocking, and are not limited as long as they are resin particles having a higher glass transition temperature than the surface temperature of the heating roller.

The lower limit of the glass transition temperature is higher than the surface temperature of the heating roller. Due to this, the particles can be present on the image after fixing and the adhesion between the images can be suppressed, and thus, the blocking resistance can be improved. For example, the glass transition temperature may be 80° C. or higher, preferably 90° C. or higher, and more preferably 100° C. or higher. The upper limit of the glass transition temperature is not particularly limited.

Here, as the glass transition temperature (Tg) in the present embodiment, the measured Tg obtained by actual measurement is employed. Specifically, the measured Tg means a value measured under normal measurement conditions using a differential scanning calorimeter (DSC) EXSTAR6220 (trade name manufactured by SII Nano Technology Inc.)

However, in a case in which the measurement is difficult due to decomposition of the resin particles or the like, the obtained value Tg calculated by the following calculation equation (S) is employed.

$$1/Tg=\Sigma(X_i/Tg_i) \quad (S)$$

Herein, for a resin particle as a calculation target, it is assumed that n kinds of monomer components of i=1 to n are copolymerized. $X_i$ is the weight fraction ($\Sigma X_i=1$) of the i-th monomer and $Tg_i$ is the glass transition temperature (absolute temperature) of a homopolymer of the i-th resin. Σ is the sum of i=1 to n. As the value ($Tg_i$) of the glass transition temperature of a homopolymer of each resin, the values described in "Polymer Handbook" (3rd Edition) (edited by J. Brandrup and E. H. Immergut (Wiley-Interscience, 1989)), the disclosure of which is incorporated by reference herein, are employed.

The resin particles may be either poorly water-soluble or water-insoluble, but in the present embodiment, they are preferably insoluble in water. When the resin particles are poorly water soluble or water insoluble, preferably water-insoluble, in a case in which the resin particles are applied onto the recorded image, it is possible to effectively suppress the lowering of the blocking resistance caused by the resin particles dissolved or penetrated into the inside of the recorded image, and it is also possible to suppress generation of unevenness occurring on the side of the recorded image. In the present embodiment, to be water-insoluble means that the dissolution amount is 5.0 parts by mass or less with respect to 100 parts by mass (25° C.) of water. The liquid including the resin particles of the present embodiment is preferably in the dispersion state, that is, a resin particle dispersion liquid.

Examples of the resin particle include polymethyl (meth) acrylate particles, polystyrene particles, polyester particles, and the like. Among these, from the viewpoints of blocking inhibition and the like, polymethyl (meth)acrylate particles are preferable. The polymethyl (meth)acrylate refers to at least one kind of polymethyl acrylate and polymethyl methacrylate (PMMA).

With respect to the resin particles, one kind may be used singly, or two or more kind thereof may be used in combination.

The volume average particle diameter of the resin particle is usually from 0.05 μm to 20.0 μm, preferably from about 2 μm to about 15 μm, and more preferably from about 4 μm to about 12 μm. The volume average particle diameter of the present embodiment is a value measured by a NANOTRAC particle size distribution measuring instrument UPA-EX150 (trade name, manufactured by NIKKISO Co., Ltd.). The measurement can be carried out using a sample liquid for measurement prepared by adding 10 mL of ion-exchange water to 100 μl of 20% by mass of an aqueous resin particle dispersion, and adjusting the temperature to 25° C.

The content of the resin particles contained in the liquid is not limited, but it may be, for example, from about 1% by mass to about 50% by mass, and preferably from about 5% by mass to about 40% by mass, with the respect to the total amount of the resin particle-containing liquid.

The resin particle-containing liquid may include any liquid (the liquid used in the resin particle-containing liquid may also be referred to as "first liquid" in the present embodiment) is not limited as long as the first liquid is capable of dispersing the resin particles. In the present embodiment, a nonvolatile solvent is preferably used. The nonvolatile solvent in the present embodiment refers to a solvent that does not boil at 150° C. or lower under 1 atm. Examples of such liquid include silicone oils or fluorine-containing oils such as dimethylsilicone oil, fluorinated oil, fluorosilicone oil, amino-modified silicone oil, and the like; liquid paraffin, and the like. Among these, from the viewpoint that a homogeneous release agent layer is formed on a surface layer of a heating roller and resin particles can be easily transferred to a recorded image surface, preferable examples include silicone oils and fluorine-containing oils Examples of the silicone or fluorine-containing oil include "KF-96-10 CS", "KF-96-20 CS", "KF-96-30 CS", "KF-96-50 CS", "KF-96-100 CS", "KF-96-200 CS", "KF-96-300 CS", "KF-96-500 CS", "KF-96-1000 CS", "KF-96-3000 CS", "KF-96-5000 CS", and "KF-96-10000 CS", (trade names) each manufactured by Shin-Etsu Chemical Co., Ltd., and dimethylsilicone oils such as "SH200-10 CS", "SH200-100 CS", "SH200-1000 CS", "SH200-10000 CS", and the like, (trade names) each manufactured by Dow Corning Toray Co., Ltd.; "KF-393", "KF-859", "KF-860", "KF-861", "KF-864", "KF-865", "KF-867", "KF-868", "KF-869", "KF-6012", "KF-880", "KF-8002", "KF-8004", "KF-8005", "KF-877", "KF-8008", "KF-8010", "KF-8012", "X-22-3820 W", "X-22-3939 A", "X-22-161 A", "X-22-161B", and "X-22-1660B-3", (trade names) each manufactured by Shin-Etsu Chemical Co., Ltd., and amino-modified silicone oils such as "BY16-871", "BY16-853 U", "FZ-3705", "SF8417", "BY16-849", "FZ-3785", "BY16-890", "BY16-208", "BY16-893", "FZ-3789", "BY16-878", "BY16-891", and the like, (trade names) each manufactured by Dow Corning Toray Co., Ltd.; "FL-5", "X22-821", "X-22-822", "FL-100-100 CS", "FL-100-450 CS", "FL-100-1000 CS", and "FL-100-10000 CS", (trade names) each manufactured by Shin-Etsu Chemical Co., Ltd., and fluorosilicone oils such as "FS1265-300 CS", "FS1265-1000 CS", "FS1265-10000

CS", and the like, (trade names) each manufactured by Dow Corning Toray Co., Ltd.; and the like.

With respect to the first liquid, one kind of liquid may be used singly, or two or more kind thereof may be used in combination.

The resin particle-containing liquid (particularly, resin particles) in the present embodiment is preferably one that does not form a film or is not polymerized when applied on an image surface. It is particularly preferably one that does not form a film in a fixing process. For example, it is preferable that in a case in which the content ratio of the resin particles and the water-soluble organic solvent is such a ratio that the latter is at 40 parts by mass based on 100 parts by mass of the former, the resin particle-containing liquid does not have a minimum film-forming temperature. This makes it possible to further improve the fixing off-set resistance and inhibit the blocking more effectively. This minimum film-forming temperature may be determined by substantially the same method as that for obtaining the minimum film-forming temperature $T_A$ as described above.

The resin particle-containing liquid may contain one or more known additives within a range not interfering with the effect of the present application.

(Heating Roller)

The surface temperature (heating temperature) of the heating roller is higher than the minimum film-forming temperature ($MFT^{40\%}$), and lower than the glass transition temperature of the resin particles. Accordingly, by promoting the film formation of the film-forming polymer in the image while making the resin particles exist in the form of particles on the image, the glossiness may be enhanced and thus, the blocking resistance may also be improved. The surface temperature of the heating roller may be, for example, from about 40° C. to about 100° C., and preferably from about 50° C. to about 90° C.

The method of heating is not particularly limited, but examples thereof include methods of drying in a non-contact mode, such as a method of heating with a heating member such as a nichrome wire heater and the like, a method of supplying warm air or hot air, a method of heating with a halogen lamp, an infrared ray lamp, or the like.

The heating roller may be either a metal roller made of a metal, or a roller having a core metal made of a metal and a coated layer including an elastic member, and optionally, a surface layer (also referred to a release layer) provided at the periphery thereof. The metal roller and the core metal made of a metal can be formed, for example, of a cylindrical member made of iron, aluminum, SUS, or the like. Particularly, the coated layer is formed preferably of a silicone resin or fluorine-containing resin having releasability. Further, the heating roller preferably includes a heating member built in the inside of the core metal thereof. When, for example, two rollers are used, one of the two rollers may have a heating member built in the core metal thereof. The recording medium may be heated by applying the heating treatment and the pressing treatment simultaneously by passing the medium between the rollers. Two heating rollers may be used and the recording medium may be heated by passing the medium between the two heating rollers. As the heating member, for example, a halogen lamp heater, a ceramic heater, a nichrome wire, or the like is preferred.

(Application onto Surface of Heating Roller)

The application process of the first mode of the present embodiment is a process for applying a liquid including the resin particles (resin particle-containing liquid) onto the surface of the heating roller. For example, a method in which a fabric material having a resin particle-containing liquid impregnated therein is brought into contact with a heating roller surface, a method in which a resin particle-containing liquid is sprayed onto a heating roller surface, a method for in which the surface of the heating roller is coated with a roll coater, and the like. Particularly, the method in which a fabric material is brought into contact with a heating roller is preferable from the viewpoints of supplying an appropriate amount of a resin particle-containing liquid to a roller surface without unevenness. The fabric material (web member) as used herein may be any one of woven fabrics, non-woven fabrics, and the like, and a commercially available or known one may be used. However, the fabric material (web member) having heat resistance is preferable since the material is brought into contact with the heating roller. Examples thereof include polyvinylidene chloride, polyethylene, an aramide, a polyester, a mixture thereof, and the like.

One example of the application process of the first mode is illustrated with reference to FIG. 1. In a heating roller (fixing roller) 1, through a web pressing roller 3, a fabric material 5 including the resin particle-containing liquid is pressed. The fabric material 5 is wound up by rotation of a delivery roller 2 and a winding roller 4 to be brought into contact with the heating roller 1, thereby continuously supplying the resin particle-containing liquid to the heating roller surface. 6 is a pressing roller.

(Application Onto Image Surface)

The application process of the second mode of the present embodiment is a process in which the resin particle-containing liquid is applied directly to a recording medium on which the image has been recorded, not to the heating roller.

Application in the second mode can be carried out by a known method such as a spraying method, a coating method, an ink jet method, an immersion method, and the like. The coating method may be a known coating method using a bar coater, an extrusion die coater, an air doctor coater, a blade coater, a rod coater, a knife coater, a squeeze coater, a reverse roll coater, or the like. Details of the ink jet method are as described above.

3. Fixing Process

The fixing process is a process in which the heating roller is brought into contact with the surface of the image.

The surface temperature of the heating roller of the present embodiment satisfies a formula (I), that is, the surface temperature of the heating roller is higher than a minimum film-forming temperature ($MFT^{40\%}$) and lower than the glass transition temperature of the resin particles. This makes it possible to promote the film formation of the film-forming polymer contained in the recorded image to perform the fixing, and at the same time, to apply efficiently the resin particles onto the image surface while maintaining the state of particles. Therefore, blocking prevention characteristics can be obtained, in addition to the glossiness. Further, the fixing off-set resistance can also be improved.

As for the fixing process of the present embodiment, for example, in the first mode, the heating roller having the resin particle-containing liquid adhered on the roller surface is pressed onto the recording medium (printed article) on which the image has been recorded, and thus, the resin particles can be applied on the printed article surface and, also, the image can be fixed. In the second mode, the resin particles are present on the printed article surface in advance before being brought into contact with the heating roller, and by contact with the heating roller, the image can be fixed together with the resin particles. In the present embodiment, the first mode is preferred, from the viewpoints that the resin particles can be adhered appropriately onto the image surface and the blocking can be inhibited effectively.

The pressing method is not limited, but examples thereof include (i) a method in which a pressing roller is also used and a recorded image surface passes between a pair of these rollers (the heating roller and the pressing roller) such that the recorded image surface if brought into contact with the heating roller surface, (ii) a method in which two heating rollers are used, and a printed article passes between a pair of these heating rollers, (iii) a method in which a printed article conveyed by on a conveying belt passes between such that the recorded image surface is brought into contact with the heating roller surface, (iv) a combination of any of these methods, and the like.

The pressure for pressing is preferably in the range of from 0.1 MPa to 3.0 MPa, more preferably in the range of from 0.1 MPa to 1.0 MPa, and even more preferably in the range of from 0.1 MPa to 0.5 MPa, in view of surface smoothness.

A preferable nip time during which the recording medium passes between the heating roller is preferably from 1 millisecond to 10 seconds, more preferably from 2 milliseconds to 1 second, and even preferably from 4 milliseconds to 100 milliseconds. A preferable nip width is from 0.1 mm to 100 mm, more preferably from 0.5 mm to 50 mm, and even preferably from 1 mm to 10 mm.

Moreover, the pressure (nip pressure) may be attained, for example, by selecting an elastic member such as a spring and the like having tension and disposing the elastic member on both roller ends of rollers such as a heating roller and the like so that a desired nip may be obtained taking the nip gap into consideration.

The belt substrate for conveying the recording medium is not particularly limited, and, for example, a seamless electrocast nickel substrate may be preferred. The thickness of the substrate is preferably from 10 μm to 100 μm. Examples of the material of the belt substrate include aluminum, iron, polyethylene, nickel and the like. When disposing a silicone resin or a fluorine-containing resin, the thickness of the layer formed by using such a resin is preferably from 1 μm to 50 μm, and more preferably from 10 μm to 30 μm.

The conveying speed of the recording medium is preferably in the range of from 200 mm/sec to 700 mm/sec, more preferably from 300 mm/sec to 650 mm/sec, and even preferably from 400 mm/sec to 600 mm/sec.

The amount of the resin particles to be applied onto the recording medium is not limited, and can be adjusted appropriately with a supply amount onto the heating roller, the concentration of the resin particle-containing liquid, or the like. Further, in a method in which a fabric material having a resin-containing liquid impregnated therein is used, the amount can be adjusted with the impregnation amount onto the fabric material, the delivery amount of the fabric material, or the like.

In the image forming method of the present embodiment, a device such as an ink drying zone and the like can be included to carry out a drying process between the recording process, the application process, and the fixing process, or after the application process.

Figure 2:
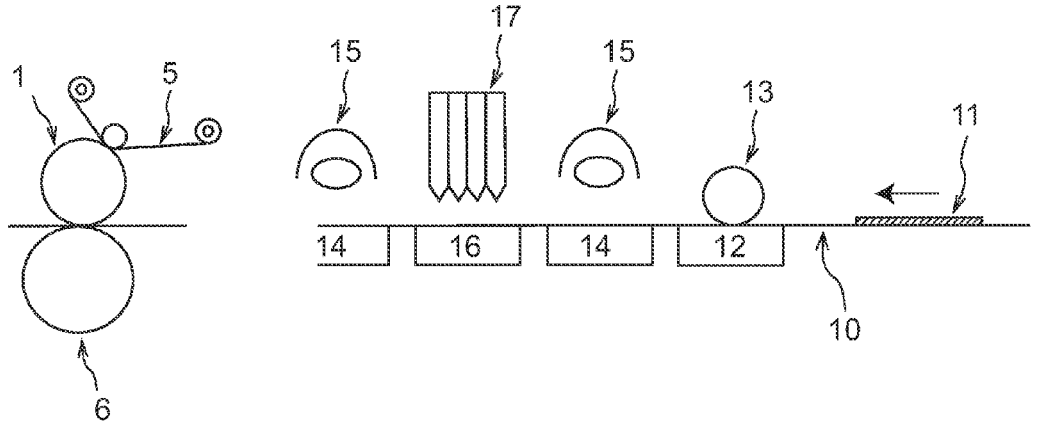
FIG. 2 is a schematic view showing a device used in an ink jet image forming method of an embodiment of the present invention.

One preferable example of the image forming method of the present embodiment is illustrated with reference to the schematic view of a device shown in FIG. 2. In a case in which the recording medium 11 is delivered by the conveying belt 10 or the like in the device, the treatment liquid is first applied by a bar 13 for applying the treatment liquid in the treatment liquid coating section 12, and the recording medium is then dried by the heater 15 in the heating-drying section 14. Thereafter, when the recording medium 11 has reached the ink jet recording section 16, ink is ejected from the ink jet nozzle 17 towards the recording medium, whereby an image is formed on the recording medium. The recording medium (printed article) on which the image has been recorded is conveyed to the fixing section through the heating-drying section 14. The fixing section includes a heating roller (fixing roller) 1 and a pressing roller 6. On the heating roller, the fabric material 5 partially impregnated in the resin particle-containing liquid is pressed, and as a result, the resin particles are adhered onto the roller surface. The conveyed printed article passes between the heating roller 1 and the pressing roller 6. By this passage, the image formed on the recording medium is fixed while the resin particles adhered onto the heating roller surface are transferred to the print surface. Thereafter, the recording medium is cut to a predetermined size if necessary and, then, the recording medium is discharged from a discharge port to allow the printed article to be stacked on a discharge tray (not shown). In FIG. 2, the treatment liquid-coating section 12 is provided and first the recording medium is brought into contact with the treatment liquid-coating bar, thereby carrying out a treatment liquid application process (as described later) on the recording medium surface. Further in FIG. 2, the heating-drying sections 14 are provided, respectively, after the treatment liquid-applied coating section 12 and the ink jet recording section 16 to carry out the drying process. However, the image forming method of the present embodiment may be a method which does not including the treatment liquid application process and the heating process.

II. Second Image Forming Method

The second image forming method is described. Hereinbelow, in this section of "II. Second Image Forming Method", the second image forming method may be simply referred to as "the present embodiment".

The second image forming method include applying an ink composition onto a recording medium by an ink jet method (ink application process), and applying a dispersion liquid including polymer particles having a volume average particle diameter of from 1 μm to 30 μm and a glass transition temperature Tg of 100° C. or higher and a nonvolatile solvent (hereinafter also simply referred to as a dispersion liquid) onto the recording medium onto which the ink composition has been applied (dispersion liquid application process). Hereinafter, details of the present embodiment are described.

—Dispersion Liquid—

The dispersion liquid in the present embodiment includes a nonvolatile solvent and polymer particles having a volume average particle diameter from 1 μm to 30 μm and a Tg of 100° C. or higher.

(Polymer Particles)

The dispersion liquid in the present embodiment includes polymer particles having a volume average particle diameter from 1 μm to 30 μm and a Tg of 100° C. or higher.

The glass transition temperature (Tg) of the polymer particles in the present embodiment is 100° C. or higher, preferably from 100° C. to 250° C., even more preferably from 100° C. to 180° C., and still more preferably from 130° C. to 160° C. It is preferable to use polymer particles having a Tg of 100° C. or higher from the viewpoints of improvement of both-side printability, including suppressing attachment of ink onto the backside of the recording medium of the polymer particles and suppressing unevenness or cissing of the treatment liquid or ink.

Herein, as the glass transition temperature (Tg) of the particle in the present embodiment, the measured Tg obtained by actual measurement is employed. Specifically, the measured Tg means a value measured as follows, using a differential scanning calorimeter (DSC) EXSTAR6220 (trade name, manufactured by SII Nano Technology, Inc.)

The glass transition temperature Tg is measured as follows. The solid of polymer particles are placed in an aluminum pan, which is sealed. Then, the following steps are carried out under a nitrogen atmosphere:

1) a step of decreasing the temperature from 30° C. to −50° C. at 50° C./minute, 2) a step of increasing the temperature from −50° C. to 140° C. at 20° C./minute, 3) a step of decreasing the temperature from 140° C. to −50° C. at 50° C./minute, and 4) a step of increasing the temperature from −50° C. to 140° C. at 20° C./minute.

The value of the peak top of DSC in the step 4) in which the temperature is increased from −50° C. to 140° C. is measured and defined as Tg.

However, in a case in which the measurement is difficult due to decomposition of the polymer or the like, a calculated Tg obtained by the following calculation equation (S) is employed.

$$1/Tg=\Sigma(X_i/Tg_i) \quad (S)$$

Herein, for a polymer as a calculation target it is assumed that n kinds of monomer components of i=1 to n are copolymerized. $X_i$ is the weight fraction ($\Sigma X_i=1$) of the i-th monomer and $Tg_i$ is the glass transition temperature (absolute temperature) of a homopolymer of the i-th monomer. Σ is the sum of i=1 to n. As the value ($Tg_i$) of the glass transition temperature of a homopolymer of each monomer, the values described in "Polymer Handbook" (3rd Edition) (edited by J. Brandrup and E. H. Immergut (Wiley-Interscience, 1989)) are employed.

The polymer particles in the present embodiment are not limited as long as they are polymer particles having a volume average particle diameter of from 1 μm to 30 μm and a Tg of from 100° C. to 250° C., but example thereof include an acrylonitrile-styrene copolymer (Tg>100° C.), a polystyrene (Tg>100° C.), a styrene-divinylbenzene copolymer (Tg>100° C.), a polymethyl (meth)acrylate (Tg>100° C.), a polyisobornyl methacrylate (Tg>155° C.), a polyacrylonitrile (Tg>104° C.), a polycarbonate (Tg>150° C.), a polytetrafluoroethylene (Tg>125° C.), and the like, from which, preferable examples include a polystyrene and a polymethyl (meth) acrylate. Polymethyl (meth)acrylate refers to at least one of a polymethyl acrylate and a polymethyl methacrylate (PMMA).

When crosslinked polymer particles having a crosslinked structure are used as the polymer particles in the present embodiment, greater effects may be obtained in terms of the both-side printability. Specifically, the polymer particles having a crosslinking density from 0.01% by mass to 50% by mass, more preferably from 0.1% by mass to 40% by mass, and most preferably from 1% by mass to 20% by mass. The crosslinking density can be measured by a known method.

The polymer particles in the present embodiment have a volume average particle diameter of from 1 μm to 30 μm. The volume average particle diameter is preferably from 2 μm to 15 μm, and more preferably from 4 μm to 12 μm. By setting the volume average particle diameter to this range, the fixing off-set of the image section can be further inhibited. The volume average particle diameter in the present embodiment is a value measured by a NANOTRAC particle size distribution measuring instrument UPA-EX150 (trade name, manufactured by NIKKISO Co., Ltd.). The measurement is carried out using a sample liquid for measurement prepared by adding 10 mL of ion-exchange water to 100 μl of 20% by mass of an aqueous resin particle dispersion, and adjusting the temperature to 25° C.

As the polymer particles, a commercially available product may be used. In a case in which a commercially available product in a form of dispersion is used, it may be used after being made into powder by a known method such as freeze-drying and the like.

One kind of polymer particles may be used singly, or two or more kinds thereof may be used in combination.

(Nonvolatile Solvent)

The dispersion liquid in the present embodiment includes a nonvolatile solvent. The nonvolatile solvent in the present embodiment refers to a solvent that does not boil at 150° C. or lower under 1 atm. Examples of such solvent include silicone oils and fluorine-containing oils such as dimethylsilicone oil, fluorinated oil, fluorosilicone oil, amino-modified silicone oil, and the like; liquid paraffin, and the like.

As the nonvolatile solvent in the present embodiment, silicone oil or fluorine-containing oil is preferred, and silicone oil is more preferred.

Examples of the nonvolatile solvent in the present embodiment include "KF-96-10 cs", "KF-96-20 cs, KF-96-30 cs", "KF-96-50 cs", "KF-96-100 cs", "KF-96-200 cs", "KF-96-300 cs", "KF-96-500 cs", "KF-96-1000 cs", "KF-96-3000 cs", "KF-96-5000 cs", and "KF-96-10000 cs", (trade names) each manufactured by Shin-Etsu Chemical Co., Ltd., dimethylsilicone oils such as "SH200-10 CS", "SH200-100 CS", "SH200-1000 CS", "SH200-10000 CS", and the like, (trade names) each manufactured by Dow Corning Toray Co., Ltd.; "KF-393", "KF-859", "KF-860", "KF-861", "KF-864", "KF-865", "KF-867", "KF-868", "KF-869", "KF-6012", "KF-880", "KF-8002", "KF-8004", "KF-8005", "KF-877", "KF-8008", "KF-8010", "KF-8012", "X-22-3820 W", "X-22-3939 A", "X-22-161 A", "X-22-161 B", and "X-22-1660B-3", manufactured by Shin-Etsu Chemical Co., Ltd., amino-modified silicone oils such as "BY16-871", "BY16-853 U", "FZ-3705", "SF8417", "BY16-849", "FZ-3785", "BY16-890", "BY16-208", "BY16-893", "FZ-3789", "BY16-878", "BY16-891", and the like, (trade names) each manufactured by Dow Corning Toray Co., Ltd.; "FL-5", "X22-821", "X-22-822", "FL-100-100 CS", "FL-100-450 CS", "FL-100-1000 CS", and "FL-100-10000 CS", manufactured by Shin-Etsu Chemical Co., Ltd., and fluorosilicone oils such as "FS1265-300 CS", "FS1265-1000 CS", "FS1265-10000 CS", and the like, (trade names) each manufactured by Dow Corning Toray Co., Ltd.; and the like.

One kind of nonvolatile solvent may be used singly, or two or more kinds thereof may be used in combination.

The content of the polymer particles contained in the dispersion liquid is not limited, but it is, for example, from about 1% by mass to 50% by mass, preferably about 5% by mass to 40% by mass, and more preferably from about 10% to 30%, with the respect to the total amount of the dispersion liquid, from the viewpoint of improving the applicability of the dispersion.

(Other Additives)

The dispersion liquid in the present embodiment may further include one or more other additives in addition to the above-described components. Examples of other additives include known additives such as a dispersant, an emulsifier, a drying preventing agent (a moisturizing agent), an anti-fading agent, an emulsion stabilizer, an ultraviolet ray absorber, a preservative, an anti-mold agent, a pH adjusting agent, a surface tension adjusting agent, an anti-foaming agent, a viscosity-adjusting agent, a dispersion stabilizer, an anticorrosive agent, a chelating agent, and the like.

The dispersion liquid in the present embodiment can be formed by mixing the above-described components and dispersing them using a known or commercially available dispersing instrument. For example, the dispersion can be obtained by mixing them by an emulsifying device.

Next, details of each process included in the second image forming method is described.

<Ink Application Process>

The ink application process in the present embodiment is an ink application process in which an ink composition is applied onto a recording medium by an ink jet method.

(Ink Jet Method)

The ink jet method is not particularly limited and may be any known method such as a charge-control method in which ink is ejected by electrostatic attraction force, a drop-on-demand method (pressure-pulse method) in which a pressure of oscillation of a piezo element is utilized, an acoustic ink jet method in which ink is ejected by radiation pressure generated by irradiation of ink with acoustic beams that have been converted from electric signals, a thermal ink jet method in which ink is ejected by a pressure generated by formation of bubbles caused by heating of ink (BUBBLEJET (registered trademark) system), and the like. Further, examples of the ink jet method include a method in which a large number of small-volume droplets of an ink having a low optical density, which is called a photo ink, are ejected, a method in which inks of substantially the same color hue at different densities are used to improve the image quality, and a method in which a clear and colorless ink is used.

Further, the ink jet head used in an ink jet method may be either an on-demand type head or a continuous type head. Further, examples of the ejecting systems include electromechanical transduction systems (for example, a single-cavity system, a double-cavity system, a vendor system, a piston system, a share-mode system, a shared-wall system, and the like), electrothermal transduction systems (for example, a thermal ink jet system, a BUBBLEJET (registered trademark) system, and the like), electrostatic suction systems (for example, an electric-field-control system, a slit-jet system, and the like), discharge systems (for example, a spark-jet system and the like), and the like, and any of these ejecting systems is applicable.

In addition, the ink nozzles and the like used when carrying out the ink jet recording by the ink jet method are not particularly limited, and may be selected as appropriate according to purposes.

Regarding the ink jet head, there are a shuttle system in which recording is carried out while a short serial head is used, and the head is moved in the width direction of a recording medium in a scanning manner, and a line system in which a line head having recording devices that are aligned correspondingly to the entire length of one side of a recording medium is used (also be referred to as "single pass method"). In the line system, image recording can be carried out over the whole of one surface of a recording medium by moving the recording medium in a direction orthogonal to the direction along which the recording devices are aligned, and a conveyance system, such as carriage which moves the short head in a scanning manner, and the like is unnecessary. Further, since a complicated scan-movement control of the movement of the carriage and the recording medium is unnecessary and only the recording medium is moved, the recording speed can be increased compared to the shuttle system. The ink jet recording method of the present embodiment can be applied to both of these systems, but effects in improving the ejecting accuracy and abrasion resistance of an image are larger in a case in which the ink jet recording method of the present invention is applied to a line system, in which dummy ejecting is not generally performed.

The amount of the ink droplets ejected from an ink jet head is preferably 0.5 pl (picoliters) to 15 pl, more preferably from 1 pl to 12 pl, and even more preferably 2 pl to 10 pl, from the viewpoints of obtaining a high-precision image.

(Recording Medium)

According to the ink jet recording method of the present embodiment, an ink composition is applied onto a recording medium.

The recording medium is not particularly limited, but a cellulose-based general printing paper, such as high-quality paper, coat paper, or art paper, which is used for general offset printing and the like, can be used.

As the recording medium, a commercially available product can be used, and examples thereof include high-quality papers (A) such as "OK PRINCE HIGH-QUALITY" (trade name) manufactured by Oji Paper Co., Ltd., SHIRAOI (trade name) manufactured by Nippon Paper Industries Co., Ltd., "NEW NPI HIGH-QUALITY" (trade name) manufactured by Nippon Paper Industries Co., Ltd., and the like, fine coated papers such as "OK EVER LIGHT KOTE" (trade name) manufactured by Oji Paper Co., Ltd., "AURORA S" (trade name) manufactured by Nippon Paper Industries Co., Ltd., and the like, light-weight coat papers (A3) such as "OK KOTE L" (trade name) manufactured by Oji Paper Co., Ltd., "AURORA L" (trade name) manufactured by Nippon Paper Industries Co., Ltd., and the like, coat papers (A2, B2) such as "OK TOPKOTE+" (trade name) manufactured by Oji Paper Co., Ltd., "AURORA COAT" (trade name) manufactured by Nippon Paper Industries Co., Ltd., and the like, N Silver Diamonds, art papers (A1) such as "OK GOLDEN CASK+" (trade name) manufactured by Oji Paper Co., Ltd., "TOKUBISHI ART" (trade name) manufactured by Mitsubishi Paper Mills Ltd., and the like. As the recording medium, various ink jet-recording papers exclusively for photos can also be used.

Among the recording media, a so-called coated paper that is used in general off-set printing or the like is preferred. The coated paper is one having a coat layer provided by coating a coat material on the surface of a high-quality paper, a neutral paper, or the like, that is based on cellulose and is not surface-treated. Particularly, it is preferable to use coated paper having base paper and a coated layer including kaolin and/or calcium bicarbonate. These are more preferably art paper, coated paper, light-weight coated paper, or very light-weight coated paper.

(Ink Composition)

The ink composition used in the present embodiment is not limited as long as it contains a coloring material and water, and a known or commercially available one can be used.

(Coloring Material)

As the coloring material, a known dye, a pigment, or the like can be used without particular limitation. Among these, coloring materials that are mostly water-insoluble or poorly water-soluble are preferable from the viewpoints of ink colorability. Specific examples thereof include various pigments, a dispersion dye, oil-soluble dyes, coloring particles forming a J coagulate, and the like, and a pigment is more preferred.

In the present embodiment, a water-insoluble pigment as it is or a pigment which has been surface-treated with a dispersant can be used as a coloring material.

The type of the pigment in the present embodiment is not particularly limited, and any of conventionally known organic pigments and inorganic pigments may be used. Examples of the pigment include polycyclic pigments such as an azo lake, an azo pigment, a phthalocyanine pigment, a perylene pigment, a perynone pigment, an anthraquinone pigment, a quinacridone pigment, a dioxazine pigment, a diketopyrrolopyrrole pigment, a thioindigo pigment, an isoindolinone pigment, a quinophthalone pigment, and the like, dye lakes such as basic dye lakes, acidic dye lakes, and the like, organic pigments such as a nitro pigment, a nitroso pigment, aniline black, a daylight fluorescent pigment, and the like, and inorganic pigments such as titanium oxide, an iron oxide-based pigment, a carbon black-based pigment, and the like. Also, pigments that can be dispersed in an aqueous phase may be used even if they are not described in the Color Index. Further, pigments obtained by subjecting the above-described pigments to surface treatment with a surfactant, a polymer dispersant, or the like, grafted carbon, or the like may be used. Among these pigments, preferable examples include an azo pigment, a phthalocyanine pigment, an anthraquinone pigment, a quinacridone pigment, and a carbon black-based pigment.

Specific examples of the organic pigments that may be used in the present embodiment are described below. The coloring materials below may be used alone or in combination of two or more kinds thereof.

Examples of the organic pigments for orange or yellow include C. I. pigment orange 31, C. I. pigment orange 43, C. I. pigment yellow 12, C. I. pigment yellow 13, C. I. pigment yellow 14, C. I. pigment yellow 15, C. I. pigment yellow 17, C. I. pigment yellow 74, C. I. pigment yellow 93, C. I. pigment yellow 94, C. I. pigment yellow 128, C. I. pigment yellow 138, C. I. pigment yellow 151, C. I. pigment yellow 155, C. I. pigment yellow 180, C. I. pigment yellow 185, and the like.

Examples of the organic pigments for magenta or red include C. I. pigment red 2, C. I. pigment red 3, C. I. pigment red 5, C. I. pigment red 6, C. I. pigment red 7, C. I. pigment red 15, C. I. pigment red 16, C. I. pigment red 48:1, C. I. pigment red 53:1, C. I. pigment red 57:1, C. I. pigment red 122, C. I. pigment red 123, C. I. pigment red 139, C. I. pigment red 144, C. I. pigment red 149, C. I. pigment red 166, C. I. pigment red 177, C. I. pigment red 178, C. I. pigment red 222 C. I. pigment violet 19, and the like.

Examples of the organic pigments for green or cyan include C. I. pigment blue 15, C. I. pigment blue 15:2, C. I. pigment blue 15:3, C. I. pigment blue 15:4, C. I. pigment blue 16, C. I. pigment blue 60, C. I. pigment green 7, aluminum phthalocyanine pigments crosslinked with siloxane as described in U.S. Pat. No. 4,311,775, and the like.

Examples of the organic pigments for black include C. I. pigment black 1, C. I. pigment black 6, C. I. pigment black 7, and the like.

If the coloring material in the present embodiment is a pigment, the pigment may be dispersed in an aqueous solvent by a dispersant. The dispersant may be either a polymer dispersant or a low-molecular-weight surfactant-type dispersant. The polymer dispersant may be either a water-soluble dispersant or a water-insoluble dispersant.

Among the polymer dispersants which may be used in the present embodiment, as the water-soluble dispersant, a hydrophilic polymer compound can be used. Examples of the hydrophilic polymer compound include natural hydrophilic polymer compounds, and examples of the natural hydrophilic polymer include plant polymers such as gum arabic, gum tragacanth, guar gum, gum karaya, locust bean gum, arabinogalactan, pectin, quince seed starch, and the like, sea weed based polymers such as alginic acid, carrageenan, agar, and the like, animal-based polymers such as gelatin, casein, albumin, collagen, and the like, microbial polymers such as xanthan gum, dextran, and the like, and others.

Moreover, examples of hydrophilic polymer compounds obtained by chemically modifying natural raw materials include cellulose-based polymers such as methyl cellulose, ethyl cellulose, hydroxyethyl cellulose, hydroxypropyl cellulose, carboxymethyl cellulose, and the like, starch-based polymers such as sodium starch glycolate, sodium starch ester, and the like, sea weed based polymers such as ester and the like, and others.

In addition, examples of synthetic water-soluble polymer compounds include vinyl-based polymers such as polyvinyl alcohol, polyvinyl pyrrolidone, polyvinyl methyl ether, and the like; acrylic resins such as polyacrylamide, polyacrylic acid or alkali metal salts thereof, water-soluble styrene acrylic resins, and the like, water-soluble styrene maleic acid resins, water-soluble vinylnaphthalene acrylic resins, water-soluble vinylnaphthalene maleic acid resins, polyvinyl pyrrolidone, polyvinyl alcohol, alkali metal salts of formalin condensates of β-naphthalene sulfonic acid, polymer compounds having, at a side chain, a salt of a cationic functional group such as a quaternary ammonium group, an amino group, and the like, and others.

Among the polymer dispersants, as the water-insoluble dispersant, polymers each having both hydrophilic and hydrophobic moieties can be used. Examples thereof include styrene-(meth)acrylic acid copolymers, styrene-(meth) acrylic acid-(meth)acrylic ester copolymers, (meth)acrylic ester-(meth)acrylic acid copolymers, polyethylene glycol (meth)acrylate-(meth)acrylic acid copolymers, styrene-maleic acid copolymers, and the like.

The acid value of the polymer dispersant is preferably 100 mg KOH/g or less. Further, the acid value is more preferably from 25 mg KOH/g to 100 mg KOH/g, and particularly preferably from 30 mg KOH/g to 90 mg KOH/g, from the viewpoints of good coagulation properties when a treatment liquid is in contact therewith.

The average particle diameter of the coloring material is preferably from 10 nm to 200 nm, more preferably from 10 nm to 150 nm, and even more preferably from 10 nm to 100 nm. If the average particle diameter is 200 nm or less, color reproducibility may be excellent and ejection characteristics may be excellent in a case in which droplets are ejected by an ink jet method, whereas if the average particle diameter is 10 nm or more, light-fastness may be excellent. Further, the particle diameter distribution of the coloring material is not particularly limited, and may be either a broad particle diameter distribution or a monodispersed particle diameter distribution. A mixture of two or more coloring materials having monodispersed particle diameter distributions may be used.

From the viewpoints of the image density, the content of the coloring material in the ink is preferably from 1% by mass to 25% by mass, and more preferably from 2% by mass to 10% by mass, based on the ink composition.

(Polymer Particles)

The ink composition in the present embodiment may preferably contain polymer particles if necessary, whereby the abrasion resistance and the like of the image can be further improved.

Examples of the polymer particles in the present embodiment include particles of resins having an anionic group, such as thermoplastic, thermosetting, or modified acrylic, epoxy-based, polyurethane-based, polyether-based, polyamide-based, unsaturated polyester-based, phenolic, silicone-based or fluorine-based resins, polyvinyl-based resins such as vinyl chloride, vinyl acetate, polyvinyl alcohol, polyvinyl butyral, and the like, polyester-based resins such as an alkyd resin, a phthalic acid resin, and the like, amino-based materials such as a melamine resin, a melamine-formaldehyde resin, an aminoalkyd co-condensed resin, an urea resin, and the like, copolymers or mixtures thereof, and the like. Among these, the anionic acrylic resins may be obtained by, for example, polymerizing an acrylic monomer having an anionic group (hereinafter, referred to as an "anionic group-containing acrylic monomer") and optionally, another monomer capable of being copolymerized with the anionic group-containing acrylic monomer, in a solvent. Examples of the anionic group-containing acrylic monomer include acrylic monomers having one or more anionic groups selected from the group consisting of a carboxy group, a sulfonic acid group and a phosphonic acid group, and among them, more preferable examples include acrylic monomers having a carboxy group (for example, acrylic acid, methacrylic acid, crotonic acid, ethacrylic acid, propylacrylic acid, isopropylacrylic acid, itaconic acid, fumaric acid, and the like), and even more preferable examples include acrylic acid and methacrylic acid. One kind of the polymer particles can be used alone or two or more kinds thereof can be used in combination.

The weight average molecular weight of the polymer particles in the present embodiment is preferably in a range of from 3000 to 200,000, and more preferably from 5000 to 150,000. The weight average molecular weight is measured by gel permeation chromatography (in terms of a polystyrene).

The average particle size of the resin particles is, in terms of a volume average particle diameter, preferably in the range of from 10 nm to 400 nm, more preferably in the range of from 10 nm to 200 nm, even more preferably in the range of from 10 nm to 100 nm, and particularly preferably in the range of from 10 nm to 50 nm. In a case in which the volume average particle diameter is within the range, ease of preparation, storage stability, and the like may be improved. The volume average particle diameter of the polymer particles is determined by measuring the volume average particle diameters by means of a dynamic light scattering method, using a NANOTRAC particle size distribution measuring instrument UPA-EX150 (trade name, manufactured by NIKKISO Co., Ltd.).

From the viewpoints of the glossiness and the like of the image, the content of the polymer particles in the ink composition is preferably from 1% by mass to 30% by mass, and more preferably from 2% by mass to 20% by mass, and still more preferably from 3% by mass to 10% by mass based on the ink composition.

(Water)

The ink composition contains water, but the amount of water is not particularly limited. Among these, a preferable content of water is from 10% mass to 99% by mass, more preferably from 30% mass to 80% by mass, and even more preferably from 50% mass to 70% by mass.

(Organic Solvent)

The ink composition may optionally contain a water-soluble organic solvent, in addition to the water above. The water-soluble organic solvent is preferably an alkyleneoxy alcohol from the viewpoints of ejectability, or the ink composition particularly preferably contains two or more water-soluble organic solvents including at least one alkyleneoxy alcohol and at least one alkyleneoxyalkyl ether.

The alkyleneoxy alcohol is preferably propyleneoxy alcohol. Examples of the propyleneoxy alcohol include SANNIX GP250 and SANNIX GP400 (trade name, manufactured by Sanyo Chemical Industries, Ltd.).

Preferable examples of the alkyleneoxyalkyl ether include ethyleneoxyalkyl ethers having an alkyl moiety having 1 to 4 carbon atoms, and propyleneoxy alkyl ethers having an alkyl moiety having 1 to 4 carbon atoms. Examples of the alkyleneoxyalkyl ether include tripropylene glycol monoethyl ether, ethylene glycol monomethyl ether, ethylene glycol monoethyl ether, ethylene glycol monobutyl ether, diethylene glycol monomethyl ether, diethylene glycol monobutyl ether, propylene glycol monomethyl ether, propylene glycol monobutyl ether, dipropylene glycol monomethyl ether, triethylene glycol monomethyl ether, ethylene glycol diacetate, ethylene glycol monomethyl ether acetate, triethylene glycol monomethyl ether, triethylene glycol monoethyl ether, ethylene glycol monophenyl ether, and the like.

The ink composition may optionally contain one or more additional organic solvents, in addition to the above-described water-soluble organic solvent, for the purpose of promoting drying prevention, penetration prevention, viscosity modification, or the like.

(Other Additives)

The ink composition may optionally contain one or more other additives in addition to the above-described components. Examples of other additives include known additives such as a polymerizable compound that is polymerized by an actinic energy beam, a polymerization initiator, an anti-fading agent, an emulsion stabilizer, a penetration preventing agent, an ultraviolet ray absorber, a preservative, an anti-mold agent, a pH adjusting agent, a surface tension adjusting agent, an anti-foaming agent, a viscosity modifier, a wax, a dispersion stabilizer, an anticorrosive agent, a chelating agent, and the like. These various additives may be added directly after preparation of the ink or may be added during preparation of the ink.

<Dispersion Liquid Application Process>

In the dispersion liquid application process in the present embodiment, a dispersion liquid including polymer particles having a volume average particle diameter from 1 um to 30 um and a Tg of 100° C. or higher and a nonvolatile solvent may be applied on the a recording medium, onto which an composition has been applied.

In the dispersion liquid application process in the present embodiment, it is preferable that a dispersion liquid including polymer particles having a volume average particle diameter from 1 μm to 30 μm and a Tg of 100° C. or higher and a nonvolatile solvent is supplied onto a heating roller surface, and the polymer particles are applied onto the recording medium via the heating roller.

The surface temperature (heating temperature) of the heating roller is preferably a temperature which allows the polymer particles in the ink composition to form a film, it is, for example, from about 30° C. to about 120° C., and preferably from about 50° C. to about 90° C. By this, the film strength of the image can be improved.

The method of heating is not particularly limited, but examples thereof include methods of drying in a non-contact mode, such as a method of heating with a heating member such as a nichrome wire heater and the like, a method of supplying warm air or hot air, a method of heating with a halogen lamp, an infrared ray lamp, or the like.

The heating roller may be either a metal roller made of a metal, or a roller having a core metal made of a metal and a coated layer including an elastic member, and optionally, a surface layer (also referred to a release layer) provided at the periphery thereof. The metal roller and the core metal made of a metal can be formed, for example, of a cylindrical member made of iron, aluminum, SUS, or the like. Particularly, the coated layer is formed preferably of a silicone resin or fluorine-containing resin having releasability. The heating roller preferably has a heating member built in the inside of the core metal thereof. When, for example, two rollers are used, one of the two rollers may have a heating member built in the core metal thereof. The recording medium may be heated by applying the heating treatment and the pressing treatment simultaneously by passing the medium between the rollers. Two heating rollers may be used, and the recording medium may be heated by passing the medium between the two heating rollers. As the heating member, for example, a halogen lamp heater, a ceramic heater, a nichrome wire, or the like is preferred.

For application of the polymer particles onto the heating roller, the dispersion liquid including polymer particles having a volume average particle diameter of from 1 μm to 30 μm and a Tg of 100° C. or higher and a nonvolatile solvent may be directly or indirectly adhered. For example, a method in which a fabric material having a resin particle-containing liquid impregnated therein is brought into contact with a heating roller surface, a method in which the liquid is sprayed onto a heating roller surface, or a method in which the liquid is coating with a roll coater, and the like may be used. Particularly, the method in which a fabric material is brought into contact with a heating roller is preferable from the viewpoints of supplying an appropriate amount of a dispersion liquid to a roller surface without causing unevenness. The fabric material (web member) as used herein may be any one of woven fabrics, non-woven fabrics, and the like, and a commercially available or known one may be used. However, the fabric material (web member) having heat resistance is preferable when the heating roller is used and the fabric material is brought into contact with the heating roller. Examples thereof include polyvinylidene chloride, polyethylene, an aramide, a polyester, and the like.

In the dispersion liquid application process in the present embodiment, for example, by pressing a heating roller in which the polymer particles are adhered onto the roller surface on a recording medium (print) on which the image is recorded, the polymer particles can be applied onto the print surface. The pressing method is not limited, but examples thereof include (i) a method in which a pressing roller is also used and a recording medium passes between a pair of these rollers (the heating roller and the pressing roller) such that the recorded image side of the recordium medium is brought into contact with the heating roller surface, (ii) a method in which two pressing rollers are used, and the recording medium passes between a pair of these pressing rollers, (iii) a method in which a printed article (recording medium) carried on a conveying belt passes through such that the recorded image side of the recording medium is brought into contact with the pressing roller surface, (iv) a combination of any of these methods, and the like.

The dispersion liquid application process in the present embodiment may include a fixing process for image recording before and after the heating roller. Generally, in the fixing process, it is necessary to use a fixing roller as a fixing member, but in the present embodiment, the heating roller can serve as a fixing roller besides as a roller for applying the polymer particles, and therefore, the fixing process may be performed without using a separate fixing roller, and it is possible to fix the image recording and apply the polymer particles at the same time, and the dimension of facilities can be further reduced. A method in which a further fixing member such as a separate fixing roller is used as a fixing member is also included in the scope of the present embodiment.

The pressure for pressing is not particularly limited, but the pressure is preferably such a level that the polymer particles are not crushed. The pressure is preferably, for example, in the range of from 0.1 MPa to 3.0 MPa, more preferably in the range of from 0.1 MPa to 1.0 MPa, and even more preferably in the range of from 0.1 MPa to 0.5 MPa.

The pressure (nip pressure) may be attained, for example, by selecting an elastic member such as a spring and the like having tension and disposing the elastic member on both roller ends of rollers such as a heating roller and the like so that a desired nip may be obtained taking the nip gap into consideration.

A preferable nip time during which the recording medium passes through the heating roller is preferably from 1 millisecond to 10 seconds, more preferably from 2 milliseconds to 1 second, and even preferably from 4 milliseconds to 100 milliseconds. Further, a preferable nip width is from 0.1 mm to 100 mm, more preferably from 0.5 mm to 50 mm, and even preferably from 1 mm to 10 mm.

As the belt substrate for conveying the recording medium, which is not limited, for example, a seamless electrocast nickel substrate is preferred. The thickness of the substrate is preferably from 10 μm to 100 μm. For the material of the belt substrate, aluminum, iron, polyethylene, or the like can be used, as well as nickel. When disposing a silicone resin or a fluorine-containing resin, the thickness of the layer formed by using such a resin is preferably from 1 μm to 50 μm, and more preferably from 10 μm to 30 μm.

The conveying speed of the recording medium is preferably in the range of from 200 mm/sec to 700 mm/sec, more preferably from 300 mm/sec to 650 mm/sec, and even preferably from 400 mm/sec to 600 mm/sec.

The amount of the polymer particles to be applied onto the recording medium is not limited, and the amount of polymer particles to be applied onto the recording medium may be, for example, such an amount that the amount of the dispersion liquid is from 1 $mg/m^2$ to 100 $mg/m^2$, and the amount of polymer particles to be applied on the recording medium is preferably from 5 $mg/m^2$ to 75 $mg/m^2$, and more preferably from 10 $g/m^2$ to 50 $g/m^2$. The amount can be adjusted appropriately with a supply amount onto the heating roller, the concentration of the polymer particle dispersion liquid, or the like.

Moreover, in the method using a fabric material impregnated with the dispersion liquid, the amount can be adjusted with the impregnation amount into the fabric material, the delivery amount of the fabric material, and the like.

In the image forming process of the present embodiment, a device such as an ink drying zone can be included, and a drying process can be performed between the ink application process and the dispersion application process, or after the dispersion application process.

One example of the dispersion liquid application process of the first embodiment is illustrated with reference to FIG. 1. By a web pressing roller 3, a fabric material 5 having the dispersion liquid impregnated therein is pressed against a heating roller (fixing roller) 1. The fabric material 5 is wound up by rotation of a delivery roller 2 and a winding roller 4 to be brought into contact with the heating roller 1, thereby continuously supplying the dispersion liquid to the heating roller surface.

One preferable example of the image forming process of the present embodiment is further illustrated with respect to FIG. 2. When the recording medium 11 has been conveyed by the conveying belt 10 or the like in the device, ink is ejected from the nozzle 17 of the ink jet recording device towards the recording medium, whereby a recorded image is formed on the recording medium. The recording medium (printed article) on which the image is recorded is further conveyed, and then passes between the heating roller 1 and the pressing roller 6. By this passage, the image formed on the recording medium is fixed while the polymer particles adhered onto the heating roller surface are transferred to the surface of the recording medium (printed article). Thereafter, the recording medium may be optionally cut to a predetermined size, and the recording medium is discharged from a discharge port to allow the printed article to be stacked on a discharge tray (not shown). Further, in FIG. 2, the treatment liquid-coating section 12 is provided to carry out a treatment liquid application process (as described later) on the recording medium surface, and the heating-drying sections 14 are provided after the treatment liquid-applied coating section 12 and after the ink jet recording section 16 respectively, to carry out the drying process. In FIG. 2, 13 denotes a bar for applying the treatment liquid and 15 denotes a heater <Treatment liquid Application Process>

The image forming method of the present embodiment may include applying a treatment liquid which is capable of forming aggregates by being brought into contact with the ink composition on a recording medium (treatment liquid application process).

Application of the treatment liquid can be carried out using a known method such as a coating method, an ink jet method, an immersion method, and the like. The coating method may be a known coating method using an extrusion die coater, an air doctor coater, a blade coater, a rod coater, a knife coater, a squeeze coater, a reverse roll coater, a bar coater, or the like. Details of the ink jet method are as described above.

The treatment liquid application process may be carried out before or after the ink application process using the ink composition.

In the present embodiment, an embodiment in which the ink application process is provided after the treatment liquid is applied in the treatment liquid application process is preferable. That is, a method in which the treatment liquid for aggregating the coloring material (preferably a pigment) in the ink composition is applied on the recording medium prior to applying the ink composition, and the ink composition is applied so as to come into contact with the treatment liquid provided on the recording medium, whereby an image is formed, is preferable. As a result, ink jet recording can be performed at a higher speed, and an image having a high density and a high resolution may be obtained even when recording is performed at a high speed.

The amount of the treatment liquid to be applied is not particularly limited as long as it is possible to form aggregates with the ink composition, and is preferably 0.1 $g/m^2$ or more in terms of the amount of the aggregating component (for example, a divalent or higher carboxylic acid or a cationic organic compound) to be applied. The amount of the aggregating component to be applied is preferably from 0.1 $g/m^2$ to 1.0 $g/m^2$, and more preferably from 0.2 $g/m^2$ to 0.8 $g/m^2$. In a case in which the amount of the aggregating component to be applied is 0.1 $g/m^2$ or more, the coagulation reaction proceeds properly, and the amount of the aggregating component to be applied of 1.0 $g/m^2$ or less is preferable in view of the degree of glossiness.

—Treatment Liquid—

The treatment liquid in the present embodiment is configured to be capable of forming aggregates by being brought into contact with the above-described ink composition. Specifically, the treatment liquid preferably includes at least an aggregation component which is capable of forming aggregates by aggregating dispersed particles such as the coloring material particles (for example, a pigment), and the like in the ink composition, and may include optionally one or more other components. By using the treatment liquid together with the ink composition, the speed of ink jet recording can be increased, and an image having an excellent drawing property (for example, reproducibility of fine lines and fine parts) with a high density and a high resolution, even when high-speed recording is carried out, can be obtained.

The treatment liquid can contain at least one aggregating component which is capable of forming aggregates by being brought into contact with the ink composition. By mixing the treatment liquid with the ink composition ejected by the ink jet method, coagulation of the pigments and the like that are dispersed stably in the ink composition is promoted.

Examples of the treatment liquid include liquids that are capable of forming coagulates by changing the pH of the ink composition. Here, the pH (25° C.) of the treatment liquid is preferably from 1 to 6, more preferably from 1.2 to 5, and even more preferably from 1.5 to 4, from the viewpoints of the aggregation speed of the ink composition. In this case, the pH (25° C.) of the ink composition used in the ejecting process is preferably from 7.5 to 9.5 (more preferably from 8.0 to 9.0).

Among these, in the present embodiment, from the viewpoints of the image density, resolution, and a higher recording speed of ink jet recording, the pH (25° C.) of the ink composition is 7.5 or more, and the pH (25° C.) of the treatment liquid is preferably 1.5 to 3.

The aggregating components may be used alone or as a mixture of two or more kinds thereof.

The treatment liquid may include at least one acidic compound as an aggregating component. As the acidic compound, a compound having a phosphoric acid group, a phosphonic acid group, a phosphinic acid group, a sulfuric acid group, a sulfonic acid group, a sulfinic acid, or a carboxy group, or a salt thereof (for example, a polyhydric metal salt) can be used. Among these, from the viewpoints of the aggregation speed of the ink composition, a compound having a phosphoric acid group or a carboxy group is more preferred, and a compound having a carboxy group is even more preferred.

The compound having a carboxy group is preferable selected from polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furancarboxylic acid, pyridinecarboxylic acid, coumaric acid, thiophene carboxylic acid, nicotinic acid, derivatives of the compounds, salts thereof (for example, polyvalent metal salts), and the like. These compounds may be used alone or in combination of two or more kinds thereof.

The treatment liquid in the present embodiment may include an aqueous solvent (for example, water), in addition to the acidic compound and the like.

The content of the acidic compound in the treatment liquid is preferably from 5% by mass to 95% by mass, more preferably from 10% by mass to 80% by mass, and even more preferably from 15% by mass to 50% by mass, with respect to the total mass of the treatment liquid, from the viewpoints of the coagulation effect.

The treatment liquid may be, for example, a treatment liquid including a polyvalent metal salt. When the treatment liquid including a polyvalent metal salt is used, high-speed aggregation properties can be improved. Examples of the polyvalent metal salt include salts of alkaline earth metals belonging to Group II of the periodic table (for example, magnesium and calcium), transition metals belonging to Group III of the periodic table (for example, lanthanum), cations from Group XIII of the periodic table (for example, aluminum), and lanthanides (for example, neodymium). As salts of the metals, carboxylic acid salts (formates, acetates, benzoates, and the like), nitrates, chlorides, and thiocyanates are preferable. Among these, calcium salts or magnesium salts of carboxylic acids (for example, formates, acetates, benzoates, and the like), calcium salts or magnesium salts of nitric acid, calcium chloride, magnesium chloride, and calcium salts or magnesium salts of thiocyanic acid are more preferable.

The content of the metal salt in the treatment liquid is preferably in the range of from 1% by mass to 10% by mass, more preferably 1.5% by mass to 7% by mass, and even more preferably 2% by mass to 6% by mass, from the viewpoints of the coagulation effect.

The treatment liquid may include at least one cationic organic compound as an aggregating component. Examples of the cationic organic compound include cationic polymers such as a poly(vinylpyridine) salt, a polyalkylaminoethyl acrylate, polyalkylaminoethyl methacrylate, a poly(vinylimidazole), a polyethyleneimine, a polybiguanide, a polyguanide, or a polyallylamine and a derivative thereof, and the like.

The weight average molecular weight of the cationic polymer is preferably small in terms of the viscosity of the treatment liquid. In a case in which the treatment liquid is applied onto a recording medium by an ink jet method, the weight average molecular weight is preferably in the range of from 1,000 to 500,000, more preferably from 1,500 to 200,000 and even more preferably from 2,000 to 100,000. A weight average molecular weight of 1000 or more is advantageous from the viewpoints of the aggregation speed and a weight average molecular weight of 500,000 or less is advantageous from the viewpoints of ejecting reliability. However, this does not apply in a case in which the treatment liquid is applied onto a recording medium by a method other than ink jet.

Preferable examples of the cationic organic compound include compounds of primary, secondary or tertiary amine salt type. Examples of amine salt type compounds include cationic compounds including compounds such as hydrochlorides or acetates (for example, laurylamine, palmitylamine, stearylamine, rosin amine, and the like), quaternary ammonium salt type compounds (for example, lauryltrimethylammonium chloride, cetyltrimethylammonium chloride, lauryldimethylbenzylammonium chloride, benzyltributylammonium chloride, benzalkonium chloride, and the like), pyridinium salt type compounds (for example, cetylpyridinium chloride, cetylpyridinium bromide, and the like), imidazoline type cationic compounds (for example, 2-heptadecenylhydroxyethylimidazoline and the like), ethylene oxide adducts of higher alkylamines (for example, dihydroxyethylstearylamine and the like), and the like, and amphoteric surfactants exhibiting cationic properties in a desired pH region, including amphoteric surfactants such as amino acid type amphoteric surfactants, carboxylate type amphoteric surfactants (for example, stearyldimethylbetaine, lauryldihydroxyethylbetaine, and the like), amphoteric surfactants of sulfuric acid ester type, sulfonic acid type or phosphoric acid ester type, and the like.

Among these, a divalent or higher cationic organic compound is preferable.

The content of the cationic organic compound in the treatment liquid is preferably from 1% by mass to 50% by mass, and more preferably from 2% by mass to 30% by mass, from the viewpoints of a aggregation effect.

Among these, as the aggregating component, a divalent or higher carboxylic acid or a divalent or higher cationic organic compound is preferable in view of aggregation properties and abrasion resistance of the image.

The viscosity of the treatment liquid is preferably in the range of from 1 mPa·s to 30 mPa·s, more preferably from 1 mPa·s to 20 mPa·s, even more preferably from 2 mPa·s to 15 mPa·s, and particularly preferably from 2 mPa·s to 10 mPa·s, from the viewpoints of the aggregation speed of the ink composition.

The viscosity is measured under the condition of a temperature of 20° C. using VISCOMETER TV-22 (trade name, manufactured by Toki Sangyo Co., Ltd.).

The surface tension of the treatment liquid is preferably from 20 mN/m to 60 mN/m, more preferably from 20 mN/m to 45 mN/m, and even more preferably from 25 mN/m to 40 mN/m, from the viewpoints of the aggregation speed of the ink composition.

The surface tension is measured under the condition of a temperature of 25° C. using an automatic surface tensiometer CBVP-Z (trade name, manufactured by Kyowa Interface Science Co., Ltd.).

In general, the treatment liquid in the present embodiment may contain a water-soluble organic solvent in addition to the aggregating components.

Within a range not interfering with the effect of the present embodiment, one or more other additives may also be used in the treatment liquid.

Details of the water-soluble organic solvent are the same as those in the above-described ink composition.

Examples of other additives above include those known additives such as a drying preventing agent (a moisturizing agent), an anti-fading agent, an emulsion stabilizer, a penetration enhancement agent, an ultraviolet ray absorber, a preservative, an anti-mold agent, a pH adjusting agent, a surface tension adjusting agent, an antifoaming agent, a viscosity modifier, a dispersant, a dispersion stabilizer, an anti-rusting agent, a chelating agent, and the like, and those mentioned as specific examples of other additives included in the above-described ink composition can be employed here.

III. Third Image Forming Method

The third image forming method is described. Hereinafter, in this section of "III. Third Image Forming Method", the third image forming method may be simply referred to as "the present embodiment".

Hereinbelow, the third image forming method (may also be referred to as the ink jet image forming method) is described in detail.

<Ink Jet Image Forming Method>

The third image forming method includes applying an ink composition onto a recording medium by an ink jet method (first process), and applying a particle-containing liquid including particles and a nonvolatile solvent onto the recording medium (second process), wherein the volume average particle diameter of the particles is twice or larger the maximum thickness of a dried film of the ink composition applied onto the recording medium. Hereinbelow, each process is described in detail.

<First Process>

The first process in the present embodiment is described below. In the present embodiment, the first process is not limited as long as it includes applying an ink composition onto a recording medium by an ink jet method.

(Ink Composition)

Any ink composition including a coloring material and water may be used as the ink composition without particular limitation. A known or commercially available ink composition may be used.

(Coloring Material)

As the coloring material, a known dye, a pigment, or the like can be used without particular limitation. Among these, coloring materials that are practically insoluble or poorly soluble in water are preferable from the viewpoints of ink colorability. Specific examples thereof include various pigments, dispersion dyes, oil-soluble dyes, coloring matters forming a J aggregate, and the like, and a pigment is more preferred. In the present embodiment, a water-insoluble pigment as it is or a pigment which has been surface-treated with a dispersant can be used as a coloring material.

The type of the pigment in the present embodiment is not particularly limited, and any of conventionally known organic pigments and inorganic pigments may be used. Examples of the pigment include polycyclic pigments such as an azo lake, an azo pigment, a phthalocyanine pigment, a perylene pigment, a perynone pigment, an anthraquinone pigment, a quinacridone pigment, a dioxazine pigment, a diketopyrrolopyrrole pigment, a thioindigo pigment, an isoindolinone pigment, a quinophthalone pigment, and the like, dye lakes such as basic dye lakes, acidic dye lakes, and the like, organic pigments such as a nitro pigment, a nitroso pigment, aniline black, a daylight fluorescent pigment, and the like, and inorganic pigments such as titanium oxide, an iron oxide-based pigment, a carbon black-based pigment, and the like. Also, pigments that can be dispersed in an aqueous phase may be used even if they are not described in the Color Index. Further, pigments obtained by subjecting the above-described pigments to surface treatment with a surfactant, a polymer dispersant, or the like, grafted carbon, or the like may be used. Among these pigments, preferable examples include an azo pigment, a phthalocyanine pigment, an anthraquinone pigment, a quinacridone pigment, and a carbon black-based pigment.

Specific examples of the organic pigments that are used in the present embodiment are described below. The coloring materials below may be used alone or in combination of two or more kinds thereof.

Examples of the organic pigments for orange or yellow include C. I. pigment orange 31, C. I. pigment orange 43, C. I. pigment yellow 12, C. I. pigment yellow 13, C. I. pigment yellow 14, C. I. pigment yellow 15, C. I. pigment yellow 17, C. I. pigment yellow 74, C. I. pigment yellow 93, C. I. pigment yellow 94, C. I. pigment yellow 128, C. I. pigment yellow 138, C. I. pigment yellow 151, C. I. pigment yellow 155, C. I. pigment yellow 180, C. I. pigment yellow 185, and the like.

Examples of the organic pigments for magenta or red include C. I. pigment red 2, C. I. pigment red 3, C. I. pigment red 5, C. I. pigment red 6, C. I. pigment red 7, C. I. pigment red 15, C. I. pigment red 16, C. I. pigment red 48:1, C. I. pigment red 53:1, C. I. pigment red 57:1, C. I. pigment red 122, C. I. pigment red 123, C. I. pigment red 139, C. I. pigment red 144, C. I. pigment red 149, C. I. pigment red 166, C. I. pigment red 177, C. I. pigment red 178, C. I. pigment red 222, C. I. pigment violet 19, and the like.

Examples of the organic pigments for green or cyan include C. I. pigment blue 15, C. I. pigment blue 15:2, C. I. pigment blue 15:3, C. I. pigment blue 15:4, C. I. pigment blue 16, C. I. pigment blue 60, C. I. pigment green 7, phthalocyanine pigments crosslinked with siloxane as described in U.S. Pat. No. 4,311,775, and the like.

Examples of the organic pigments for black include C. I. pigment black 1, C. I. pigment black 6, C. I. pigment black 7, and the like.

(Dispersant)

If the coloring material in the present embodiment is a pigment, the pigment may be dispersed in an aqueous solvent by a dispersant. The dispersant may be either a polymer dispersant or a low-molecular-weight surfactant-type dispersant. The polymer dispersant may be either a water-soluble dispersant or a water-insoluble dispersant.

Among the polymer dispersants which may be used in the present embodiment, as the water-soluble dispersant, a hydrophilic polymer compound can be used. Examples of the hydrophilic polymer compound include natural hydrophilic polymer compounds, and examples the natural hydrophilic polymer compound include plant polymers such as gum arabic, gum tragacanth, guar gum, gum karaya, locust bean gum, arabinogalactan, pectin, quince seed starch, and the like, sea weed based polymers such as alginic acid, carrageenan, agar, and the like, animal-based polymers such as gelatin, casein, albumin, collagen, and the like, microbial polymers such as xanthan gum, dextran, and the like, and others.

Moreover, examples of hydrophilic polymer compounds obtained by chemically modifying natural raw material include cellulose-based polymers such as methyl cellulose, ethyl cellulose, hydroxyethyl cellulose, hydroxypropyl cellulose, carboxymethyl cellulose, and the like, starch-based polymers such as sodium starch glycolate, sodium starch phosphate ester, and the like, sea weed based polymers such as propylene glycol alginate ester and the like, and others.

In addition, examples of synthetic water-soluble polymer compounds include vinyl-based polymers such as polyvinyl alcohol, polyvinyl pyrrolidone, polyvinyl methyl ether, and the like; acrylic-based resins such as polyacrylamide, polyacrylic acid and alkali metal salts thereof, water-soluble styrene acrylic resins, and the like, water-soluble styrene maleic acid resins, water-soluble vinylnaphthalene acrylic resins, water-soluble vinylnaphthalene maleic acid resins, polyvinyl pyrrolidone, polyvinyl alcohol, alkali metal salts of formalin condensates of a β-naphthalene sulfonic acid, polymer compounds having, at a side chain, a salt of a cationic functional group such as a quaternary ammonium group, an amino group, and the like, and others.

Among the polymer dispersants, as the water-insoluble dispersant, polymers each having both hydrophilic and hydrophobic moieties can be used. Examples thereof include styrene-(meth)acrylic acid copolymers, styrene-(meth) acrylic acid-(meth)acrylic ester copolymers, (meth)acrylic ester-(meth)acrylic acid copolymers, polyethylene glycol (meth)acrylate-(meth)acrylic acid copolymers, styrene-maleic acid copolymers, and the like.

The acid value of the polymer dispersant is preferably 100 mg KOH/g or less, from the viewpoints of good aggregation properties when a treatment liquid is in contact therewith. Further, the acid value is more preferably from 25 mg KOH/g to 100 mg KOH/g, and particularly preferably from 30 mg KOH/g to 90 mg KOH/g.

The average particle diameter of the coloring material is preferably from 10 nm to 200 nm, more preferably from 10 nm to 150 nm, and even more preferably from 10 nm to 100 nm. If the average particle diameter is 200 nm or less, color reproducibility may be excellent and ejection characteristics may be excellent in a case in which droplets are ejected by an ink jet method, whereas if the average particle diameter is 10 nm or more, light-fastness may be excellent. Further, the particle diameter distribution of the coloring material is not particularly limited, and may be either a broad particle diameter distribution or a monodispersed particle diameter distribution. Further, a mixture of two or more coloring materials having monodispersed particle diameter distributions may be used.

From the viewpoints of the image density, the content of the coloring material in the ink composition is preferably from 1% by mass to 25% by mass, and more preferably from 2% by mass to 20% by mass, based on the ink composition.

(Polymer Particles)

It is preferable that the ink composition of the present embodiment optionally contain polymer particles. This makes it possible to further improve the abrasion resistance, the fixing property, and the like of the image.

Examples of the polymer particles in the present embodiment include particles of resins having an anionic group, such as thermoplastic, thermosetting, or modified acrylic, epoxy-based, polyurethane-based, polyether-based, polyamide-based, unsaturated polyester-based, phenolic-based, silicone-based or fluorine-based resins, polyvinyl-based resins such as vinyl chloride, vinyl acetate, polyvinyl alcohol, polyvinyl butyral, and the like, polyester-based resins such as an alkyd resin, a phthalic acid resin, and the like, amino-based materials such as a melamine resin, a melamine-formaldehyde resin, an aminoalkyd co-condensed resin, an urea resin, and the like, copolymers or mixtures thereof, and the like. Among these, the anionic acrylic resins may be obtained by, for example, polymerizing an acrylic monomer having an anionic group (hereinafter, referred to as an "anionic group-containing acrylic monomer") and optionally, another monomer capable of being copolymerized with the anionic group-containing acrylic monomer, in a solvent. Examples of the anionic group-containing acrylic monomer include acrylic monomers having one or more anionic groups selected from the group consisting of a carboxy group, a sulfonic acid group and a phosphonic acid group, and among them, acrylic monomers having a carboxy group (for example, acrylic acid, methacrylic acid, crotonic acid, ethacrylic acid, propylacrylic acid, isopropylacrylic acid, itaconic acid, fumaric acid, and the like) are preferred, and acrylic acid or methacrylic acid is particularly preferred. One kind of the polymer particles can be used singly or two or more kinds thereof may be used in combination.

The weight average molecular weight of the polymer particles in the present embodiment is preferably from 3000 to 200,000, more preferably from 5000 to 150,000, and even preferably from 10,000 to 100,000. The weight average molecular weight is measured by gel permeation chromatography (in terms of polystyrene).

The volume average particle diameter of the polymer particles dispersed is preferably in the range of from 10 nm to 400 nm, more preferably in the range of from 10 nm to 200 nm, even more preferably in the range of from 10 nm to 100 nm, and particularly preferably in the range of from 10 nm to 50 nm. When the particle diameter is in this range, the preparation suitability, the storage stability, and the like may be improved. The volume average particle diameter of the polymer particles is determined by measuring a volume average particle diameter by means of a dynamic light scattering method, using a NANOTRAC particle size distribution measuring instrument UPA-EX150 (trade name, manufactured by NIKKISO Co., Ltd.).

The content of the polymer particles in the liquid composition is preferably from 1% by mass to 30% by mass, and more preferably from 3% by mass to 20% by mass, with respect to the mass of the ink composition, from the viewpoints of the glossiness and the like of the image.

(Water)

The ink composition contains water, but the amount of water is not particularly limited. A preferable content of water is from 10% by mass to 99% by mass, more preferably from 30% by mass to 80% by mass, and even more preferably from 50% by mass to 70% by mass.

(Water-Soluble Organic Solvent)

The ink composition of the present embodiment may optionally contain a water-soluble organic solvent, in addition to the water above. The water-soluble organic solvent is preferably an alkyleneoxy alcohol from the viewpoints of ejectability. The ink composition particularly preferably contains two or more water-soluble organic solvents including at least one alkyleneoxy alcohol and at least one alkyleneoxyalkyl ether.

The alkyleneoxy alcohol is preferably propyleneoxy alcohol. Examples of the propyleneoxy alcohol include SANNIX GP250 and SANNIX GP400 (trade names, manufactured by Sanyo Chemical Industries, Ltd.).

Preferable examples of alkyleneoxyalkyl ether include ethyleneoxyalkyl ether having an alkyl moiety having from 1 to 4 carbon atoms, and propyleneoxy alkyl ether having an alkyl moiety having from 1 to 4 carbon atoms. Examples of alkyleneoxyalkyl ether include tripropylene glycol monomethyl ether, ethylene glycol monomethyl ether, ethylene glycol monoethyl ether, ethylene glycol monobutyl ether, diethylene glycol monomethyl ether, diethylene glycol monobutyl ether, propylene glycol monomethyl ether, propylene glycol monobutyl ether, dipropylene glycol monomethyl ether, triethylene glycol monomethyl ether, ethylene glycol diacetate, ethylene glycol monomethyl ether acetate, triethylene glycol monomethyl ether, triethylene glycol monoethyl ether, ethylene glycol monophenyl ether, and the like.

The ink composition may optionally contain one or more other organic solvents, in addition to the above-described water-soluble organic solvent, for the purpose of promoting drying prevention, penetration enhancement, viscosity modification, or the like.

(Other Additives)

The ink may optionally contain one or more other additives in addition to the above-described components. Examples of other additives include known additives such as a polymerizable compound that is polymerized by an active energy beam, a polymerization initiator, an anti-fading agent, an emulsion stabilizer, a penetration enhancement agent, an ultraviolet ray absorber, a preservative, an anti-mold agent, a pH adjusting agent, a surface tension adjusting agent, an anti-foaming agent, a viscosity modifier, a wax, a dispersion stabilizer, an anticorrosive agent, a chelating agent, and the like. These various additives may be added directly after preparation of the ink or may be added during preparation of the ink.

(Ink Jet Method)

The ink jet method in the present embodiment is not particularly limited and may be any known method such as a charge-control method in which ink is ejected by electrostatic attraction force, a drop-on-demand method (pressure-pulse method) in which a pressure of oscillation of a piezo element is utilized, an acoustic ink jet method in which ink is ejected by radiation pressure generated by irradiation of ink with acoustic beams that have been converted from electric signals, a thermal ink jet method in which ink is ejected by a pressure generated by formation of bubbles caused by heating of ink (BUBBLEJET (registered trademark) system), and the like. Further, examples of the ink jet method include a method in which a large number of small-volume droplets of an ink having a low optical density, which is called a photo ink, are ejected, a method in which inks of substantially the same color hue at different concentrations are used to improve the image quality, and a method in which a clear and colorless ink is used.

The ink jet head used in an ink jet method may be either an on-demand type head or a continuous type head. Further, specific examples of the ejecting systems include electromechanical transduction systems (for example, a single-cavity system, a double-cavity system, a vendor system, a piston system, a share-mode system, a shared-wall system, and the like), electrothermal transduction systems (for example, a thermal ink jet system, a BUBBLEJET (registered trademark) system, and the like), electrostatic suction systems (for example, an electric-field-control system, a slit-jet system, and the like), discharge systems (for example, a spark-jet system and the like), and the like, and any of these ejecting systems is applicable.

The ink nozzles and the like used for carrying out the ink jet recording by the ink jet method are not particularly limited, and may be selected as appropriate according to purposes.

Regarding the ink jet head, there are a shuttle system in which recording is carried out while a short serial head is used, and the head is moved in the width direction of a recording medium in a scanning manner, and a line system in which a line head having recording devices that are aligned correspondingly to the entire length of one side of a recording medium is used. In the line system, image recording can be carried out over the whole of one surface of a recording medium by scanning the recording medium in a direction perpendicular to the direction along which the recording devices are aligned, and a carrying system, such as carriage which moves the short head in a scanning manner, and the like is unnecessary. Further, since a complicated scan-movement control of the movement of the carriage and the recording medium is unnecessary and only the recording medium is moved, the recording speed can be increased compared to the shuttle system. The ink jet recording method of the present embodiment can be applied to both of these systems, but effects in improving the ejecting accuracy and abrasion resistance of an image are larger in a case in which the ink jet recording method of the present invention is applied to a line system, in which dummy ejecting is not generally performed.

The amount of the ink droplets ejected from an ink jet head is preferably 0.5 μl (picoliters) to 15 μl, more preferably from 1 μl to 12 μl, and even more preferably 2 μl to 10 μl, from the viewpoints of obtaining a high-precision image.

(Recording Medium)

In the ink jet image forming method of the present embodiment, images are recorded on a recording medium.

The recording medium is not particularly limited, but a cellulose-based general printing paper, such as high-quality paper, coat paper, or art paper, which is used for general offset printing and the like, can be used.

As the recording medium, a commercially available product can be used, and examples thereof include high-quality papers (A) such as "OK PRINCE HIGH-QUALITY" (trade name) manufactured by Oji Paper Co., Ltd., SHIRAOI (trade name) manufactured by Nippon Paper Industries Co., Ltd., "NEW NPI HIGH-QUALITY" (trade name) manufactured by Nippon Paper Industries Co., Ltd., and the like, fine coated papers such as "OK EVER LIGHT KOTE" (trade name) manufactured by Oji Paper Co., Ltd., "AURORA S" (trade name) manufactured by Nippon Paper Industries Co., Ltd., and the like, light-weight coat papers (A3) such as "OK KOTE L" (trade name) manufactured by Oji Paper Co., Ltd., "AURORA L" (trade name) manufactured by Nippon Paper Industries Co., Ltd., and the like, coat papers (A2, B2) such as "OK TOPKOTE+" (trade name) manufactured by Oji Paper Co., Ltd., "AURORA KOTE" (trade name) manufactured by Nippon Paper Industries Co., Ltd., and the like, art papers (A1) such as "OK GOLDEN CASK+" (trade name) manufactured by Oji Paper Co., Ltd., "TOKUBISHI ART" (trade name) manufactured by Mitsubishi Paper Mills Ltd., and the like. Also, matte paper such as "SILVER DIAMOND" (trade name) manufactured by Nippon Paper Industries Co., Ltd., can be used. As the recording medium, various ink jet-recording papers exclusively for photos can also be used.

Among the recording media, a so-called coated paper that is used in general off-set printing or the like is preferred. The coated paper is one having a coat layer provided by coating a coat material on the surface of a high-quality paper, a neutral paper, or the like, that is based on cellulose and is not surface-treated. Particularly, it is preferable to use coated paper having base paper and a coated layer including kaolin and/or calcium bicarbonate. The coated paper is more preferably art paper, coated paper, light-weight coated paper, or very light-weight coated paper.

<Second Process>

A second process in the present embodiment is a process in which a particle-containing liquid containing particles and a nonvolatile solvent is applied on a recording medium, and a volume average particle diameter of the particles is twice or larger the maximum thickness of dried film of the ink composition applied on the recording medium. In the present embodiment, it is preferable to apply the particle-containing liquid on the ink composition applied on the recording medium.

In the present embodiment, by using the particle-containing liquid including the particles having the volume average particle diameter of twice or more the maximum thickness of the dried film of the ink composition applied on the recording medium, it is possible to suppress clogging in nozzle tips and also improve fixing offset resistance.

The reason why the clogging in the nozzle tips of the ink jet is suppressed and the fixing offset resistance is also improved by the method in the present embodiment is not clear, but the present inventors estimate as follows. In the present embodiment, it is thought that scattering of particles may be suppressed by using the particle-containing liquid having a specific configuration, and, as a result, the nozzle tips of the inkjet were suppressed from being blocked. It is also thought that by using the particles having the volume average particle diameter of twice or larger the maximum thickness of the dried film of the ink composition applied on the recording medium, the situation in which a fixing member and the recording medium have excessive contact with each other in the fixing process can be suppressed, and thus a problem (fixing offset) in that the ink composition is transferred to the fixing member can be improved.

(Particle-Containing Liquid)

The particle-containing liquid in the present embodiment is not limited as long as it contains particles and a nonvolatile solvent. The particle-containing liquid may optionally contain one or more other components. The particle-containing liquid can be obtained by adding particles to a nonvolatile solvent and is preferably prepared by stirring and mixing. In the particle-containing liquid in the present embodiment, it is preferable that the particles are dispersed in the nonvolatile solvent.

From the viewpoints of a handling property of the particle-containing liquid, the content of the nonvolatile solvent in the particle-containing liquid in the present embodiment is preferably from 100 parts by mass to 5000 parts by mass, more preferably from 200 parts by mass to 2000 parts by mass, and still more preferably from 300 parts by mass to 1000 parts by mass, with respect to 100 parts by mass of the particles.

The content of the particles contained in the particle-containing liquid is preferably from 2% by mass to 50% by mass, and more preferably from 5% by mass to 30% by mass, based on the total mass of the particle-containing liquid. The content of the nonvolatile solvent contained in the particle-containing liquid is preferably from 50% by mass to 98% by mass, and more preferably from 70% by mass to 95% by mass, based on the total mass of the particle-containing liquid. With these concentrations, a particle surface is entirely surrounded by the nonvolatile solvent and, therefore, the particle-containing liquid may be relatively easily applied to a fixing roller.

(Particles)

The particles used in the second process is not limited as long as they have a volume average particle diameter which is twice or larger the maximum thickness of the dried film of the ink composition applied on the recording medium in the first process. It is possible to use particles having the volume average particle diameter which is twice or larger the maximum thickness of the dried film of the ink composition applied on the recording medium in the second process in the present embodiment, by, after the ink composition is applied on the recording medium in the first process, measuring the maximum thickness of the dried film thickness of the ink composition.

The maximum thickness of the dried film of the ink composition applied on the recording medium is a thickness of the ink composition applied in the first process and then dried. The maximum thickness of the dried film of the ink composition is measured as follows. The recording medium on which an ink composition is applied is cut such that the region in which the amount of applied ink is largest is cut in a direction perpendicular to the recording medium surface, and the cross-section thereof is observed using an electron microscope. The maximum value of the thickness measured by the observation is the maximum thickness of the dried film of the ink composition.

The volume average particle diameter of the particles is a value measured by a NANOTRAC particle size distribution measuring instrument UPA-EX150 (trade name, manufactured by NIKKISO Co., Ltd.) using a dynamic light scattering method. The measurement can be carried out using a sample liquid for measurement prepared by adding 10 mL of ion-exchange water to 100 μl of ion-exchange water containing particles of 20% by mass, and adjusting the temperature thereof to 25° C.

The volume average particle diameter of the particles is preferably from two times to six times the maximum thickness of the dried film of the ink composition applied on the recording medium, and more preferably from two and a half times to five times of the dried film thickness of the ink composition applied on the recording medium. If the volume average particle diameter of the particles is two times or more the maximum film thickness of the ink composition applied on the recording medium, it is possible to improve the fixing offset resistance. Further, it is possible to prevent contact between the ink compositions and to improve a blocking inhibition. If the volume average particle diameter of the particle is six times or less the maximum film thickness of the ink composition, it is preferable because, as well as the improvement in the fixing offset, it is possible to suppress removal of particles which occurs in a case in which other components come into contact with a surface of an image which has been formed and to prevent the image from being scratched due to the removed particles. In addition, if the volume average particle diameter of the particles is six times or less the maximum film thickness of the ink composition, it is preferable because it is possible to prevent the surface of the image from being rough.

The volume average particle diameter in the particle-containing liquid in the present embodiment is two times or larger the maximum thickness of the dried film of the ink composition applied on the recording medium, but, from the viewpoints of the prevention of adhesion due to contact between a surfaces on which images are formed or the prevention of scratch in each surface, is preferably from 4 μm to 15 μm, and more preferably from 6 μm to 12 μm.

The amount of particles (number of particles) to be applied is preferably from $1/mm^2$ to $10/mm^2$, and more preferably from $2/mm^2$ to $5/mm^2$, for improvement of the fixing offset resistance.

The particles used in the present embodiment are preferably either poorly soluble in water or insoluble in water, and more preferably insoluble in water. When particles that are poorly soluble or insoluble in water, preferably insoluble in water, are used as the particles, it is possible to suppress the lowering of the fixing offset resistance, unevenness of an image surface, or the like which is generated by particles being dissolved or penetrated into the image which has been formed in the first process of the present embodiment. In the present embodiment, to be water-insoluble means that the dissolution amount is 1 parts by mass or less with respect to 100 parts by mass (25° C.) of water.

Examples of the particles in the present embodiment include inorganic particles and organic particles. Examples of the inorganic particles include silica (silicon dioxide) particles, titanium oxide particles, magnesium oxide particles, aluminum oxide particles, calcium carbonate particles, and the like. Examples of the organic particles include polymethyl (meth)acrylate particles, polystyrene particles, polyester particles, and the like. Among these, polymethyl (meth) acrylate particles are preferable. Polymethyl (meth)acrylate refers to at least one of polymethyl acrylate and polymethyl methacrylate (PMMA).

With respect to the particles, one kind may be used singly, or two or more kind thereof may be used in combination.

(Nonvolatile Solvent)

The nonvolatile solvent in the present embodiment is not limited as long as it boils at 150° C. or higher under 1 atm. As the nonvolatile solvent in the present embodiment, nonvolatile organic solvents are preferably used.

In the present embodiment, since the particle-containing liquid which contains particles and a nonvolatile solvent is applied on a recording medium, it is possible to suppress the particles from scattering to the vicinity. Also, in the present embodiment, since the nonvolatile solvent is used, it is possible to suppress variation in concentration of the particle-containing liquid, to stably apply the particle-containing liquid on the recording medium, and to stably supply printed articles where the fixing offset resistance is improved. Further, the nonvolatile solvent in the present embodiment does not have a polymerizable group. Accordingly, the particle-containing liquid which is applied on the recording medium in the second process of the present embodiment may not form a film, glossiness of an obtained image does not vary, and gloss can be suppressed. Also, the nonvolatile solvent in the present embodiment is preferred in that it does not contain polymer or the like to be coated, and thus glossiness of an obtained image does not vary and gloss can be suppressed.

Examples of the nonvolatile solvent used in the present embodiment include silicone oils such as dimethylsilicone oil, fluorosilicone oil, or amino-modified silicone oil; fluorine-containing oil; liquid paraffin, and the like. Among them, from the viewpoints of appropriate application on a recording medium because of an excellent releasability, silicone oil and fluorine-containing oil is preferred, and silicone oil is more preferred.

Examples of the non-volatile solvent in the present embodiment include "KF-96-10 cs", "KF-96-20 cs", "KF-96-30 cs", "KF-96-50 cs", "KF-96-100 cs", "KF-96-200 cs", "KF-96-300 cs", "KF-96-500 cs", "KF-96-1000 cs", "KF-96-3000 cs", "KF-96-5000 cs", and "KF-96-10000 cs", (trade names) each manufactured by Shin-Etsu Chemical Co., Ltd., dimethylsilicone oils such as "SH200-10 CS", "SH200-100 CS", "SH200-1000 CS", "SH200-10000 CS", and the like, (trade names) each manufactured by Dow Corning Toray Co., Ltd.; "KF-393", "KF-859", "KF-860", "KF-861", "KF-864", "KF-865", "KF-867", "KF-868", "KF-869", "KF-6012", "KF-880", "KF-8002", "KF-8004", "KF-8005", "KF-877", "KF-8008", "KF-8010", "KF-8012", "X-22-3820 W", "X-22-3939 A", "X-22-161 A", "X-22-161 B", and "X-22-1660B-3", (trade names) manufactured by Shin-Etsu Chemical Co., Ltd., amino-modified silicone oils such as "BY16-871", "BY16-853 U", "FZ-3705", "SF8417", "BY16-849", "FZ-3785", "BY16-890", "BY16-208", "BY16-893", "FZ-3789", "BY16-878", "BY16-891", and the like, (trade names) each manufactured by Dow Corning Toray Co., Ltd.; "FL-5", "X22-821", "X-22-822", "FL-100-100 CS", "FL-100-450 CS", "FL-100-1000 CS", and "FL-100-10000 CS", (trade names) manufactured by Shin-Etsu Chemical Co., Ltd., and fluorosilicone oils such as "FS1265-300 CS", "FS1265-1000 CS", "FS1265-10000 CS", and the like, (trade names) each manufactured by Dow Corning Toray Co., Ltd.; and the like.

With respect to the nonvolatile solvent, one kind may be used singly, or two or more kind thereof may be used in combination.

(Process for Applying Particle-Containing Liquid on Recording Medium)

In the second process of the present embodiment, the amount of the particle-containing liquid to be applied on the recording medium is preferably from 5 mg/m$^2$ to 100 mg/m$^2$, and more preferably from 10 mg/m$^2$ to 50 mg/m$^2$. In this range, it is possible to improve the fixing offset, and to suppress a surface of a printed article from being sticky due to the presence of excessive particle-containing liquid on the recording medium.

In the second process of the present embodiment, the particle-containing liquid containing particles and a nonvolatile solvent is applied on the recording medium. The method for application of the particle-containing liquid is not limited, and, for example, can be carried out by employing a known method such as a transferring method, a spraying method, a coating method, an ink jet method, or an immersion method. The coating method may be a known coating method using a bar coater, an extrusion die coater, an air doctor coater, a blade coater, a rod coater, a knife coater, a squeeze coater, a reverse roll coater, or the like. Details of the ink jet method are as described above. In the present embodiment, particularly, the particle-containing liquid is preferably applied on the recording medium by transferring. In order to transfer the particle-containing liquid to the recording medium, a web member having a particle-containing liquid impregnated therein is more preferably used. Examples of the web member include non-woven fabrics, and the like. Among them, as the web member, it is preferable to use the non-woven fabrics.

<Fixing Process>

In the ink jet image forming method in the present embodiment, in addition to the second process, a fixing process is preferably carried out in which the recording medium on which the ink composition has been applied is fixed. The fixing process is preferably carried out by causing a fixing member to contact with the recording medium on which the ink composition has been applied. The fixing member is preferably a roll type member.

It is preferable that the particle-containing liquid in the present invention is supplied to the fixing member and, then, applied on the recording medium after the first process. The method for supplying the particle-containing liquid to the fixing member is not limited as long as the particle-containing liquid can be attached to the fixing member directly or indirectly. For example, a method in which a web member having a particle-containing liquid impregnated therein is brought into contact with a fixing member surface, a method in which a particle-containing liquid is sprayed onto a fixing member surface, a method in which a particle-containing liquid is coated with a roll coater, and the like. Particularly, the method in which a web member is brought into contact with a fixing member surface is preferable from the viewpoints of supplying an appropriate amount of a particle-containing liquid to a fixing member surface without unevenness. The web member may be any one of woven fabrics, non-woven fabrics, and the like, and a commercially available or known one may be used. However, the web member having heat resistance is preferable in a case in which heating is performed during the fixing process. Examples thereof include a polyvinylidene chloride, a polyethylene, an aramide, a polyester, and the like.

In the case in which the transfer of the particle-containing liquid in the present embodiment is carried out by using the web member and the fixing member as described above, as a device for cleaning the fixing member, it is preferable to use a device which has a web cleaning type fixing roll cleaning mechanism. Examples of the cleaning device include one disclosed in JP-A No. 2003-233265 or JP-A No. 2006-276295, but the present invention is not limited thereto.

The nip time in the fixing process is preferably from 1 millisecond to 10 milliseconds, more preferably from 2 milliseconds to 1 second, and even more preferably from 4 milliseconds to 100 milliseconds. A nip width is preferably from 0.1 mm to 100 mm, more preferably from 0.5 mm to 50 mm, and even more preferably from 1 mm to 10 mm.

As the belt substrate for conveying the recording medium, which is not limited, for example, a seamless electrocast nickel substrate is preferred and the thickness of the substrate is preferably from 10 μm to 100 μm. Further, for the material of the belt substrate, aluminum, iron, polyethylene, or the like can be used, as well as nickel. When disposing a silicone resin or a fluorine-containing resin, the thickness of the layer formed by using such a resin is preferably from 1 μm to 50 μm, and more preferably from 10 μm to 30 μm.

Moreover, the pressure (nip pressure) may be attained, for example, by selecting an elastic member such as a spring and the like having tension and disposing the elastic member on both roller ends of rollers such as a fixing roller and the like so that a desired nip pressure may be obtained taking the nip gap into consideration.

The conveying speed of the recording medium is preferably in the range of from 200 mm/sec to 700 mm/sec, more preferably from 300 mm/sec to 650 mm/sec, and even more preferably from 400 mm/sec to 600 mm/sec.

The amount of the particle-containing liquid to be applied on the recording medium is not limited, and may be appropriately adjusted by an amount to be supplied to a fixing member, a particle-containing liquid, or the like. Further, in the method using a web member having a particle-containing liquid impregnated therein, the amount can be adjusted with the impregnation amount into the web member, the delivery amount of the web member, and the like.

The fixing process is preferably performed by, for example, heating and pressing a surface of a recording medium using the fixing member. The heating temperature at this time is preferably in the range of from 40° C. to 150° C., more preferably in the range of from 50° C. to 100° C., and even more preferably in the range of from 60° C. to 90° C.

The pressure during pressing along with heating is not limited, but preferably such a level that the particles used in the present embodiment are not crushed. The pressure is preferably in the range of from 0.1 MPa to 3.0 MPa, more preferably in the range of from 0.1 MPa to 1.0 MPa, and even more preferably in the range of from 0.1 MPa to 0.5 MPa.

The method of heating is not particularly limited, but examples thereof include methods of drying in a non-contact mode, for example, a method of heating with a heating member such as a nichrome wire heater, a method of supplying warm air or hot air, a method of heating with a halogen lamp, an infrared ray lamp, or the like.

The heating and pressing roller may be either a metal roller made of a metal, or a roller having a core metal made of a metal and a coated layer including an elastic member, and optionally, a surface layer (also referred to a release layer) provided at the periphery thereof. The latter core metal can be formed, for example, of a cylindrical member made of iron, aluminum, SUS, or the like, and at least a portion of the surface of the core metal is preferably covered by the coated layer. Particularly, the coated layer is formed preferably of a silicone resin or fluorine-containing resin having releasability. The heating and pressing roller preferably has a heating member built in the side of the core metal thereof. When, for example, two rollers are used, one of the two rollers may have a heating member built in the core metal thereof. The recording medium may be heated by applying the heating treatment and the pressing treatment simultaneously by passing the medium between the rollers. Two heating rollers may be used, and the recording medium may be heated by passing the medium between the two heating rollers. As the heating member, for example, a halogen lamp heater, a ceramic heater, a nichrome wire, or the like is preferred.

In the image forming method of the present embodiment, a device such as an ink drying zone and the like can be included to carry out a drying process between the first process and the second process, the second process and the fixing process, the respective processes after the fixing process, and the like.

(Other Processes)

In the present embodiment, in addition to the first process in which the ink composition is applied on the recording medium by the ink jet method, a treatment liquid application process in which a treatment liquid including a aggregating agent which aggregates components in the ink composition, is applied onto a recording medium, is preferably included. The treatment liquid application process may be provided either before or after the first process in the present embodiment.

The treatment liquid which may be used in the present embodiment is configured to be capable of forming aggregates by being brought into contact with the ink composition. Specifically, the treatment liquid preferably includes at least an aggregating agent which is capable of forming aggregates by aggregating dispersed particles such as the coloring material particles (pigments or the like), and the like in the ink composition. The treatment liquid may further include one or more other components optionally.

—Treatment Liquid—

The treatment liquid can contain at least one aggregating component (which may also be referred to as "aggregating agent") which is capable of forming aggregates by being brought into contact with the ink composition. By mixing the treatment liquid with the ink composition ejected by the ink jet method, coagulation of the pigments and the like that are dispersed stably in the ink composition is promoted.

Examples of the treatment liquid include liquids that are capable of forming coagulates by changing the pH of the ink composition. Here, the pH (25° C.) of the treatment liquid is preferably from 0.5 to 6, more preferably from 1.0 to 5, and even more preferably from 1.5 to 4, from the viewpoints of the aggregation speed of the ink composition. In this case, the pH (25° C.) of the ink composition used in the ejecting process is preferably from 7.5 to 9.5 (more preferably from 8.0 to 9.0).

Among these, in the present embodiment, from the viewpoints of the image density, resolution, and a higher recording speed of ink jet recording, the pH (25° C.) of the ink composition is 7.5 or more, and the pH (25° C.) of the treatment liquid is preferably 1.0 to 3.

The aggregating components may be used alone or as a mixture of two or more kinds thereof.

The treatment liquid may include at least one acidic compound as an aggregating component. As the acidic compound, a compound having a phosphoric acid group, a phosphonic acid group, a phosphinic acid group, a sulfuric acid group, a sulfonic acid group, a sulfinic acid, or a carboxy group, or a salt thereof (for example, a polyhydric metal salt) can be used. Among these, from the viewpoints of the aggregation speed of the ink composition, a compound having a phosphoric acid group or a carboxy group is more preferred, and a compound having a carboxy group is even more preferred.

The compound having a carboxy group is preferable selected from polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furancarboxylic acid, pyridinecarboxylic acid, coumaric acid, thiophene carboxylic acid, nicotinic acid, derivatives of the compounds, salts thereof (for example, polyvalent metal salts), and the like. These compounds may be used alone or in combination of two or more kinds thereof.

The treatment liquid in the present embodiment may include an aqueous solvent (for example, water), in addition to the acidic compound and the like.

The content of the acidic compound in the treatment liquid is preferably from 5% by mass to 95% by mass, more preferably from 10% by mass to 80% by mass, and even more preferably from 15% by mass to 50% by mass, with respect to the total mass of the treatment liquid, from the viewpoints of the coagulation effect.

The treatment liquid may be, for example, a treatment liquid including a polyvalent metal salt or polyallylamine. When the treatment liquid including a polyvalent metal salt or polyallylamine is used, high-speed aggregation properties can be improved. Examples of the polyvalent metal salt and polyallylamine include salts of alkaline earth metals belonging to Group II of the periodic table (for example, magnesium and calcium), transition metals belonging to Group III of the periodic table (for example, lanthanum), cations from Group XIII of the periodic table (for example, aluminum), and lanthanides (for example, neodymium), polyallylamine and polyallylamine derivatives. As salts of the metals, carboxylic acid salts (formates, acetates, benzoates, and the like), nitrates, chlorides, and thiocyanates are preferable. Among these, calcium salts or magnesium salts of carboxylic acids (for example, formates, acetates, benzoates, and the like), calcium salts or magnesium salts of nitric acid, calcium chloride, magnesium chloride, and calcium salts or magnesium salts of thiocyanic acid are more preferable.

The content of the metal salt in the treatment liquid is preferably in the range of from 1% by mass to 10% by mass, more preferably 1.5% by mass to 7% by mass, and even more preferably 2% by mass to 6% by mass, from the viewpoints of the coagulation effect.

The treatment liquid may include at least one cationic organic compound as an aggregating component. Examples of the cationic organic compound include cationic polymers such as a poly(vinylpyridine) salt, a polyalkylaminoethyl acrylate, polyalkylaminoethyl methacrylate, a poly(vinylimidazole), a polyethyleneimine, a polybiguanide, a polyguanide, or a polyallylamine and a derivative thereof, and the like.

The weight average molecular weight of the cationic polymer is preferably small in terms of the viscosity of the treatment liquid. In a case in which the treatment liquid is applied onto a recording medium by an ink jet method, the weight average molecular weight is preferably in the range of from 1,000 to 500,000, more preferably from 1,500 to 200,000 and even more preferably from 2,000 to 100,000. A weight average molecular weight of 1000 or more is advantageous from the viewpoints of the aggregation speed and a weight average molecular weight of 500,000 or less is advantageous from the viewpoints of ejecting reliability. However, this does not apply in a case in which the treatment liquid is applied onto a recording medium by a method other than ink jet.

Preferable examples of the cationic organic compound include compounds of primary, secondary or tertiary amine salt type. Examples of amine salt type compounds include cationic compounds including compounds such as hydrochlorides or acetates (for example, laurylamine, palmitylamine, stearylamine, rosin amine, and the like), quaternary ammonium salt type compounds (for example, lauryltrimethylammonium chloride, cetyltrimethylammonium chloride, lauryldimethylbenzylammonium chloride, benzyltributylammonium chloride, benzalkonium chloride, and the like), pyridinium salt type compounds (for example, cetylpyridinium chloride, cetylpyridinium bromide, and the like), imidazoline type cationic compounds (for example, 2-heptadecenylhydroxyethylimidazoline and the like), ethylene oxide adducts of higher alkylamines (for example, dihydroxyethylstearylamine and the like), and the like, and amphoteric surfactants exhibiting cationic properties in a desired pH region, including amphoteric surfactants such as amino acid type amphoteric surfactants, compounds of R—NH—$CH_2CH_2$—COOH type, carboxylate type amphoteric surfactants (for example, stearyldimethylbetaine, lauryldihydroxyethylbetaine, and the like), amphoteric surfactants of sulfuric acid ester type, sulfonic acid type or phosphoric acid ester type, and the like.

Among these, a divalent or higher cationic organic compound is preferable.

The content of the cationic organic compound in the treatment liquid is preferably from 1% by mass to 50% by mass, and more preferably from 2% by mass to 30% by mass, from the viewpoints of a aggregation effect.

Among these, as the aggregating component, a divalent or higher carboxylic acid or a divalent or higher cationic organic compound is preferable in view of aggregation properties and abrasion resistance of the image.

The viscosity of the treatment liquid is preferably in the range of from 1 mPa·s to 30 mPa·s, more preferably from 1 mPa·s to 20 mPa·s, even more preferably from 2 mPa·s to 15 mPa·s, and particularly preferably from 2 mPa·s to 10 mPa·s, from the viewpoints of the aggregation speed of the ink composition.

The viscosity is measured under the condition of a temperature of 20° C. using VISCOMETER TV-22 (trade name, manufactured by Toki Sangyo Co., Ltd.).

Further, the surface tension of the treatment liquid is preferably from 20 mN/m to 60 mN/m, more preferably from 20 mN/m to 45 mN/m, and even more preferably from 25 mN/m to 40 mN/m, from the viewpoints of the aggregation speed of the ink composition.

The surface tension is measured under the condition of a temperature of 25° C. using an automatic surface tensiometer CBVP-Z (trade name, manufactured by Kyowa Interface Science Co., Ltd.).

In general, the treatment liquid in the present embodiment may contain a water-soluble organic solvent in addition to the aggregating components.

Within a range not interfering with the effect of the present embodiment, one or more other additives may also be used in the treatment liquid.

Details of the water-soluble organic solvent are the same as those in the above-described ink composition.

Examples of other additives above include those known additives such as a drying preventing agent (a moisturizing agent), an anti-fading agent, an emulsion stabilizer, a penetration enhancement agent, an ultraviolet ray absorber, a preservative, an anti-mold agent, a pH adjusting agent, a surface tension adjusting agent, an antifoaming agent, a viscosity modifier, a dispersant, a dispersion stabilizer, an anti-rusting agent, a chelating agent, and the like, and those mentioned as specific examples of other additives included in the above-described ink composition can be employed here.

EXAMPLES

Hereinafter, the present invention is described in detail using Examples, but the present invention is not limited to the following Examples without departing from the scope thereof. Also, unless otherwise noted, the "parts" are in terms of mass.

I. Examples of First Image Forming Method

Hereinafter, the first image forming method is described in detail using Examples. The weight average molecular weight was measured by gel permeation chromatography (GPC). In GPC, HLC-8220GPC (trade name, manufactured by Tosoh Corporation) is used, TSKgel Super HZM-H, TSKgel Super HZ4000 and TSKgel Super HZ2000 (trade names, manufactured by Tosoh Corporation), three of which are connected in series, are used as the columns, and THF (tetrahydrofuran) is used as an eluent. Further, the conditions included a sample concentration of 0.45% by mass, a flow rate of 0.35 mL/min, an amount of the sample to be injected of 10 μl, a measurement temperature of 40° C., and using an RI detector. Further, a calibration curve was created using eight samples of "STANDARD SAMPLE TSK standard polysterene": "F-40", "F-20", "F-4", "F-1", "A-5000", "A-2500", "A-1000", (trade names), and "n-propyl benzene" each of which is manufactured by Tosoh Corporation.

<Preparation of Ink Composition>

(Synthesis of Polymer Dispersant PD-1)

The polymer dispersant PD-1 was synthesized as described below according to the following schemes.

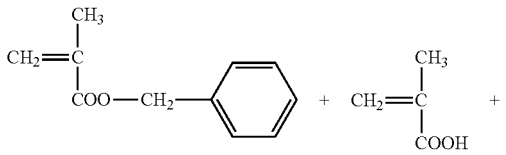

-continued

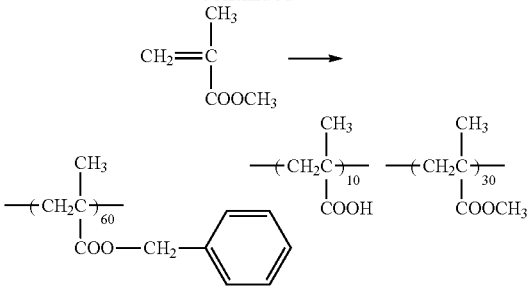

PD-1

In a 1000 mL three-necked flask equipped with a stirrer and a condenser tube, methyl ethyl ketone (88 g) was placed, which was then heated at 72° C. under a nitrogen atmosphere. A solution obtained by dissolving dimethyl 2,2'-azobis isobutyrate (0.85 g), benzyl methacrylate (60 g), methacrylic acid (10 g), and methyl methacrylate (30 g) in methyl ethyl ketone (50 g) was added dropwise into the flask over three hours. After the dropwise addition, the content of the flask was further allowed to react for additional one hour, and then a solution obtained by dissolving dimethyl 2,2'-azobis isobutyrate (0.42 g) in methyl ethyl ketone (2 g) was added thereto. Then the temperature of the resultant was increased to 78° C. and was heated for four hours. The obtained reaction solution was twice immersed in a large excess amount of hexane, precipitated resin was dried, and then the polymer dispersant PD-1 of 96 g was obtained.

The composition of the obtained polymer dispersant PD-1 was confirmed using 1H-NMR, and the weight average molecular weight (Mw) obtained from GPC was 44,600. Further, an acid value obtained using a method disclosed in the JIS specification (JIS K0070: 1992) was 65.2 mgKOH/g.

(Preparation of Dispersion C of Resin-Coated Pigment Particles)

Pigment blue 15:3 (PHTHALOCYANINE BLUE A220, (trade name) manufactured by Dainichiseika Color & Chemicals Mfg. Co., Ltd.; cyan pigment) 10 parts, the polymer dispersant P-1 (5 parts), methyl ethyl ketone 42 parts, a 1N NaOH aqueous solution 5.5 parts, and ion-exchange water 87.2 parts were mixed with each other, which were dispersed using 0.1 mmΦ zirconia beads in a beads-mill for two to six hours.

The methyl ethyl ketone was removed from the obtained dispersion at 55° C. under reduced pressure, and a portion of water was further removed. Moreover, a high-speed centrifugal cooler 7550 (trade name, manufactured by Kubota Corporation) and a centrifuge tube of 50 mL were used, a centrifugal treatment was performed at 8000 rpm for thirty minutes, and a supernatant liquid other than sediment was collected. Thereafter, a pigment concentration was determined from an absorbance spectrum, and dispersion C (dispersion C of cyan) of resin-coated pigment particles (pigment coated with the polymer dispersant) of which the pigment concentration was 10.2% by mass was obtained.

(Preparation of Dispersion M of Resin-Coated Pigment Particles)

As compared with the preparation of the dispersion C of the resin-coated pigment particles, instead of the pigment blue 15:3 (cyan pigment), pigment red 122 (CROMOPHTAL JET MAGENTA DMQ, (trade name) manufactured by BASF; magenta pigment) was used, and, except therefor, dispersion M (dispersion M of magenta) of resin-coated pigment particles (pigment coated with the polymer dispersant) was prepared in substantially the same manner as the preparation of the dispersion C of the resin-coated pigment particles.

(Preparation of Dispersion Y of Resin-Coated Pigment Particles)

As compared with the preparation of the dispersion C of the resin-coated pigment particles, instead of the pigment blue 15:3 (cyan pigment), pigment yellow 74 (IRGALITE YELLOW GS, (trade name) manufactured by BASF; yellow pigment) was used, and, except therefor, dispersion Y (dispersion Y of yellow) of resin-coated pigment particles (pigment coated with the polymer dispersant) was prepared in the same manner as the preparation of the dispersion C of the resin-coated pigment particles.

(Preparation of Dispersion K of Resin-Coated Pigment Particles)

As compared with the preparation of the dispersion C of the resin-coated pigment particles, instead of the pigment blue 15:3 (cyan pigment), carbon black (NIPEX160-IQ, trade name, manufactured by Evonik Degussa Corporation; black pigment) was used, and, except therefor, dispersion K (dispersion K of black) of resin-coated pigment particles (pigment coated with the polymer dispersant) was prepared in the same manner as the preparation of the dispersion C of the resin-coated pigment particles.

(Preparation of Self-Dispersing Polymer Particles)

Synthesis Example 1

—Preparation of Aqueous Dispersion of Polymer Particle B-1—

Methyl ethyl ketone 540.0 g was placed in a 2 L three-necked flask equipped with a mechanical stirrer, a thermometer, a reflux condenser tube, and a nitrogen gas introducing tube, and the temperature increased to 75° C. While the temperature in the reaction vessel was maintained at 75° C., a mixed solution including methyl methacrylate 108 g, isobornyl methacrylate 388.8 g, methacrylic acid 43.2 g, methyl ethyl ketone 108 g, and an initiator ("V-601," trade name, manufactured by Wako Pure Chemical Industries, Ltd.) 2.16 g was added dropwise at a constant speed so as to complete the dropwise addition over two hours. After completion of the dropwise addition, a solution formed of "V-601" 1.08 g and methyl ethyl ketone 15.0 g was added thereto, and, the resultant was stirred at 75° C. for two hours, and, moreover, a solution formed of "V-601" 0.54 g and methyl ethyl ketone 15.0 g was added thereto, and, the resultant was stirred at 75° C. for two hours. Thereafter, the temperature of the resultant was increased to 85° C. and was stirred for additional two hours, thereby obtaining a resin solution of methyl methacrylate/isobornyl methacrylate/methacrylic acid (=20/72/8[mass ratio]) copolymer.

The weight average molecular weight (Mw) of the obtained copolymer was 61,000. The acid value obtained using a method disclosed in JIS specification (JIS K0070: 1992; the disclosure of which is incorporated by reference herein) was 52.1 mgKOH/g.

Next, 588.2 g of the resin solution obtained in the above was weighed, isopropanol 165 g and a sodium hydroxide aqueous solution 120.8 mL of 1 mole/L were added to the resin solution, and the temperature in the reaction vessel increased to 80° C. Next, distilled water 718 g was added dropwise at speed of 20 mL/min for aqueous dispersion. Thereafter, under atmospheric pressure, in order to distil off the solvent, the temperature of the inside of the reaction vessel was maintained at a temperature of 80° C. for two hours, at 85° C. for two hours, and 90° C. for two hours. Further, the inside of the reaction vessel was reduced in pressure so as to distil off the isopropanol, the methyl ethyl ketone, and the distilled water, and to obtain an aqueous dispersion of the self-dispersing polymer particles B-1 (film-forming polymer particles) of solid content 26.0% by mass.

An actual measurement value (measured Tg) for glass transition temperature of the polymer particles B-1 was 180° C. The measured Tg was measured in the following method.

An aqueous dispersion of polymer particles of 0.5 g in terms of solid content was dried under reduced pressure for four hours at 50° C., and then a polymer solid was obtained. Using the obtained polymer solid, the measured Tg was measured by a differential scanning calorimeter (DSC) EXSTAR6220 (trade name) manufactured by SII Nanotechnology Inc. The measurement conditions were as follows. A sample of 5 mg was placed in an aluminum pan which was sealed. Under a nitrogen atmosphere, measurement was carried and the value of the peak top of DSC of the measured data during the second increase in the temperature in the following temperature profiles was defined as the measured Tg.

30° C. to −50° C. (decrease in temperature at 50° C./min)
−50° C. to 140° C. (increase in temperature at 20° C./min)
140° C. to −50° C. (decrease in temperature at 50° C./min)
−50° C. to 140° C. (increase in temperature at 20° C./min)

—Preparation Method of Wax 1—

A microcrystalline wax (HI-MIC 1090, trade name, manufactured by Nippon Serio Co., Ltd., a melting point of 88° C.) 60 g and a compound WA-2 (the following structure formula) 40 g were added to a stainless dispersing device of 2 L, and the temperature was increased to 100° C., and the wax and compound WA-2 were mixed with each other so as to be uniform, and a mixture having viscosity was obtained. Hot water 800 g at 95° C. was added to the melted mixture and then was the resulting mixture was dispersed in a HOMOGENIZER (trade name, manufactured by Nippon Seiki Co., Ltd.; rpm 10,000, ten minutes) at a high speed. While continuing the agitation, the dispersing device was cooled such that the inside temperature gradually decreased, and a wax 1 of a solid form dispersion was obtained. The average particle size of the dispersion was 0.2 μm.

$$\text{WA-2}\ C_{40}H_{81}O\text{-}(CH_2CH_2O)_{16}H$$

—Preparation of Ink Composition—

Using the dispersions of the resin-coated pigment particles obtained above (the cyan dispersion C, the magenta dispersion M, the yellow dispersion Y, and the black dispersion K), and the dispersion of the self-dispersing polymer particles (B-1), the respective components were mixed to have each of the following ink compositions, each mixture was placed in a plastic disposable syringe, and filtered using a filter having a pore diameter of 5 μm and made of polyvinylidene fluoride (PVDF) (MILLEX-SV, diameter 25 mm, trade name, manufactured by Millipore Corporation), thereby obtaining the ink composition.

(Composition of Cyan Ink CI-1)

Cyan pigment (pigment blue 15:3): 4% by mass
The polymer dispersant PD-1 (solid content): 2% by mass
The self-dispersing polymer particles B-1 (solid content): 4% by mass
SANNIX GP250 (trade name, manufactured by Sanyo Chemical Industries, Ltd., water-soluble organic solvent): 8% by mass
Tripropylene glycol monoethyl ether (TPGMME): (trade name, manufactured by Wako Pure Chemical Industries, Ltd., water-soluble organic solvent) 8% by mass
OLFINE E1010 (trade name, manufactured by Nissin Chemical Industry Co., Ltd., surfactant): 1% by mass
Wax 1: 2% by mass The cyan ink was prepared by adding ion-exchange water to the components so as to give 100% by mass.

(Composition of Magenta Ink MI-1)

The magenta ink had the same composition as the cyan ink CI-1 except that the cyan pigment in the composition of the cyan ink CI-1 was changed to a magenta pigment (pigment red 122) so as to have the same amount of the pigment.

(Composition of Yellow Ink YI-1)

The yellow ink had the same composition as the cyan ink CI-1 except that the cyan pigment in the composition of the cyan ink CI-1 was changed to a yellow pigment (pigment yellow 74) so as to have the same amount of the pigment.

(Composition of Black Ink KI-1)

The black ink had the same composition as the cyan ink CI-1 except that the cyan pigment in the composition of the cyan ink CI-1 was changed to a black pigment (carbon black) so as to have the same amount of the pigment.

(Composition of cyan ink CI-2)

Cyan pigment (pigment blue 15:3): 4% by mass
The polymer dispersant PD-1 (solid content): 2% by mass
The self-dispersing polymer particles B-1 (solid content): 4% by mass
SANNIX GP250 (trade name, manufactured by Sanyo Chemical Industries, Ltd., water-soluble organic solvent): 16% by mass
OLFINE E1010 (trade name, manufactured by Nissin Chemical Industry Co., Ltd., surfactant): 1% by mass
Wax 1: 2% by mass The cyan ink was prepared by adding ion-exchange water to the components so as to give 100% by mass.

(Composition of Magenta Ink MI-2)

The magenta ink had the same composition as the cyan ink CI-2 except that the cyan pigment in the composition of the cyan ink CI-2 was changed to a magenta pigment (pigment red 122) so as to have the same amount of the pigment.

(Composition of Yellow Ink YI-2)

The yellow ink had the same composition as the cyan ink CI-2 except that the cyan pigment in the composition of the cyan ink CI-2 was changed to a yellow pigment (pigment yellow 74) so as to have the same amount of the pigment.

(Composition of Black Ink KI-2)

The black ink had the same composition as the cyan ink CI-2 except that the cyan pigment in the composition of the cyan ink CI-2 was changed to a black pigment (carbon black) so as to have the same amount of the pigment.

Measurement of $MFT^{40\%}$($T_A$: MFT for a hydrophilic organic solvent content of 40% by mass)

An aqueous solution including the self-dispersing polymer particles (B-01) 25% by mass (solid content), the solvent (total amount) used in each ink as described above and disclosed in the following Table 1 10% by mass, and water 65% by mass was prepared, and the measurement was performed using an MFT meter manufactured by YOSHIMITSU SEIKI Co., Ltd. Specifically, each of the obtained aqueous solutions was coated at 50 cm length×3 cm width on a PET film (64 cm×18 cm) using a blade such that a thickness of the coated film became 300 μm, then the conting film was heated from the back side of the PET film such that the temperature gradient of from 20° C. to 74° C. was applied, and dried at 20° C. for four hours under the condition of 22% RH. At this time, a temperature [° C.] at a boundary between a portion where a white powder precipitate was generated and a portion where a transparent film was formed was measured and defined as the minimum film-forming temperature.

TABLE 1

| | $MFT^{40\%}$ | |
|---|---|---|
| | C1 solvent | C2 solvent |
| Polymer particles B-1 | 52° C. | 74° C. or higher |

Here, the solvent C1 and the solvent C2 are as follows.

The solvent C1: a solvent mixture (mass ratio 1:1) of SANNIX GP250 and TPGMME (trade names)

The solvent C2: SANNIX GP250 (trade name)

<Preparation of Treatment Liquid>

A treatment liquid (1) was prepared as described below. The measurement for a surface tension was performed using an Automatic Surface Tensiometer CBVP-Z (trade name, manufactured by Kyowa Interface Science Co., Ltd), at 25° C. by a Wilhelmy method using a platinum plate.

The measurement of viscosity was performed using a VISCOMETER TV-22 (trade name, manufactured by TOKI SANGYO CO., LTD.) at 30° C.

The pH measurement was performed using a treatment liquid without dilution of 25° C. using a pH meter WM-50EG (trade name) manufactured by Dkk-Toa Corporation.

The respective components were mixed to have the following composition and the treatment liquid (1) was prepared. As the physical characteristic values of the treatment liquid (1), the viscosity was 2.6 mPa·s, the surface tension was 37.3 mN/m, and pH was 1.6.

<Composition of Treatment Liquid (1)>

Malonic acid (bivalent carboxylic acid, manufactured by Wako Pure Chemical Industries, Ltd.) 15% by mass Diethylene glycol monomethyl ether (trade name, manufactured by Wako Pure Chemical Industries, Ltd.) 20.0% by mass N-Oleoyl-N-sodium methyl taurate (surfactant) 1.0% by mass Ion-exchange water 64.0% by mass —Preparation of Web Members 1 to 4—

Silicone oil ("KF-96-100CS," trade name, manufactured by Shin-Etsu Chemical Co., Ltd.) 85.0% by mass Resin particles (resin particles 1 described below) 15.0% by mass By mixing a liquid (1 L) of the composition as described above using an emulsifying device manufactured by Silverson Machines, Inc. at 8000 rpm for ten minutes, a resin particle dispersion liquid 1 was manufactured. A web member 1 was manufactured by impregnating the resin particle dispersion liquid 1 in a non-woven fabric so as to give an impregnated amount of the resin particle dispersion liquid of 30 g/m$^2$. The non-woven fabric was made of a mixture of polyamide and polyester, and employed one having a weight 30 g/m$^2$ and a thickness 0.1 mm.

The webs 2 to 4 were manufactured in substantially the same manner as the web 1except that the resin particles 1 in the web member 1 was changed to resin particles 2 to 4respectively. When a dispersion type product was used as the resin particles, this was powdered once by freeze-drying and then dispersed again in a silicone oil. The Tg of the resin particles described below was measured in substantially the same manner as Tg of the polymer particles.

Resin Particles 1: Cross-linked polymethyl methacrylate particles (trade name: MX-501, manufactured by Soken Chemical & Engineering Co., Ltd.) Tg>140° C.

Resin Particles 2: Cross-linked polystyrene particles (trade name: MX-800, manufactured by Soken Chemical & Engineering Co., Ltd.) Tg>140° C.

Resin Particles 3: Cross-linked acrylic ester particles (trade name: SX-500H, manufactured by Soken Chemical & Engineering Co., Ltd.) Tg=100° C.

Resin Particles 4: ethylene-vinyl acetate particles (trade name: CHEMIPEARL V200, manufactured by Mitsui Chemicals, Inc.) Tg=85° C.

$MFT^{40\%}$ of the resin particles 1 to 4 was measured in a state of containing a solvent of 40% by mass. The measurement was performed in substantially the same manner as the measurement in the self-dispersing polymer particles (B-01) as described above except that "the self-dispersing polymer particles (B-01)" was changed to "the resin particles 1 to 4."

TABLE 2

| | $MFT^{40\%}$ | |
|---|---|---|
| | C1 solvent | C2 solvent |
| Resin particles 1 | Film is not formed | Film is not formed |
| Resin particles 2 | Film is not formed | Film is not formed |
| Resin particles 3 | Film is not formed | Film is not formed |
| Resin particles 4 | lower than 20° C. | 40° C. |

Here, the solvent C1 and the solvent C2 are as described above.

<Image Formation and Evaluation>

As described below, an image was recorded using the ink C1/M1/Y1/K1, and the following evaluation was performed. The evaluated result is shown in the following Table 3.

—Abrasion Resistance—

A GELJET GX5000 (trade name) print head (a full-line head manufactured by RICOH Company, Ltd.) was prepared, and the contents in storage tanks connected thereto were replaced with the cyan ink C 1, the magenta ink M11, the yellow ink Y1, and the black ink K1, obtained as described above. As a recording medium, OK TOPKOTE+ (trade name, manufactured by Oji paper Co.; a basis weight 104.7 g/m$^2$) was fixed onto a stage (a conveying belt) which was movable in a predetermined straight line direction at 500 mm/sec, the treatment liquid obtained as described above was coated to have a thickness of about 1.5 μm (corresponding to malonic acid 0.34 g/m$^2$) using a wire bar coater, and was dried at 50° C. for two seconds (FIG. 2) immediately after being coated.

Thereafter, the GELJET GX5000 (trade name) print head (a full-line head manufactured by RICOH Company, Ltd.) was fixed and disposed such that the direction (main scanning direction) of the line head in which the nozzles are arranged is tilted at 75.7° with respect to the direction perpendicular to the movement direction (sub-scanning direction) of the stage. The recording medium was moved in the sub-scanning direction at a constant speed, and the ink was ejected in the line system under the ejecting condition of the amount of ink droplets of 2.4 pl, an ejecting frequency of 24 kHz and the resolution of 1200 dpi×1200 dpi. Accordingly, an evaluation sample was obtained by printing a solid image. After the printing, the sample was dried at 60° C. for three seconds.

Next, the web members provided as shown in FIG. 2 was changed in accordance with the respective evaluations (the following Table 3), and the recording medium with a solid image was passed between a pair of rollers, the heating roller having a temperature disclosed in Table 3 and the pressing roller), whereby, the fixing process was performed at the nip pressure of 0.25 MPa and the nip width of 4 mm, and then the evaluation sample was obtained.

As the heating roller (the fixing roller) in FIG. 2, a roller including a cylindrical core metal made of SUS, a surface of which is coated with a silicon resin and which has, a halogen lamp installed in therein, was used.

Unprinted OK TOPKOTE+ (trade name), not undergoing printing, which was cut into a size of 10 mm×50 mm was wound in a paper weight (the weight is 470, and the size is 15 mm×30 mm×120 mm) (an area formed by the contact between the unprinted OK TOPKOTE+ (trade name) and the evaluation sample was 150 $mm^2$), and the evaluation sample obtained as described above was rubbed three times reciprocally (corresponding to a load of 260 $kg/m^2$) with the paperweight with the Unprinted OP TOPKOTE+. The printed surface after being rubbed was visually observed, and was evaluated according to the following evaluation criteria.

<Evaluation Criteria>

A: Peeling of the image on the printed surface cannot be recognized at all.

B: Peeling of the image on the printed surface is recognized a little, but at a practically unproblematic level.

C: Peeling of the image on the print surface is recognized and is a practically problematic level.

—Blocking Evaluation—

A solid image was manufactured in substantially the same manner as in the evaluation of abrasion resistance. Two sheets of evaluation samples were cut into 4 cm×4 cm size, and were adhered to each other such that the recorded surfaces were face each other, applied with a pressure of 2.0 MPa with a press machine for thirty seconds, and the evaluation samples were separated from each other. Easiness of separation at this time and color transfer after the separation were visually observed, and evaluated according to the following evaluation criteria.

<Evaluation Criteria>

A: Two samples are naturally separated from each other and color transfer to each other is not recognized.

B: Adhesion occurs and some color transfer is recognized.

C: Adhesion is strong and color transfer to each other occurs. Practically problematic.

—Glossiness Evaluation—

A 70% dot image was manufactured by substantially the same image forming method as in the evaluation of abrasion resistance. A sample thereof was measured for a glossiness of 60 degrees and compared with a measured value for unprinted OK TOPKOTE(+) (trade name) (white background) which did not undergo printing, and the evaluation was performed according to the following evaluation criteria.

<Evaluation Criteria>

A: The glossiness is larger than the measured value for the white background and a good glossiness is shown.

B: The glossiness is lower than the measured value for the white background, but the difference therebetween is within 5%.

C: The glossiness is lower than the measured value for the white background, the difference therebetween is greater than 5%, and the reduction in the gloss is significant.

—Fixing Offset Evaluation—

By substantially the same print method as in the evaluation of the abrasion resistance, a solid print was performed under ejecting conditions of ink droplets of 2.4 μl, an ejecting frequency of 24 kHz, and a resolution of 1200 dpi×1200 dpi from each of heads of Y/M/C, and a three-color-mixed gray solid image was printed. The fixing roller and the image after the print was observed and the evaluation was performed according to the following evaluation reference.

<Evaluation Criteria>

A: Good. Neither attachment of impurities to the fixing roller nor peeling of the image is recognized.

B: Attachment of impurities to the fixing roller is recognized a little, but peeling of the image is not recognized.

C: Peeling of the image is recognized. Practically problematic.

TABLE 3

| | Ink composition | | | | | Heating roller surface temperature | Web/resin particles | | | | | | | |
|---|---|---|---|---|---|---|---|---|---|---|---|---|---|---|
| | C ink | M ink | Y ink | K ink | $MFT^{40\%}$ ($T_A$(° C.)) | (TB(° C.)) | Web | Resin particles | Tg ($T_G$(° C.)) | Film-forming property | Fixing offset | Abrasion resistance | Blocking | Glossiness |
| Example 1 | C1 | M1 | Y1 | K1 | 52 | 60 | Web 1 | Resin particles 1 | >140 | Film is not formed | A | A | A | A |
| Example 2 | C1 | M1 | Y1 | K1 | 52 | 80 | Web 2 | Resin particles 2 | >140 | Film is not formed | A | A | A | A |
| Example 3 | C1 | M1 | Y1 | K1 | 52 | 65 | Web 3 | Resin particles 3 | 100 | Film is not formed | A | A | A | A |
| Example 4 | C1 | M1 | Y1 | K1 | 52 | 60 | Web 4 | Resin particles 4 | 85 | lower than 20° C. | B | A | B | A |
| Comparative example 1 | C2 | M2 | Y2 | K2 | 74 or higher | 60 | Web 1 | Resin particles 1 | >140 | Film is not formed | A | C | B | C |
| Comparative example 2 | C1 | M1 | Y1 | K1 | 52 | 120 | Web 4 | Resin particles 4 | 85 | lower than 20° C. | C | B | C | B |

II. Examples of Second Image Forming Method

Hereinafter, the second image forming method is described further in detail using Examples.

The weight average molecular weight was measured by gel permeation chromatography (GPC). In GPC, HLC-8220GPC (trade name, manufactured by Tosoh Corporation) was used, TSKgel Super HZM-H, TSKgel Super HZ4000 and TSKgel Super HZ2000 (trade names, manufactured by Tosoh Corporation), three of which are connected in series, were used as the columns, and THF (tetrahydrofuran) was used as an eluent. Further, the conditions included a sample concentration of 0.45% by mass, a flow rate of 0.35 mL/min, an amount of the sample to be injected of 10 μl, a measurement temperature of 40° C., and using an RI detector. Further, a calibration curve was created using eight samples of "STANDARD SAMPLE TSK standard polystyrene": "F-40", "F-20", "F-4", "F-1", "A-5000", "A-2500", "A-1000", (trade names), and "n-propyl benzene" each of which was manufactured by Tosoh Corporation. An acid value was obtained by a method disclosed in JIS specification (JIS K0070: 1992).

The volume average particle diameter was measured by a NANOTRAC particle size distribution measuring instrument UPA-EX150 (trade name, manufactured by NIKKISO Co., Ltd.). The measurement was carried out using a sample liquid for measurement prepared by adding 10 mL of ion-exchange water to 100 μl of 20% by mass of an aqueous polymer particle dispersion, and adjusting the temperature to 25° C.

The glass transition temperature Tg was measured using the polymer particles 0.5 g in terms of solid content, by a differential scanning calorimeter (DSC) EXSTAR6220 (trade name) manufactured by SII Nanotechnology Inc. The glass transition temperature Tg was measured as follows. The sample of 5 mg was placed in an aluminum pan which was then sealed. The measurement was performed under a nitrogen atmosphere, and the value of the peak top of DSC of the measured data during the second increase in the temperature of −50° C. to 140° C. in the following temperature profiles was defined as the measured Tg.

30° C. to −50° C. (decrease in temperature at 50° C./min)
−50° C. to 140° C. (increase in temperature at 20° C./min)
140° C. to −50° C. (decrease in temperature at 50° C./min)
−50° C. to 140° C. (increase in temperature at 20° C./min)

(Composition of Cyan Ink (C))

The cyan ink C was prepared to have the following composition.

Cyan pigment (pigment blue 15:3): 4% by mass
Acryl-based polymer dispersant (the acid value 65.2 mgKOH/g, and the weight average molecular weight 44600): 2% by mass
Acryl based polymer particles (the weight average molecular weight 66,000): 4% by mass
SANNIX GP250: (trade name, manufactured by Sanyo Chemical Industries, Ltd., organic solvent) 10% by mass
Tripropylene glycol monoethyl ether (trade name, manufactured by Wako Pure Chemical Industries, Ltd., organic solvent): 10% by mass
OLFINE E1010 (trade name, manufactured by Nissin Chemical Industry Co., Ltd., surfactant): 1% by mass
Microcrystalline wax (HI-MIC1090, trade name, manufactured by Nippon Seiro Co., Ltd.): 2% by mass The cyan ink was prepared by adding ion-exchange water to the components so as to give 100% by mass.

(Composition of Magenta Ink (M))

The magenta ink had the same composition as the cyan ink (C) except that the cyan pigment in the composition of the cyan ink (C) was changed to magenta pigment (pigment red 122) so as to have the same amount of the pigment.

(Composition of Yellow Ink (Y))

The yellow ink had the same composition as the cyan ink (C) except that the cyan pigment in the composition of the cyan ink (C) was changed to yellow pigment (pigment yellow 74) so as to have the same amount of the pigment.

(Composition of Black Ink (K))

The black ink had the same composition as the cyan ink (C) except that the cyan pigment in the composition of the cyan ink (C) was changed to black pigment (carbon black) so as to have the same amount of the pigment.

<Preparation of Treatment Liquid>

The respective components were mixed to have the following composition and the treatment liquid was prepared.

Malonic acid (bivalent carboxylic acid, manufactured by Wako Pure Chemical Industries, Ltd.): 15% by mass
Diethylene glycol monomethyl ether (trade name, manufactured by Wako Pure Chemical Industries, Ltd.): 20.0% by mass
N-oleoyl-N-sodium methyl taurate (surfactant): 1.0% by mass The treatment liquid was prepared by adding ion-exchange water to the components so as to give 100% by mass.

<Preparation of Web Members>

(Preparation of Web Member 1)

Silicone oil KF-96-100CS (trade name): 85.0% by mass (trade name, manufactured by Shin-Etsu Chemical Co., Ltd., nonvolatile solvent)
Cross-linked polymethyl methacrylate particles (acryl based): 15.0% by mass (trade name: MX-501, manufactured by Soken Chemical & Engineering Co., Ltd., volume average particle diameter 5 μm, Tg>140° C., polymer particles)

By mixing a liquid (1 L) of the composition as described above using an emulsifying device manufactured by Silverson Machines, Inc. at 8000 rpm for ten minutes, a polymer particle dispersion liquid 1 was manufactured. A web member 1 was manufactured by impregnating the polymer particle dispersion liquid 1 in a non-woven fabric so as to give an impregnated amount of the polymer particle dispersion liquid of 30 g/m$^2$. The non-woven fabric was made of a mixture of polyamide and polyester, and employed one having a weight 30 g/m$^2$ and a thickness 0.1 mm (non-woven fabrics of web members 2 to 5 are the same). Tg for the polymer particles was not observed at 140° C. or less.

(Preparation of Web Member 2)

Silicone oil KF-96-100CS (trade name): (trade name, manufactured by Shin-Etsu Chemical Co., Ltd., nonvolatile solvent) 85.0% by mass
Cross-linked polystyrene particles (volume average particle diameter 5 μm, Tg>140° C., polymer particles): 15.0% by mass By mixing a liquid (1 L) of the composition as described above using an emulsifying device manufactured by Silverson Machines, Inc. at 8000 rpm for ten minutes, a polymer particle dispersion liquid 2 was manufactured. A web member 2 was manufactured by impregnating the polymer particle dispersion liquid 2 in a non-woven fabric so as to give an impregnated amount of the polymer particle dispersion liquid of 30 g/m$^2$.

Tg for the polymer particles was not observed at 140° C. or less.

The cross-linked polystyrene particles can be synthesized by known synthesis methods.

(Preparation of Web Member 3)

Silicone oil KF-96-100cs: (trade name, manufactured by Shin-Etsu Chemical Co., Ltd., nonvolatile solvent) 85.0% by mass
Cross-linked acrylic ester particles (acryl based): (volume average particle diameter 5 um, Tg 100° C., polymer particles) 15.0% by mass By mixing a liquid (1 L) of the compositions as described above using an emulsifying device manufactured by Silverson Machines, Inc. at 8000 rpm for ten minutes, a polymer particle dispersion liquid 3 was manufactured. A web member 3 was manufactured by impregnating the polymer particle dispersion liquid 3 in a non-woven fabric so as to give an impregnated amount of the polymer particle dispersion liquid of 30 g/m$^2$.

The cross-linked acrylic ester particles can be synthesized by known methods.

(Preparation of Web Member 4)

Silicone oil KF-96-100CS: (trade name, manufactured by Shin-Etsu Chemical Co., Ltd., nonvolatile solvent) 85.0% by mass Ethylene-vinyl acetate particles (trade name: CHEMIPEARL V200, manufactured by Mitsui Chemicals, Inc., volume average particle diameter 7 um, Tg 85° C., polymer particles)

By mixing a liquid (1 L) of the composition as described above using an emulsifying device manufactured by Silverson Machines, Inc. at 8000 rpm for ten minutes, a polymer particle dispersion liquid 4 was manufactured. A web member 4 was manufactured by impregnating the polymer particle dispersion liquid 4 in a non-woven fabric so as to give an impregnated amount of the polymer particle dispersion liquid of 30 g/m$^2$.

(Preparation of Web Member 5)

Silicone oil KF-96-100CS: (trade name, manufactured by Shin-Etsu Chemical Co., Ltd., nonvolatile solvent) 85.0% by mass Cross-linked urethane particles: (trade name: C-800 TRANSPARENT, manufactured by Negami Chemical Industrial Co., Ltd., volume average particle diameter 6 um, Tg-13° C., polymer particles) 15.0% by mass By mixing a liquid (1 L) of the composition as described above using an emulsifying device manufactured by Silverson Machines, Inc. at 8000 rpm for ten minutes, a polymer particle dispersion liquid 5 was manufactured. A web member 5 was manufactured by impregnating the polymer particle dispersion liquid 5 in a non-woven fabric so as to give an impregnated amount of the polymer particle dispersion liquid of 30 g/m$^2$.

<Image Recording and Evaluation>

As described below, an image was recorded using the ink having the composition as described above, and the following evaluation was performed. The evaluated result is shown in the following table.

—Both-side Printability—

A GELJET GX5000 (trade name) print head (a full-line head manufactured by RICOH Company, Ltd.) was prepared, and the contents of storage tanks connected thereto was repraced with the cyan ink (C), the magenta ink (M), the yellow ink (Y), and the black ink (K) respectively, obtained as described above. As a recording medium, N SILVER DIAMONDS (trade name, manufactured by Nippon Paper Industries Co., Ltd.) having a basis weight 104 g/m$^2$) was fixed onto a conveying belt which was movable in a predetermined straight line direction at 500 mm/sec, the treatment liquid obtained as described above was coated to have a thickness of about 1.5 μm (corresponding to malonic acid 0.34 g/m$^2$) using a wire bar coater, and was dried at 50° C. for two seconds (FIG. 2) immediately after being coated.

Thereafter, the GELJET GX5000 (trade name) print head (a full-line head manufactured by RICOH Company, Ltd.) was fixed and disposed such that the direction (main scanning direction) of the line head in which the nozzles were arranged was tilted at 75.7° with respect to the direction perpendicular to the movement direction (sub-scanning direction) of the conveying belt. The recording medium was moved in the sub-scanning direction at a constant speed, and the cyan ink (C) and the magenta ink (M) was ejected in the line system under the ejecting condition of the amount of ink droplets of 3.5 pl, an ejecting frequency of 24 kHz and the resolution of 1200 dpi×600 dpi. An evaluation sample was obtained by printing a blue solid image. After the printing, the sample was dried at 60° C. for three seconds.

Next, the web members 1 to 5 were brought into contact with the heating roller, respectively, so as to apply the dispersion liquid onto the heating roller. Then, the recording medium was passed between a pair of rollers, the heating roller heated at 60° C. and the pressing roller, whereby the fixing process was performed at the nip pressure of 0.25 MPa and the nip width of 4 mm, and then the evaluation sample was obtained. The amount of the dispersion liquid applied was 25 mg/m$^2$.

The evaluation was performed according to the following evaluation criteria; the evaluation samples obtained using the web members 1 to 3 were designated as Examples 5 to 7, and the evaluation samples obtained using the web members 4 and 5 were designated as comparative examples 3 and 4.

As the heating roller (the fixing roller) in FIG. 2, a roller having a cylindrical core metal made of SUS having a halogen lamp installed therein and a surface of which was coated with a silicone resin, was used.

<Evaluation Criteria>

The blue solid image manufactured by the image recording was printed successively on a hundred sheets. Thereafter, the hundred sheets were left as they were in a stacked state at room temperature for six hours. In the recording mediums which were left as they were for six hours, a chinese character which means "hawk" in points 8, 9, and 10 was printed on a surface having no the solid image, i.e. opposite to the surface having the solid image, in substantially the same manner as in the formation of the solid image, the resolution of the chinese character "hawk" was visually observed, and the evaluation was performed according to the following evaluation criteria.

A: The character hawk in point 8 can be clearly recognized.

B: The character hawk in point 9 can be clearly recognized.

C: The character hawk in point 10 can be clearly recognized.

C is practically problematic level.

—Evaluation of Image Glossiness—

A solid image was created in substantially the same manner as the both-side printability, and the glossiness of the surface was visually observed, and the evaluation was performed according to the following evaluation criteria.

<Evaluation Criteria>

A: No unnatural impression with respect to an original gloss of paper.

B: The glossiness of the image is higher than the original gloss of paper and there is unnatural impression.

B is practically problematic level.

—Fixing Offset Resistance—

A red solid image was prepared in substantially the same manner as in the evaluation of the both-side printability except that in the ink ejecting conditions, the yellow ink (Y) and the magenta ink (M) were ejected in a line system instead of the cyan ink (C) and the magenta ink (M). A degree peeling caused by the transfer of the solid image to the fixing roller was visually observed, and the evaluation was performed according to the following evaluation criteria.

<Evaluation Criteria>

A: The transfer or peeling of the image is not recognized at all for the entire printed image.

B: Image omission caused by the transfer of the image is recognized in only a part of the entire printed images.

C: Image omission which can be clearly visually found is recognized in the printed image.

C is practically problematic level.

TABLE 4

| | Web member | Polymer particle Tg(° C.) | Both-side print-ability | Image glossiness | Fixing offset resistance |
|---|---|---|---|---|---|
| Example 5 | 1 | 140° C.< | A | A | A |
| Example 6 | 2 | 140° C.< | A | A | A |
| Example 7 | 3 | 100 | A | A | B |

TABLE 4-continued

| | Web member | Polymer particle Tg(° C.) | Both-side print-ability | Image glossiness | Fixing offset resistance |
|---|---|---|---|---|---|
| Comparative example 3 | 4 | 85 | B | B | C |
| Comparative example 4 | 5 | −13 | C | B | C |

When an ink jet image is formed by the second image forming method of the present invention, as can be seen from the Table 4, it is possible to form an image having a good both-side printability, image glossiness, and fixing offset resistance.

III. Examples of Third Image Forming Method

Hereinafter, the third image forming method is described further in detail using Examples.

The weight average molecular weight was measured by gel permeation chromatography (GPC). In GPC, HLC-8220GPC (trade name, manufactured by Tosoh Corporation) was used, TSKgel Super HZM-H, TSKgel Super HZ4000 and TSKgel Super HZ2000 (trade names, manufactured by Tosoh Corporation), three of which were connected in series, were used as the columns, and THF (tetrahydrofuran) was used as an eluent. Further, the conditions included a sample concentration of 0.45% by mass, a flow rate of 0.35 mL/min, an amount of the sample to be injected of 10 μl, a measurement temperature of 40° C., and using an RI detector. Further, a calibration curve was created using eight samples of "STANDARD SAMPLE TSK standard polysterene": "F-40", "F-20", "F-4", "F-1", "A-5000", "A-2500", "A-1000" (trade names), and "n-propyl benzene" each of which was manufactured by Tosoh Corporation.

An acid value was obtained by a method disclosed in JIS specification (JIS K0070: 1992).

The volume average particle diameter was measured by a NANOTRAC particle size distribution measuring instrument UPA-EX150 (trade name, manufactured by NIKKISO Co., Ltd.).

Example 8

Preparation of Self-dispersing Polymer Particles B-01

Methyl ethyl ketone (560.0 g) was placed in a 2 L three-necked flask equipped with a stirrer, a thermometer, a reflux condenser tube, and a nitrogen gas introducing tube, and the temperature was increased to 87° C. While a reflux state was maintained inside the reaction vessel (the reflux was maintained until the end of reaction), a mixed solution including methyl methacrylate 220.4 g, isobornyl methacrylate 301.6 g, methacrylic acid 58.0 g, methyl ethyl ketone 108 g, and "V-601" (trade name, manufactured by Wako Pure Chemical Industries, Ltd.) 2.32 g was added dropwise at a constant speed over two hours (such that the dropwise addition completed in two hours). After completion of the dropwise addition, stirring was performed for one hour, then (1) a solution formed of "V-601" 1.16 g and methyl ethyl ketone 6.4 g was added thereto and the mixture was stirred for two hours, and, the process (1) was repeated four times, and moreover, a solution formed of "V-601" 1.16 g and methyl ethyl ketone 6.4 g was added thereto, and, the resultant was stirred for three hours. After completion of polymerization reaction, the temperature of the solution decreased to 65° C., isopropanol 163.0 g was added thereto and the mixture was allowed to cool. The weight average molecular weight (Mw) of the obtained copolymer was 63,000, and the acid value was 65.1 (mgKOH/g).

Next, 317.3 g (solid concentration of 41.0%) of the obtained polymer solution was weighed, isopropanol 46.4 g, a 20% maleic acid anhydride aqueous solution 1.65 g (a water-soluble acidic compound, corresponding to maleic acid of 0.3% with respect to the copolymer), and a 2 mol/L sodium hydroxide aqueous solution 40.77 g were added thereto, and the temperature in the reaction vessel increased to 70° C. Next, distilled water 380 g was added dropwise at a speed of 10 mL/min so as to disperse the resultant in water (dispersing process). Thereafter, under reduced pressure, the inside of the reaction vessel was maintained at a temperature of 70° C. for 1.5 hours to distil off the isopropanol, the methyl ethyl ketone and distilled water in total amount of 287.0 g (solvent removal process), and PROXEL GXL(S) (trade name, manufactured by Arch Chemicals, Inc.) 0.278 g (benzisothiazoline-3-one of 440 ppm with respect to polymer solid) was added. Thereafter, the filtration was performed using a filter of 1 μm, a filtered liquid was recovered, and an aqueous dispersion of the self-dispersing polymer particles B-01 of solid concentration 26.5% was obtained. The obtained self-dispersing polymer particles were diluted by ion-exchange water and the physical characteristic values of a liquid of 25.0% were measured as a pH 7.8, an electrical conductivity 461 mS/m, a viscosity 14.8 mPa·s, and a volume average particle diameter 2.8 nm.

(Synthesis of Resin Dispersant P-1)

In a 1000 mL three-necked flask equipped with a stirrer and a condenser tube, methyl ethyl ketone 88 g was placed, which was when heated at 72° C. under a nitrogen atmosphere. A solution obtained by dissolving dimethyl 2,2'-azobis isobutyrate 0.85 g, phenoxyethyl methacrylate 50 g, methacrylic acid 11 g, and methyl methacrylate 39 g in methyl ethyl ketone 50 g was added dropwise therein over three hours. After the dropwise addition, the content of the flask further allowed to react for an hour, and then a solution obtained by dissolving dimethyl 2,2'-azobis isobutyrate 0.42 g in methyl ethyl ketone (MEK) 2 g was added thereto. Then the temperature of the resultant was increased to 78° C. and was heated for four hours. MEK was added to the obtained reaction solution to obtain a MEK solution of phenoxyethyl methacrylate/methyl methacrylate/methacrylic acid (copolymer ratio [% by mass]=50/39/11) copolymer (resin dispersant P-1) 36.8% by mass.

The composition of the obtained resin dispersant P-1 was confirmed using 1H-NMR, and the weight average molecular weight (Mw) obtained from GPC was 49,400. Further, an acid value of polymer obtained using a method disclosed in the JIS specification (JIS K0070: 1992) was 71.7 mgKOH/g.

(Synthesis of Resin Dispersant P-2)

In a 1000 mL three-necked flask equipped with a stirrer and a condenser tube, methyl ethyl ketone 240 g, a mixture 30 g of N-(4-vinylbenzyl)-10H-acridine-9-one and N-(3-vinylbenzyl)-10H-acridine-9-one (1/1=wt/wt), methacrylic acid 20 g, ethyl methacrylate 150 g were placed and heated at 75° C. under a nitrogen atmosphere, and a solution obtained by dissolving dimethyl 2,2'-azobis isobutyrate 2.44 g in methyl ethyl ketone 16 g was added thereto.

While the agitation was performed at the same temperature, the content in the flask further allowed to react for two hours. Thereafter a solution obtained by dissolving dimethyl 2,2'-azobis isobutyrate 1.0 g in methyl ethyl ketone 2 g was added thereto, and the contents of the flask further allowed to react for two hours. Then, a solution obtained by dissolving dimethyl 2,2'-azobis isobutyrate 1.0 g in methyl ethyl ketone 2 g was added thereto, and the temperature of the resultant was increased to 80° C. and was heated for four hours.

Methyl ethyl ketone was added to the obtained reaction solution to obtain an MEK solution of resin dispersant P-2 (a mixture of N-(4-vinylbenzyl)-10H-acridine-9-one and N-(3-vinylbenzyl)-10H-acridine-9-one (1/1=wt/wt)/methyl methacrylate/methacrylic acid (copolymer ratio [mass ratio]=15/75/10) copolymer).

A portion of the obtained solution was heated and dried under reduced pressure, and an obtained nonvolatile amount was 36.8% by mass. The composition of the obtained resin dispersant P-2 was confirmed using 1H-NMR, and the weight average molecular weight (Mw) obtained from GPC was 44,200. Further, an acid value of polymer was 65.2 mgKOH/g.

(Preparation of Cyan Pigment Dispersion C)

Pigment blue 15:3 (PHTHALOCYANINE BLUE A220 wet cake (pigment solid content 33.5%), (trade name), manufactured by Dainichiseika Color & Chemicals Mfg. Co., Ltd.) 100 g as a pigment solid content, the phenoxyethyl methacrylate/methyl methacrylate/methacrylic acid copolymer (resin dispersant P-1) 45 g as a solid content, methyl ethyl ketone 140 g, 1 mol/L sodium hydroxide aqueous solution 50.6 g (degree of neutralization 88% by mol with respect to methacrylic acid) as a pH adjuster, and ion-exchange water 331 g were preliminarily dispersed with a disperser, and further underwent eight-pass process with a disperser manufactured by microfluidic Chip Shop GmbH, MICROFLUIDIZER M-140K (trade name), 150 MPa).

The methyl ethyl ketone is removed from the obtained dispersion at 56° C. under reduced pressure, and a portion of water is further removed. Moreover, a high-speed centrifugal cooler 7550 (trade name, manufactured by Kubota Corporation) and a centrifuge tube of 50 mL were used, a centrifugal process is performed at 8000 rpm for thirty minutes, and a supernatant liquid other than sediment was collected.

Next, the obtained dispersion (supernatant liquid) was heated at 70° C. for four hours, and, as antiseptic agents, the following compounds were added so as to give the concentration as follows: 2-methyl-4-isothiazoline-3-one of 80 ppm, 5-chloro-2-methylisothiazoline-3-one of 40 ppm, 2-bromo-2-nitropropane-1 of 10 ppm, 4,4-dimethyloxazolidine of 30 ppm, 1,2-benzisothiazoline-3-one of 80 ppm, and 2-n-octyl-4-isothiazoline-3-one 30 ppm. The thus obtained mixture was filtered and the filtrate was collected.

Thereafter, a pigment concentration was determined from an absorbance spectrum, and a dispersion (cyan pigment dispersion liquid C) of resin-coated pigment particles of which the pigment concentration was 15% was obtained. For the obtained dispersion, the particle diameter was 88 nm, pH was 8.5, and the viscosity was 2.9.

(Preparation of Yellow Pigment Dispersion Y)

As a pigment, pigment yellow 74 (Fast Yellow FG, trade name, manufactured by Sanyo Color Works, LTD.) 100 g, the phenoxyethyl methacrylate/methyl methacrylate/methacrylic acid copolymer (resin dispersant P-1) 42 g as a solid content, methyl ethyl ketone 108 g, 1 mol/L sodium hydroxide aqueous solution 47.2 g (degree of neutralization 88% by mol with respect to methacrylic acid) as a pH adjuster, and ion-exchange water 369.5 g were preliminarily dispersed with a disperser, and further underwent eight-pass process with a disperser (trade name, manufactured by microfluidic Chip Shop GmbH, MICROFLUIDIZER M-140K, trade name, 150 MPa). The resultant was filtered with a filter having a pore diameter of 1 μm, and the filtrate was collected.

Thereafter, by substantially the same method as the cyan pigment dispersion C, a dispersion (yellow pigment dispersion liquid Y) of resin-coated pigment particles of which the pigment concentration was 15% was obtained. For the obtained dispersion, the particle diameter was 91 nm, pH was 8.6, and the viscosity was 3.2 mPa·s.

(Preparation of Black Pigment Dispersion K)

As a pigment, carbon black (#2600, trade name, manufactured by Mitsubishi Chemical Corporation) 100 g, the phenoxyethyl methacrylate/methyl methacrylate/methacrylic acid copolymer (resin dispersant P-1) 57 g as a solid content, methyl ethyl ketone 155.8 g, a 1 mol/L sodium hydroxide aqueous solution 80.8 g (degree of neutralization 110% by mol with respect to methacrylic acid) as a pH adjuster, and ion-exchange water 491 g were preliminarily dispersed with a disperser, and further underwent eight-pass process with a beads-mill disperser using 0.1 mmΦ zirconia beads. The resultant was filtered with a filter having a pore diameter of 1 μm, and the filtrate was collected. Thereafter, by substantially the same method as the cyan pigment dispersion C, a dispersion (black pigment dispersion liquid K) of resin-coated pigment particles of which the pigment concentration was 15% was obtained. For the obtained dispersion, the particle diameter was 73 nm, pH was 8.4, and the viscosity was 3.9 mPa·s.

(Preparation of Magenta Pigment Dispersion M)

Pigment red 122 (CROMOPHTAL JET MAGENTA DMQ, trade name, manufactured by BASF; magenta pigment) 100 g, the resin dispersant P-2 30 g as a solid content, methyl ethyl ketone 133 g, 1 mol/L sodium hydroxide aqueous solution 27.2 g (degree of neutralization 78% by mole with respect to methacrylic acid), and ion-exchange water 424 g were mixed and preliminarily dispersed with a disperser, and further underwent ten-pass process with a disperser (MICROFLUIDIZER M-140K, trade name, 150 MPa).

Thereafter, by substantially the same method as the cyan pigment dispersion C, a dispersion (magenta pigment dispersion liquid M) of resin-coated pigment particles of which the pigment concentration was 15% was obtained. For the obtained dispersion, the particle diameter was 76 nm, pH was 8.6, and the viscosity was 2.8 mPa·s.

(Preparation of Ink Compositions)

Using the pigment dispersions of four colors and the self-dispersing polymer particles B-01, the respective components were mixed to have the following compositions shown in the Table 5. Each of these mixtures was placed in a plastic disposable syringe, and filtered using a filter having a pore diameter of 5 μm and made of polyvinylidene fluoride (PVDF) (MILLEX-SV (trade name), diameter 25 mm, manufactured by Millipore Corporation), thereby obtaining the ink compositions of the respective colors (Y1 to Y3, M1to M3, C1 to C3, and K1 to K3).

TABLE 5

| Ink composition | C1 | C2 | C3 | M1 | M2 | M3 |
|---|---|---|---|---|---|---|
| Cyan pigment (pigment blue 15:3) | 2.5% | 2.5% | 2.5% | | | |
| Magenta pigment (pigment red 122) | | | | 5.0% | 5.0% | 5.0% |
| Yellow pigment (pigment yellow 74) | | | | | | |
| Carbon black | | | | | | |

TABLE 5-continued

| | | | | | | |
|---|---|---|---|---|---|---|
| Resin dispersant P-1 (solid content) | 1.13% | 1.13% | 1.13% | | | |
| Resin dispersant P-2 (solid content) | | | | 1.5% | 1.5% | 1.5% |
| Self-dispersing polymer particleB-01 (solid content) | 8.5% | 8.5% | 8.5% | 6.25% | 6.25% | 6.25% |
| SANNIX GP250 *1 | 10% | 8% | 6% | 6% | 10% | 8% |
| Tripropylene glycol monomethyl ether *2 | 2% | 8% | 6% | 6% | 2% | 4% |
| Dipropylene Glycol *3 | 4% | | 4% | 4% | 4% | 4% |
| Urea *4 | 5% | 5% | 5% | 5% | 5% | 5% |
| NEWPOL PE-108 *5 | | | | | | |
| OLFINE E1010 *6 | 1.50% | 1.50% | 1.50% | 1.50% | 1.50% | 1.50% |
| Carnauba wax *7 (solid content) | 2% | | 2% | | 2% | 2% |
| Paraffin wax *8 (solid content) | | 2% | | 2% | | |
| Colloidal silica *9 (solid content) | 0.05% | 0.05% | 0.05% | 0.05% | 0.05% | 0.05% |
| Ion-exchange water | remainder | remainder | remainder | remainder | remainder | remainder |
| Ink composition | Y1 | Y2 | Y3 | K1 | K2 | K3 |
| Cyan pigment (pigment blue 15:3) | | | | | | |
| Magenta pigment (pigment red 122) | | | | | | |
| Yellow pigment (pigment yellow 74) | 4.0% | 4.0% | 4.0% | | | |
| Carbon black | | | | 3.0% | 3.0% | 3.0% |
| Resin dispersant P-1 (solid content) | 1.7% | 1.7% | 1.7% | 1.3% | 1.3% | 1.3% |
| Resin dispersant P-2 (solid content) | | | | | | |
| Self-dispersing polymer particleB-01 (solid content) | 7% | 7% | 7% | 7% | 7% | 7% |
| SANNIX GP250 *1 | 10% | 10% | 10% | 10% | 8% | 6% |
| Tripropylene glycol monomethyl ether *2 | 3% | 4% | 2% | 2% | 8% | 6% |
| Dipropylene Glycol *3 | 3% | 2% | 4% | 4% | | 4% |
| Urea *4 | 5% | 5% | 5% | 5% | 5% | 5% |
| NEWPOL PE-108 *5 | | | | 0.05% | 0.05% | 0.05% |
| OLFINE E1010 *6 | 1.00% | 1.00% | 1.00% | 1.00% | 1.00% | 1.00% |
| Carnauba wax *7 (solid content) | 2% | | 2% | 2% | | 2% |
| Paraffin wax *8 (solid content) | | 2% | | | 2% | |
| Colloidal silica *9 (solid content) | 0.05% | 0.05% | 0.05% | 0.05% | 0.05% | 0.05% |
| Ion-exchange water | remainder | remainder | remainder | remainder | remainder | remainder |

SANNIX GP250 *1: trade name, manufactured by Sanyo Chemical Industries, Ltd., hydrophilic organic solvent
Tripropylene glycol monomethyl ether *2: manufactured by Nippon Nyukazai Co., Ltd., MFTG, hydrophilic organic solvent
Dipropylene Glycol *3: manufactured by ADEKA corporation, DPG
Urea *4: manufactured by Nissan Chemical Industries, Ltd., solid moisturizing agent
NEWPOL PE-108 *5: trade name, manufactured by Sanyo Chemical Industries, Ltd.,thickener
OLFINE E1010 *6: trade name, manufactured by Nissin Chemical CO., Ltd.) surfactant
Carnauba wax as solid *7: manufactured by CHUKYO YUSHI CO., LTD., CELLOSOL 524 (tradename)
Paraffin wax as solid *8: manufactured by CHUKYO YUSHI CO., LTD. TORASORU PF60 (trade name)
Colloidal silica as solid *9: manufactured by Nissan Chemical Industries, Ltd., SNOWTEX XS (trade name)

(Preparation of Treatment Liquids T-1 to T-7)

The treatment liquids were prepared so as to have the compositions shown in the following Table 6. In addition, the viscosity and the surface tension were measured in the same manner as described in the section of "III. Third Image Forming Method" in the above.

TABLE 6

| Treatment liquid composition | T-1 | T-2 | T-3 | T-4 | T-5 | T-6 | T-7 |
|---|---|---|---|---|---|---|---|
| Malonic acid (bivalent carboxylic acid, manufactured by TATEYAMA KASEI Co., Ltd) | 11.25% | 11.25% | 7.9% | 7.9% | 7.9% | 7.9% | 7.9% |
| DL-Malic acid (bivalent carboxylic acid, manufactured by Fuso Chemical Co., Ltd.) | 14.5% | 14.5% | 10.2% | 10.2% | 10.2% | 10.2% | 10.2% |
| Tartaric acid (bivalent carboxylic acid, manufactured by Wako Pure Chemical Industries, Ltd.) | | | 5.0% | | | | |
| Phosphoric acid (trivalent acid, manufactured by Wako Pure Chemical Industries, Ltd.) | | | | 4.0% | 2.0% | | 4.0% |
| Diethylene glycol monobutyl ether (DIETHYLENE GLYCOL MONOBUTYL ETHER or BUTYCENOL-20P (trade name), manufactured by Kyowa Hakko Chemical Co., Ltd.,, trade name, hydrophilic organic solvent) | | 4.0% | 3.0% | 4.0% | 3.0% | 4.0% | 3.0% |
| Tripropylene glycol monoethyl ether (trade name, manufactured by Nippon Nyukazai Co., Ltd., MFTG, hydrophilic organic solvent) | | 4.0% | 2.0% | 4.0% | 5.0% | 4.0% | |

TABLE 6-continued

| Treatment liquid composition | T-1 | T-2 | T-3 | T-4 | T-5 | T-6 | T-7 |
|---|---|---|---|---|---|---|---|
| SANNIX GP250 (trade name, manufactured by Sanyo Chemical Industries, Ltd., hydrophilic organic solvent) | 10.0% | | 8.0% | | | | 10.0% |
| Ion-exchange water | remainder | remainder | remainder | remainder | remainder | remainder | remainder |

(Preparation of Particle-Containing Liquid 1)

Dimethyl silicone oil (nonvolatile solvent) (manufactured by Shin-Etsu Chemical Co., Ltd., KF-96-100 CS, trade name) 85.0% by mass Polymethyl methacrylate (PMMA) particles (EPOSTAR MA1010, trade name, manufactured by Nippon Shokubai Co., Ltd., volume average particle diameter 10 μm) 15.0% by mass By mixing a liquid (1 L) of the composition as described above using an emulsifying device manufactured by Silverson Machines, Inc. at 8000 rpm for ten minutes, a particle-containing liquid 1 was manufactured.

(Preparation of Particle-Containing Liquid 2)

Dimethyl silicone oil (nonvolatile solvent) (trade name, manufactured by Shin-Etsu Chemical Co., Ltd., KF-96-100 CS, trade name) 85.0% by mass Polymethyl methacrylate particles (manufactured by Soken Chemical & Engineering Co., Ltd., MX-800, trade name, volume average particle diameter 8 μm) 15.0% by mass By mixing a liquid (1 L) of the composition as described above using an emulsifying device manufactured by Silverson Machines, Inc. at 8000 rpm for ten minutes, a particle-containing liquid 2 was manufactured.

(Preparation of Particle-Containing Liquid 3)

Dimethyl silicone oil (nonvolatile solvent) (manufactured by Shin-Etsu Chemical Co., Ltd., KF-96-100 CS, trade name) 85.0% by mass Polymethyl methacrylate particles (trade name, manufactured by Soken Chemical & Engineering Co., Ltd., MX-501, trade name, volume average particle diameter 5 μm) 15.0% by mass By mixing a liquid (1 L) of the composition as described above using an emulsifying device manufactured by Silverson Machines, Inc. at 8000 rpm for ten minutes, a particle-containing liquid 3 was manufactured.

(Preparation of Particle-Containing Liquid 4)

Dimethyl silicone oil (nonvolatile solvent) (trade name, manufactured by Shin-Etsu Chemical Co., Ltd., KF-96-100 CS, trade name) 85.0% by mass Polymethyl methacrylate particles (trade name, manufactured by Soken Chemical & Engineering Co., Ltd., MX-300, trade name volume average particle diameter 3 μm) 15.0% by mass By mixing a liquid (1 L) of the composition as described above using an emulsifying device manufactured by Silverson Machines, Inc. at 8000 rpm for ten minutes, a particle-containing liquid 4 was manufactured.

(Preparation of Particle-Containing Liquid 5)

Dimethyl silicone oil (nonvolatile solvent) (trade name, manufactured by Shin-Etsu Chemical Co., Ltd., KF-96-100 CS, trade name) 85.0% by mass Polymethyl methacrylate particles (manufactured by Soken Chemical & Engineering Co., Ltd., MX-1500H, trade name, volume average particle diameter 15 μm) 15.0% by mass By mixing a liquid (1 L) of the composition as described above using an emulsifying device manufactured by Silverson Machines, Inc. at 8000 rpm for ten minutes, a particle-containing liquid 5 was manufactured.

(Preparation of Particle-Containing Liquid 6)

Dimethyl silicone oil (nonvolatile solvent) (trade name, manufactured by Shin-Etsu Chemical Co., Ltd., KF-96-100 CS, trade name) 85.0% by mass Polymethyl methacrylate particles (manufactured by Soken Chemical & Engineering Co., Ltd., MX-3000, trade name, volume average particle diameter 32 μm) 15.0% by mass By mixing a liquid (1 L) of the composition as described above using an emulsifying device manufactured by Silverson Machines, Inc. at 8000 rpm for ten minutes, a particle-containing liquid 6 was manufactured.

(Preparation of No Particle-Containing Liquid 7)

Dimethyl silicone oil (nonvolatile solvent) (trade name, manufactured by Shin-Etsu Chemical Co., Ltd., KF-96-100 CS, trade name) 100.0% by mass (Preparation of Particle-Containing Liquid 8)

The particle-containing liquid 8 was prepared using the coating agent B2 in Example 2 in JP-A No. 2007-296637.

Emulsion type resin (JONCRYL 7600, trade name, manufactured by BASF) 21% by mass Polyethylene wax (manufactured by Mitsui Chemicals, Inc. and GifuShellac Manufacturing. Co., Ltd., average particle diameter: 2 μm) 9% by mass Leveler (non-silicon based surfactant, OLFINE PD-001, trade name, manufactured by Nisshin Chemical Co., Ltd.) 10% by mass Antifoaming agent (mineral oil) (ADEKANATE B-940, trade name, manufactured by Adeka Corporation) 1% by mass Precipitation preventing agent (modified sodium polyacrylates) (SN THICKENER 618, manufactured by San Nopco Limited) 5% by mass Water 54% by mass By mixing a liquid (1 L) of the composition as described above using an emulsifying device manufactured by Silverson Machines, Inc. at 8000 rpm for ten minutes, a particle-containing liquid 8 was manufactured.

(Preparation of Particle-Containing Liquid 9)

The particle-containing liquid 9 was prepared using the coating agent E2 in Example 2 in JP-A No. 2007-296637.

Emulsion type resin (JONCRYL 7600, trade name manufactured by BASF) 21% by mass

Polyethylene wax (manufactured by Mitsui Chemicals, Inc. and GifuShellac manufacturing. Co., Ltd., average particle diameter: 6 μm) 9% by mass Leveler (non-silicon based surfactant, OLFINE PD-001, trade name, manufactured by Nissin Chemical CO., Ltd.) 10% by mass Antifoaming agent (mineral oil) (ADEKANATE B-940, trade name manufactured by Adeka Corporation) 1% by mass Precipitation preventing agent (modified sodium polyacrylates) (SN THICKENER 618, trade name, manufactured by San Nopco Limited) 5% by mass Water 54% by mass By mixing a liquid (1 L) of the composition as described above using an emulsifying device manufactured by Silverson Machines, Inc. at 8000 rpm for ten minutes, a particle-containing liquid 9 was manufactured.

(Preparation of Particle-Containing Liquid 10)

Isopropyl alcohol (nonvolatile solvent) (Wako Pure Chemical Industries, Ltd.) 85.0% by mass Polymethyl methacrylate particles (EPOSTAR MA1010, trade name, manufactured by Nippon Shokubai Co., Ltd., volume average particle diameter 10 μm) 15.0% by mass By mixing a liquid (1 L) of the composition as described above using an emulsifying device manufactured by Silverson Machines, Inc. at 8000 rpm for ten minutes, a particle-containing liquid 10 was manufactured.

<Image Formation and Evaluation>

As described below, an image was formed using the ink prepared as described above, and the following evaluation was performed. The evaluated result is shown in the following table.

(Evaluation of Fixing Offset Resistance)

A GELJET GX5000 (trade name) print head (a full-line head manufactured by RICOH Company, Ltd.) was prepared, and the content storage tanks connected thereto were replaced with the cyan ink composition C1, the magenta ink composition M1, the yellow ink composition Y1, and the black ink composition K1 again, obtained as described above. As a recording medium, SILVER DIAMOND (trade name, manufactured by Nippon Paper Industries Co., Ltd.) which is matte paper was fixed onto a stage which was movable in a predetermined straight line direction at 500 mm/sec, the treatment liquid T-1 obtained as described above was coated to give 1.7 g/m$^2$ using a wire bar coater, and was dried at 50° C. for two seconds immediately after being coated.

Thereafter, the GELJET GX5000 (trade name) print head (a full-line head manufactured by RICOH Company, Ltd.) was fixed and disposed such that the direction (main scanning direction) of the line head in which the nozzles are arranged was tilted at 75.7° with respect to the direction perpendicular to the movement direction (sub-scanning direction) of the stage. The recording medium was moved in the sub-scanning direction at a constant speed, and the ink was ejected in the line system under the ejecting condition of the amount of M1 ink composition droplets of 2.4 μl, an ejecting frequency of 24 kHz and the resolution of 1200 dpi×1200 dpi, thereby printing a solid image. Immediately thereafter, a solid image was printed on the ink composition M1 using the ink composition C1 in the same manner as the ink composition M1, and after the print, a solid image printing sample 1 was obtained by drying the solid image at 60° C. for three seconds.

Next, the particle-containing liquid 1 was applied on the fixing roller heated to 60° C. With respect to the obtained solid image printing sample 1, the fixing roller was brought into contact with the ink composition-applied side of the recording medium onto which the ink composition was applied, then the fixing process was performed at the nip pressure of 0.25 MPa and the nip width of 4 mm, and thereafter the evaluation sample 1, in which the particle-containing liquid 1 was applied on the recording medium, was obtained. Here, the amount of the particle-containing liquid to be applied onto the recording medium was 30 mg/m$^2$.

The evaluation samples 2 to 7, and 10 were manufactured in substantially the same manner as the method of manufacturing the evaluation sample 1 except that the particle-containing liquid was changed to the ones shown in the following table.

When the particle-containing liquids 8 and 9 were respectively used to manufacture the samples in substantially the same manner as the method of manufacturing the evaluation sample 1, in the process of applying the particle-containing liquids 8 or 9 onto the fixing roller heated to 60° C., in the fixing roller surface, portions where the particle-containing liquids 8 or 9 were attached to and not detached were generated, and thus these particle-containing liquids could not be efficiently applied onto the recording medium. Thus, after the particle-containing liquids 8 or 9 were provided on the recording medium by a roll coat method, the fixing roller heated to 60° C. was brought into contact with the recording medium, and the fixing process was performed at the nip pressure of 0.25 MPa and the nip width of 4 mm, thereby obtaining the evaluation samples 8 and 9. Even by the use of the method, the attachment of the particle-containing liquid to the fixing roller was observed still, but the particle-containing liquids 8 and 9 could be applied onto the recording medium.

Here, for the evaluation samples 2 to 10, the same solid image printing samples as the solid image printing sample 1 are used.

An evaluation sample 11 was prepared by substantially the same manufacturing method as the evaluation sample 3 except that the amount of ink composition droplets to be applied was changed to 2.1 μl. Here, a solid image printing sample using the evaluation sample 11 was defined as a solid image printing sample 11.

A printed portion in the solid image printing sample 1 was cut in a perpendicular direction with respect to the paper surface, the cross section was observed with an electron microscope, and the maximum thickness of the ink composition was measured. As a result, the maximum thickness of the ink composition was 2.59 μm. In the same manner, the maximum thickness of the ink composition in the solid image printing sample 11 used in the evaluation sample 11 was 2.27 μm.

A degree of peeling caused by the transfer of the image on the image surface to the fixing roller immediately after the evaluation sample was prepared was visually observed, and the evaluation was performed according to the following evaluation criteria.

<Evaluation Criteria>

A: The transfer or peeling of the image is not recognized at all in the entire printed image.

B: Image deletion caused by the transfer of the image is recognized in only a in small portion of the entire printed images. Practically problematic level.

C: Image deletion is clearly recognized by visual observation. Practically problematic.

—Evaluation of Image Gloss (Surface Gloss)—

A surface glossiness of the image surface of the evaluation sample prepared in the same manner as in the evaluation of the fixing offset resistance evaluation was visually observed, and the evaluation was performed according to the following evaluation criteria.

<Evaluation Criteria>

A: There is no gloss in the surface of the printed image, and the image is preferred as a matte surface.

B: A little gloss is recognized in the surface of the printed image. At a practically acceptable limit level.

C: The image surface is glossy, and gives unnatural impression. Practically unacceptable.

The evaluation results are shown in the following table.

TABLE 8

| Evaluation samples | Particle-containing liquid | Liquid included in particle-containing liquid Kinds | Particle include in particle-containing liquid Kinds | Volume average particle diameter B (μm) | Maximum thickness of ink composition applied onto recording medium A (μm) | B/A ratio | fixing offset | image gloss | remarks |
|---|---|---|---|---|---|---|---|---|---|
| No. 1 | 1 | dimethylsilicone oil | PMMA | 10 | 2.59 | 3.9 | A | A | present invention |
| No. 2 | 2 | dimethylsilicone oil | PMMA | 8 | 2.59 | 3.1 | A | A | present invention |
| No. 3 | 3 | dimethylsilicone oil | PMMA | 5 | 2.59 | 1.9 | B | A | Comparative example |
| No. 4 | 4 | dimethylsilicone oil | PMMA | 3 | 2.59 | 1.2 | C | A | Comparative example |
| No. 5 | 5 | dimethylsilicone oil | PMMA | 15 | 2.59 | 5.9 | A | A | present invention |
| No. 6 | 6 | dimethylsilicone oil | PMMA | 32 | 2.59 | 12.4 | A | B | present invention |
| No. 7 | 7 (containing no particles) | dimethylsilicone oil | | | 2.59 | | C | A | comparative example |
| No. 8 | 8 | Water | PE wax | 2 | 2.59 | 0.8 | C | C | comparative example |
| No. 9 | 9 | Water | PE wax | 6 | 2.59 | 2.3 | C | C | comparative example |
| No. 10 | 10 | isopropyl alcohol | PMMA | 10 | 2.59 | 3.9 | C | A | comparative example |
| No. 11 | 3 | dimethylsilicone oil | PMMA | 5 | 2.27 | 2.2 | A | A | present invention |

From the results shown in the table, in a case in which the samples were created by the third image forming method of the present invention, it was possible to suppress the nozzles of the ink jet from being clogged, and also to obtain the samples excellent in terms of the fixing offset resistance. In addition, the image gloss was good. The samples (samples Nos. 3 and 4) of which the volume average particle diameter of the particles was smaller than the size of two times the maximum thickness of the ink composition, and the sample (sample No. 7) in which particles were not applied onto the recording medium were practically problematic with respect to the fixing offset. Further, the samples Nos. 8 and 9 were practically problematic in terms of in the fixing offset and the image gloss. Particularly, regarding the image gloss, it is thought that since components in the particle-containing liquid formed a film, the surface gloss became excessively high and unnatural impression was given with respect to the image quality. With respect to the sample No. 10, it is thought that since a nonvolatile solvent was used, the application of the particle-containing liquid could not be efficiently performed and thus the fixing offset property was problematic.

Example 9

The combination of the ink compositions M1 and C1 (M1, C1) used in Example 8 was changed as in the following, and samples were manufactured in substantially the same manner as in Example 8 and then evaluated. As a result, it was possible to obtain a good result by the third image forming method as in Example 8. In a case in which the three colors of magenta, cyan, and yellow were combined, in preparing the samples, the total amount of droplets of the ink compositions M1 and C1 in Example 8 were divided to the three colors.

(M2, C2) (M3, C3)

(M1, Y1) (M1, Y2) (M1, Y3)

(M1, K1) (M1, K2) (M1, K3)

(Y1, C1) (Y2, C1) (Y3, C1)

(M1, C1, Y1)

Example 10

Evaluation samples were manufactured in substantially the same manner as in Example 8 except that the treatment liquid T-1 in Example 8 was changed to the treatment liquids T-2 to T-7 and then evaluated, and, as a result, good results were obtained by the third image forming method of the present invention as in Example 8.

Example 11

Evaluation samples were manufactured in substantially the same manner as in Example 8 except that the recording medium used in Example 8 was changed to OK TOPKOTE+ having a basis weight of 104.7 g/m$^2$ (trade name, manufactured by Oji paper Co.), and then evaluated, and as a result, in the samples of the present invention, as in Example 8, the fixing offset resistance and the surface gloss were all good. However, in a case in which a B/A ratio (a ratio of the volume average particle diameter of the particles in the particle-containing liquid to the maximum thickness of the film of the ink composition applied on the recording medium) exceeded 6, a slight roughness was seen on the surface. In the samples Nos. 8 and 9, the components in the particle-containing liquid formed film, the surface gloss became excessively high, which caused unnatural impression, and thus it was problem in terms of image quality.

According to the first image forming method, in a case in which an image is recorded on a recording medium by the ink jet method, it is possible to attain glossiness of a printed article at a good level, to suppress the blocking in the printed article, and to further improve the fixing offset resistance. Moreover, It is also possible to improve the abrasion resistance in a recorded image.

According to the second image forming method, in a case in which an image is formed on a recording medium by the ink jet method, it is possible to attain glossiness of the image at a good level, to suppress the fixing offset in the image portion, and also to improve the both-side printability.

According to the third image forming method, it is possible to provide an inkjet printed article in which the fixing offset is suppressed while occurrence of the nozzle clogging of the ink jet is also suppressed.

In the present specification, the definition of the term "(meth)acrylate" includes "acrylate" and "methacrylate", the definition of the term "(meth)acrylamide" includes "acrylamide" and "methacrylamide", and the definition of the term "(meth)acrylic" includes "acrylic" and "methacrylic".

Exemplary embodiments of the invention include, but are not limited to, the following.

<1> An Image Forming Method Comprising:

applying an ink composition onto a recording medium using an inkjet apparatus, and applying an liquid including particles onto the recording medium.

<2> The image forming method according to <1>, wherein:

the ink composition comprises a coloring material, first polymer particles having a film-forming property, a water-soluble organic solvent, and water;

the liquid including particles includes second polymer particles having a glass transition temperature; and the application of the liquid including particles onto the recording medium includes:

applying the liquid including the second polymer particles onto a surface of a heating roller or a surface of an image formed on the recording medium by the application of the ink composition; and bringing the heating roller into contact with the surface of the image; and wherein a minimum film-forming temperature $T_A$ expressed by ° C. of a mixture of the first polymer particles and the water-soluble organic solvent, a surface temperature $T_B$ expressed by ° C. of the heating roller, and a glass transition temperature $T_C$ expressed by ° C. of the second polymer particles satisfy the relationship of $T_A<T_B<T_C$.

<3> The image forming method according to <2>, wherein the application of the liquid including the second polymer particles onto the surface of the heating roller or the surface of the image comprises bringing a fabric material comprising the liquid including the second polymer particles into contact with the heating roller.

<4> The image forming method according to <2> or <3>, wherein the first polymer particles comprise a self-dispersing polymer.

<5> The image forming method according to <4>, wherein the self-dispersing polymer comprises at least one of a hydrophilic constituent unit or constituent unit derived from an alicyclic monomer.

<6> The image forming method according to any one of <2> to <5>, wherein the liquid including the second polymer particles comprises a nonvolatile solvent.

<7> The image forming method according to any one of <2> to <6>, wherein the second polymer particles are water-insoluble.

<8> The image forming method according to any one of <2> to <7>, wherein the second polymer particles comprises polymethyl(meth)acrylate.

<9> The image forming method according to any one of <2> to <8>, wherein at least one of the following relationships A to C is satisfied:

A. the minimum film forming temperature $T_A$ is from 20° C. to 70° C.;

B. the surface temperature $T_B$ is from 40° C. to 100° C.;

C. the glass transition temperature $T_C$ is 80° C. or higher.

<10> The image forming method according to <1>, wherein the liquid including particles is a dispersion liquid that includes polymer particles and a nonvolatile solvent;

the polymer particles have a volume average diameter of from 1 μm to 30 μm and a glass transition temperature Tg of 100° C. or higher, preferably from 100° C. to 180° C.; and in the application of the liquid including particles onto the recording medium, the dispersion liquid is applied onto the recording medium onto which the ink composition has been applied.

<11> The image forming method according to <10>, wherein the polymer particles are crosslinked polymer particles.

<12> The image forming method according to <10> or <11>, wherein in the application of the liquid including particles onto the recording medium, the dispersion liquid is supplied to a surface of a heating roller, and the recording medium is pressed with the heating roller.

<13> The image forming method according to any one of <10> to <12>, wherein the polymer particles comprise polymethyl(meth)acrylate or polystyrene.

<14> The image forming method according to any one of <10> to <13>, wherein a conveying speed for conveying the recording medium is 200 mm/s or higher.

<15> The image forming method according to any one of <10> to <14>, wherein in the application of the ink composition onto the recording medium, the application of the ink composition is performed by a single pass method.

<16> The image forming method according to any one of <10> to <15>, further comprising applying, to the recording medium, a treatment liquid capable of forming aggregates by contacting with the ink composition.

<17> The image forming method according to <1>, wherein the liquid including particles further includes particles and a nonvolatile solvent, and a volume average particle diameter of the particles is two times or larger, preferably from 2 times to 6 times, and more preferably from 2.5 times to 5 times, a maximum thickness of a dried film of the ink composition applied onto the recording medium.

<18> The image forming method according to <17>, wherein the nonvolatile solvent comprises silicone oil or a fluorine-containing oil.

<19> The image forming method according to <17> or <18>, wherein the particles comprise polymethyl(meth)acrylate.

<20> The image forming method according to any one of <17> to <19>, wherein the volume average particle diameter of the particles is from 4 μm to 15 μm.

All publications, patent applications, and technical standards mentioned in this specification are herein incorporated by reference to the same extent as if each individual publication, patent application, or technical standard was specifically and individually indicated to be incorporated by reference.

What is claimed is:

1. An image forming method, comprising:

applying an ink composition onto a recording medium using an inkjet apparatus, the ink composition comprising a coloring material, first polymer particles having a film-forming property, a water-soluble organic solvent, and water;

applying a liquid including second polymer particles having a glass transition temperature onto the recording medium; wherein the application of the liquid including the second polymer particles onto the recording medium includes:

applying the liquid including the second polymer particles onto a surface of a heating roller; and bringing the heating roller into contact with a surface of an image formed on the recording medium by the application of the ink composition; and wherein a minimum film-forming temperature $T_A$ expressed by ° C. of a mixture of the first polymer particles and the water-soluble organic solvent, a surface temperature $T_B$ expressed by ° C. of the heating roller, and a glass transition temperature $T_c$ expressed by ° C. of the second polymer particles satisfy the relationship of $T_A<T_B<T_C$.

2. The image forming method according to claim 1, wherein the application of the liquid including the second polymer particles onto the surface of the heating roller comprises bringing a fabric material comprising the liquid including the second polymer particles into contact with the heating roller.

3. The image forming method according to claim 1, wherein the first polymer particles comprise a self-dispersing polymer.

4. The image forming method according to claim 3, wherein the self-dispersing polymer comprises at least one of a hydrophilic constituent unit or a constituent unit derived from an alicyclic monomer.

5. The image forming method according to claim 1, wherein the liquid including the second polymer particles comprises a nonvolatile solvent.

6. The image forming method according to claim 1, wherein the second polymer particles are water-insoluble.

7. The image forming method according to claim 1, wherein the second polymer particles comprise polymethyl (meth)acrylate.

8. The image forming method according to claim 1, wherein at least one of the following relationships A to C is satisfied:

A. the minimum film forming temperature $T_A$ is from 20° C. to 70° C.;

B. the surface temperature $T_B$ is from 40° C. to 100° C.;

C. the glass transition temperature $T_C$ is 80° C. or higher.

9. An image forming method comprising:

applying an ink composition onto a recording medium using an inkjet apparatus; and applying a dispersion liquid onto the recording medium onto which the ink composition has been applied, wherein the dispersion liquid includes polymer particles and a nonvolatile solvent;

the polymer particles have a volume average diameter of from 1 μm to 30 μm and a glass transition temperature Tg of 100° C. or higher; and in the application of the dispersion liquid onto the recording medium, the dispersion liquid is supplied to a surface of a heating roller, and the recording medium is pressed with the heating roller.

10. The image forming method according to claim 9, wherein the polymer particles are crosslinked polymer particles.

11. The image forming method according to claim 9, wherein the polymer particles comprise polymethyl(meth) acrylate or polystyrene.

12. The image forming method according to claim 9, wherein a conveying speed for conveying the recording medium is 200 mm/s or higher.

13. The image forming method according to claim 9, wherein, in the application of the ink composition onto the recording medium, the application of the ink composition is performed by a single pass method.

14. The image forming method according to claim 9, further comprising applying, to the recording medium, a treatment liquid capable of forming aggregates by contacting with the ink composition.

15. The image forming method according to claim 9, wherein the application of the dispersion liquid onto the surface of the heating roller comprises bringing a fabric material comprising the dispersion liquid into contact with the heating roller.

16. An image forming method comprising:

applying an ink composition onto a recording medium using an inkjet apparatus; and applying a liquid including particles and a nonvolatile solvent onto the recording medium, wherein a volume average particle diameter of the particles is equal to or greater than two times a maximum thickness of a dried film of the ink composition applied onto the recording medium.

17. The image forming method according to claim 16, wherein the nonvolatile solvent comprises silicone oil or a fluorine-containing oil.

18. The image forming method according to claim 16, wherein the particles comprise polymethyl(meth)acrylate.

19. The image forming method according to claim 16, wherein the volume average particle diameter of the particles is from 4 μm to 15 μm.

20. The image forming method according to claim 16, wherein the application of the liquid including the particles and the nonvolatile solvent onto the recording medium comprises bringing a web member impregnated with the liquid including the particles and the nonvolatile solvent into contact with a surface of a fixing member to supply the liquid including the particles and the nonvolatile solvent to the fixing member, and then bringing the fixing member into contact with the surface of the recording medium onto which the ink composition has been applied.

* * * * *